US012305418B2

(12) United States Patent
Huang et al.

(10) Patent No.: US 12,305,418 B2
(45) Date of Patent: May 20, 2025

(54) INFLATABLE PRODUCT

(71) Applicant: BESTWAY INFLATABLES & MATERIAL CORP., Shanghai (CN)

(72) Inventors: Shuiyong Huang, Shanghai (CN); Qingshui Song, Shanghai (CN); Yunzhe Ban, Shanghai (CN); Chenggen Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 133 days.

(21) Appl. No.: 17/876,241

(22) Filed: Jul. 28, 2022

(65) Prior Publication Data

US 2023/0349184 A1 Nov. 2, 2023

(30) Foreign Application Priority Data

Apr. 27, 2022 (CN) ..... 202210458848.3
Apr. 27, 2022 (CN) ..... 202221006772.2

(51) Int. Cl.
*E04H 4/00* (2006.01)
*A47C 27/08* (2006.01)
*B63B 34/52* (2020.01)

(52) U.S. Cl.
CPC ..... *E04H 4/0025* (2013.01); *A47C 27/081* (2013.01); *A47C 27/087* (2013.01); *B63B 34/52* (2020.02)

(58) Field of Classification Search
CPC ..... E04H 4/0025; B63B 34/52; A47C 27/081; A47C 27/087; A47C 4/54
USPC ..... 4/506, 584, 588; 428/12
See application file for complete search history.

(56) References Cited

U.S. PATENT DOCUMENTS 2,663,659 A 12/1953 Miller
5,490,295 A * 2/1996 Boyd ..... A47C 27/081 5/687
2012/0031265 A1 2/2012 Song et al.
2014/0332142 A1* 11/2014 Lin ..... A47C 27/087 156/87
2015/0335164 A1 11/2015 Liu

FOREIGN PATENT DOCUMENTS

CN 209211974 8/2019
GB 2519244 4/2015

OTHER PUBLICATIONS

Extended European Search Report dated Jan. 2, 2023 (Jan. 2, 2023) issued on related European Patent Application 22182931.2 by the European Patent Office.

* cited by examiner

*Primary Examiner* — Tuan N Nguyen
(74) *Attorney, Agent, or Firm* — DICKINSON WRIGHT PLLC

(57) ABSTRACT

An inflatable product is provided, comprising: an inflatable chamber defined by a chamber wall; a tensioning member disposed in the inflatable chamber; and a connecting member disposed in the inflatable chamber. The connecting member includes a covering layer and a fiber layer disposed between the chamber wall and the covering layer. The tensioning member is sewn to the connecting member, and the connecting member is connected to the chamber wall.

13 Claims, 57 Drawing Sheets

INFLATABLE PRODUCT

CROSS-REFERENCE TO RELATED APPLICATION

This Application claims priority from Chinese Application CN202210458848.3 filed Apr. 27, 2022, and Chinese Application CN202221006772.2 filed Apr. 27, 2022, in China, the disclosures of which are incorporated herein by reference in their entirety.

BACKGROUND

1. Field

Apparatuses and methods consistent with example embodiments relate to inflatable products, and particularly to an inflatable product with a tensioning member.

2. Description of the Related Art

With the development of materials technologies and increased social demands, people increasingly use various portable equipment in various places, for example, portable equipment designed for indoor use is often moved to the outdoors for use. As a typical example, inflatable products are lightweight, easy to package and store, and are widely used.

A typical inflatable product has a predetermined shape based on the configuration of its internal structure, and after being inflated, the typical product assumes its predetermined final shape under the action of internal air-pressure. For example, tensioning structures may be arranged in an inflatable chamber of an inflatable product, and the tensioning structures may be connected to an inner wall of the inflatable chamber so that the inflatable product assumes a desired shape after being pressurized.

With an increase of the variety of inflatable products, some inflatable products have been developed which need to have high air pressures in their inflatable chambers in order to meet the needs of use. Therefore, the connection between tensioning members and the inner wall of the inflatable chamber should be highly reliable, and the tensioning members themselves should have a high tensile strength.

In the related art, inflatable products are often formed by splicing various sheet materials through high-frequency welding, and accordingly, product surfaces and internal tensioning members are often made of sheeted elastic chemical materials that can be subjected to high-frequency welding. As a widely used chemical material, polyvinyl chloride (PVC) has been used in most inflatable products. However, in the case of a product with a high internal air-pressure, due to the creep behavior of the material when bearing a high tensile force (especially when an ambient temperature is high), internal tensioning members made of sheets of PVC may be deformed, so that the shape of the resultant inflatable product may be deformed, affecting user experience.

In the related art, a material of a laminated structure may be used as an internal tensioning member. For example, a fabric layer may be placed between two layers of PVC films, and a laminated material is achieved through a lamination process. In this way, the creep behavior of the internal tensioning member made of the laminated material is changed, thereby improving a deformation resistance capacity of the final product. However, material processed like this is still subject to deformation to a certain extent, and requires more consumption of PVC, resulting in an increase of material costs. Moreover, after the product is discarded, PVC does not easily degrade, and this has an adverse impact on the natural environment.

It is desirable to manufacture internal tensioning members from materials having excellent tensile properties, such as cotton fabrics, chemical fabrics, or fabrics made of other materials. However, these fabrics cannot be fastened to the previously-described sheet elastic chemical materials that can be subjected to high-frequency welding, and accordingly are not applicable.

Therefore, development of an inflatable product which includes internal tensioning members with improved tensile strength, reduced use of non-degradable materials, protection of the natural environment, and lowered costs is desirable.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable product comprises: an inflatable chamber defined by a chamber wall; a tensioning member disposed in the inflatable chamber; a connecting member comprising a covering layer, and a fiber layer disposed between the chamber wall and the covering layer; wherein the tensioning member sewn to the connecting member; and the connecting member is connected to the chamber wall.

The tensioning member may comprise a woven fabric.

The fiber layer of the connecting member may comprise a plurality of parallel strands.

The connecting member may be welded to the chamber wall.

The connecting member may comprise a first covering layer and a second covering layer, and the fiber layer may be disposed between the first covering layer and the second covering layer.

The connecting member may comprise a first covering layer, a second covering layer, and a third covering layer; the fiber layer may comprise a first fiber layer disposed between the first covering layer and the second covering layer, and a second fiber layer disposed between the second covering layer and the third covering layer.

The connecting member may comprise a first covering layer and a second covering layer; the fiber layer may comprise a first fiber layer disposed between the first covering layer and the second covering layer, and a second fiber layer disposed between the second covering layer and the chamber wall.

The connecting member may comprise a first covering layer, a second covering layer, a third covering layer, and a fourth covering layer; the fiber layer may comprise a first fiber layer disposed between the first covering layer and the second covering layer, and a second fiber layer disposed between the third covering layer and the fourth covering layer.

The inflatable product may be an inflatable pool.

According to an aspect of another example embodiment, an inflatable product comprises: an inflatable chamber defined between a first wall and a second wall; a plurality of tensioning members disposed in the inflatable chamber; and a plurality of pairs of connecting members disposed in the inflatable chamber; wherein each of the plurality of tensioning members comprises a first side sewn to a first connecting member of one of the plurality of pairs of connecting members, and a second side sewn to a second connecting member of the plurality of pairs of connecting members; wherein the first connecting member and the second connecting member, of each of the plurality of pairs of connecting members, are respectively connected to the first wall and the second wall.

According to an aspect of another example embodiment, a method of assembling an inflatable product comprising an inflatable chamber is provided, the method comprising: sewing a first side of each of a plurality of tensioning members to a first connecting member of a respective one of a plurality of pairs of connecting members; sewing a second side of each of the plurality of tensioning members to a second connecting member of a respective one of the plurality of pairs of connecting members; disposing the plurality of tensioning members and the plurality of pairs of connecting members in the inflatable chamber; welding the first connecting member and the second connecting member of each of the plurality of pairs of connecting members to a wall of the inflatable chamber.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
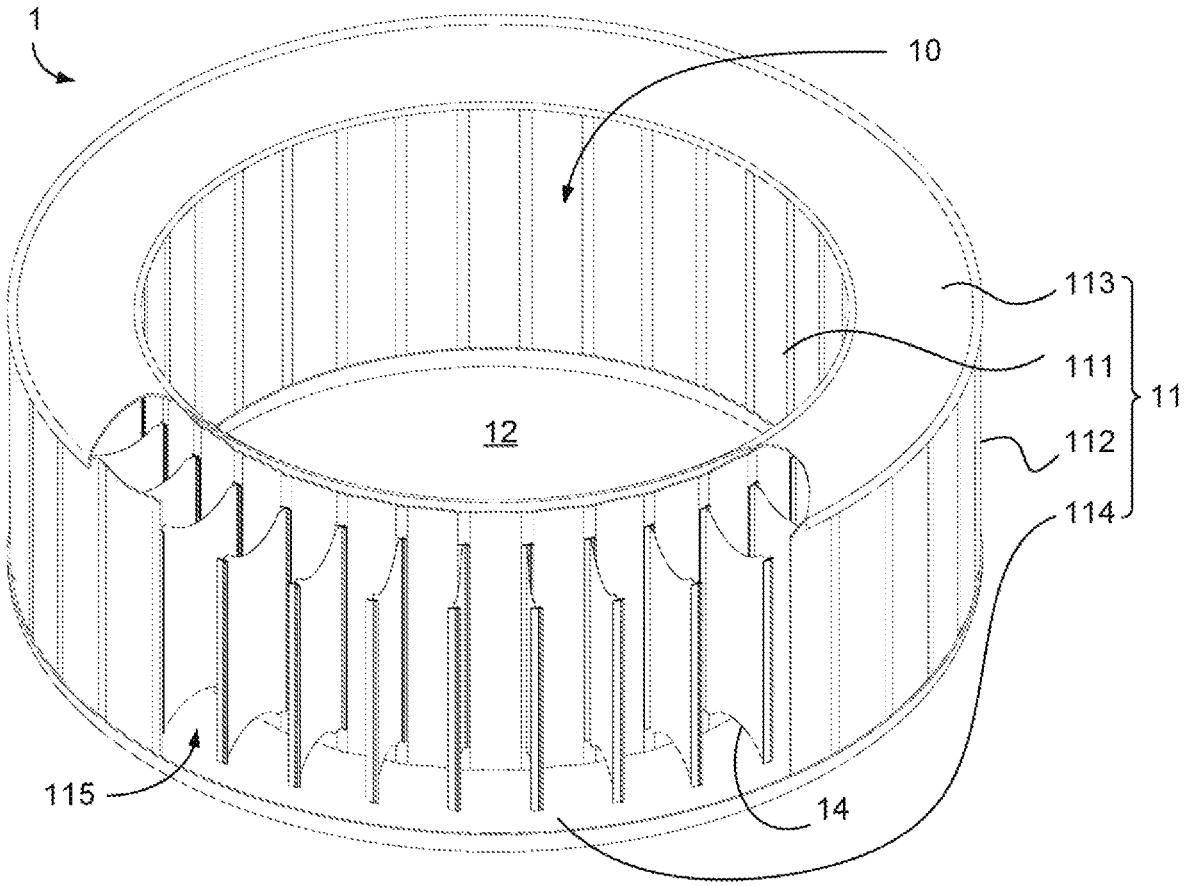
FIG. 1 illustrates an inflatable pool in which tensioning members are arranged in an inflatable chamber of the inflatable pool, according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including," "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

The present application will be described in further detail below with reference to the drawings.

As used herein, orientation or position relationships indicated by terms such as "center," "longitudinal," "transverse," "length," "width," "thickness," "up," "down," "front," "rear," "left," "right," "vertical," "horizontal," "top," "bottom," "inside," "outside," "clockwise," and "anti-clockwise" are based on orientation or position relationships shown in the accompanying drawings and are merely for ease of description, rather than indicating or implying that the apparatuses or elements referred to must have a specific orientation or be constructed and operated in a specific orientation, and therefore cannot be construed as limiting.

As used herein, unless otherwise explicitly specified and defined, terms "mounting," "connecting," "connection," and "fixing" should be understood in a broad sense, for example, they can be a fixed connection, a detachable connection, or an integrated connection, and can be a direct connection and can also be an indirect connection through an intermediate. For those of ordinary skill in the art, the specific meaning of the terms mentioned above should be construed according to specific circumstances.

As used herein, unless otherwise explicitly specified and defined, the first feature being "above" or "below" the second feature may include the first and second features being in direct contact, or may include the first and second features being not in direct contact but coming into contact through another feature between them. In addition, the first feature being "above", "over", and "on upside of" the second feature includes the first feature being directly above and obliquely above the second feature, or simply means that the level of the first feature is higher than that of the second feature. In addition, the first feature being "below", "beneath", and "on underside of" the second feature includes the first feature being directly below and obliquely below the second feature, or simply means that the level of the first feature is less than that of the second feature.

As used herein, the meaning of "a plurality of" is two or more, unless specifically defined otherwise.

As used herein, an "inflatable product" comprises at least one inflatable chamber for being inflated, and after a pressure of gas (e.g., air) in the inflatable chamber reaches a desired value, the inflatable product is in an inflated state and maintains a certain shape. After the gas in the inflatable chamber of the inflatable product is discharged, the inflatable product is in a deflated state, and a volume of the inflatable product is greatly reduced relative to that of the inflatable product in the inflated state, thereby facilitating storage of the inflatable product.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

One or more tensioning members are arranged in the inflatable chamber of the inflatable product, and at least two ends of each tensioning member are connected to walls of the inflatable chamber. When tensioned, the tensioning member provides a tensile force to limit deformation of the walls of the inflatable chamber, allowing the inflatable product to maintain a certain shape after being inflated.

Referring to FIG. 1, in an example embodiment, the inflatable product is an inflatable pool 1. The inflatable pool 1 comprises a pool wall 11 and a pool bottom 12. The pool wall 11 is connected to the pool bottom 12 and defines a water container 10. The pool wall 11 comprises an inner wall 111, an outer wall 112, and an inflatable chamber 115 defined between the inner wall 111 and the outer wall 112. For example, the pool wall 11 may further include a top wall 113 and a bottom wall 114. The top wall 113 is connected to an upper end of the inner wall 111 and an upper end of the outer wall 112, and the bottom wall 114 is respectively connected to a lower end of the inner wall 111 and a lower end of the outer wall 112. Thus, the inner wall 111, the outer wall 112, the top wall 113, and the bottom wall 114 define the inflatable chamber 115. External air enters the inflatable chamber 115 through an air inlet (not shown), provided on the pool wall 11, to inflate the inflatable chamber 115. A plurality of tensioning members 14 are arranged in the inflatable chamber 115. One side of each tensioning member 14 is connected to the inner wall 111, and an opposite side of the tensioning member 14 is connected to the outer wall 112. The inner wall 111 and the outer wall 112 are each pulled inward by the tensioning member 14, toward the inflatable chamber 115, so that the pool wall 11 and the inflatable chamber 115 maintain a desired shape.

Each tensioning member 14 of the inflatable pool 1 in FIG. 1 is vertically or substantially vertically disposed within in the inflatable chamber 115. These tensioning members 14 are arranged in an array in the inflatable chamber 115. It can be understood that the vertical or substantially vertical arrangement of the tensioning members 14 is only used to illustrate specific example embodiments. Alternately, each tensioning member 14 in another example embodiment is at an acute angle (e.g., but not limited to, approximately 5 degrees, approximately 10 degrees, approximately 15 degrees, approximately 20 degrees, approximately 25 degrees, approximately 30 degrees, approximately 35 degrees, approximately 40 degrees, approximately 45 degrees, approximately 50 degrees, approximately 55 degrees, approximately 60 degrees, approximately 65 degrees, approximately 70 degrees, approximately 75 degrees, approximately 80 degrees, or approximately 85 degrees) with respect to a horizontal plane. In another example embodiment, the tensioning members 14 may be arranged in a horizontal direction or disposed substantially in a horizontal direction. Except for a difference in the angle between the tensioning members 14 and the horizontal plane, these example embodiments may be analogous to those in which the tensioning members 14 are vertically or substantially vertically arranged.

Figure 2A:
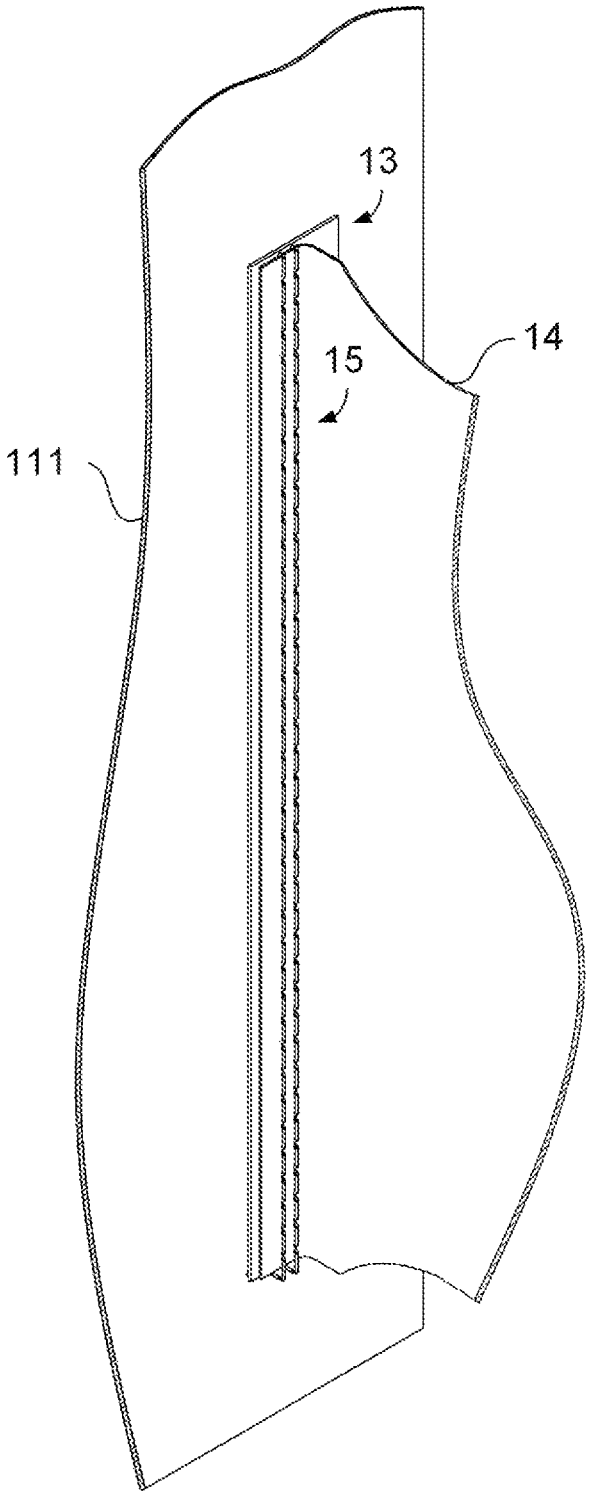
FIG. 2*a* illustrates a structure in which a tensioning member and a connecting member are connected to a pool wall of the inflatable pool of FIG. 1.

FIG. 2*a* illustrates a schematic structure of a tensioning member 14 connected to an inner wall 111 by a connecting member 13, according to an example embodiment. Here, the tensioning member 14 is connected to the inner wall 111 through the connecting member 13. For example, the tensioning member 14 is connected to the connecting member 13, and the connecting member 13 is connected to the inner wall 111, so that the tensioning member 14 is indirectly connected to the inner wall 111 through the connecting member 13. It can be understood that the connection manner between the tensioning member 14 and the outer wall 112 may be the same as the connection manner between the tensioning member 14 and the inner wall 111.

As shown in FIG. 2*a*, the connecting member 13 may be elongated and extend substantially straight along its longitudinal direction. In some other example embodiments, the connecting member 13 may have other shapes. For example, referring to FIG. 2*b*, the connecting member 13 may be elongated and extend in a curved manner along its length. In some other example embodiments, the connecting member 13 may have other shapes. For example, the connecting member 13 may have the shape of a zig-zagged line, a circular ring, an elliptical ring, a "C" shape or another shape as would be understood by those of skill in the art. Correspondingly, the cross section of the tensioning member 14 connected to the connecting member 13 may also have the shape of a zig-zagged line, a circular ring, an elliptical ring, or a "C" shape, etc. These example shapes of the connecting member 13 are not exhaustive examples, and the shape of the connecting member 13 may be selected according to actual needs.

Figure 2B:
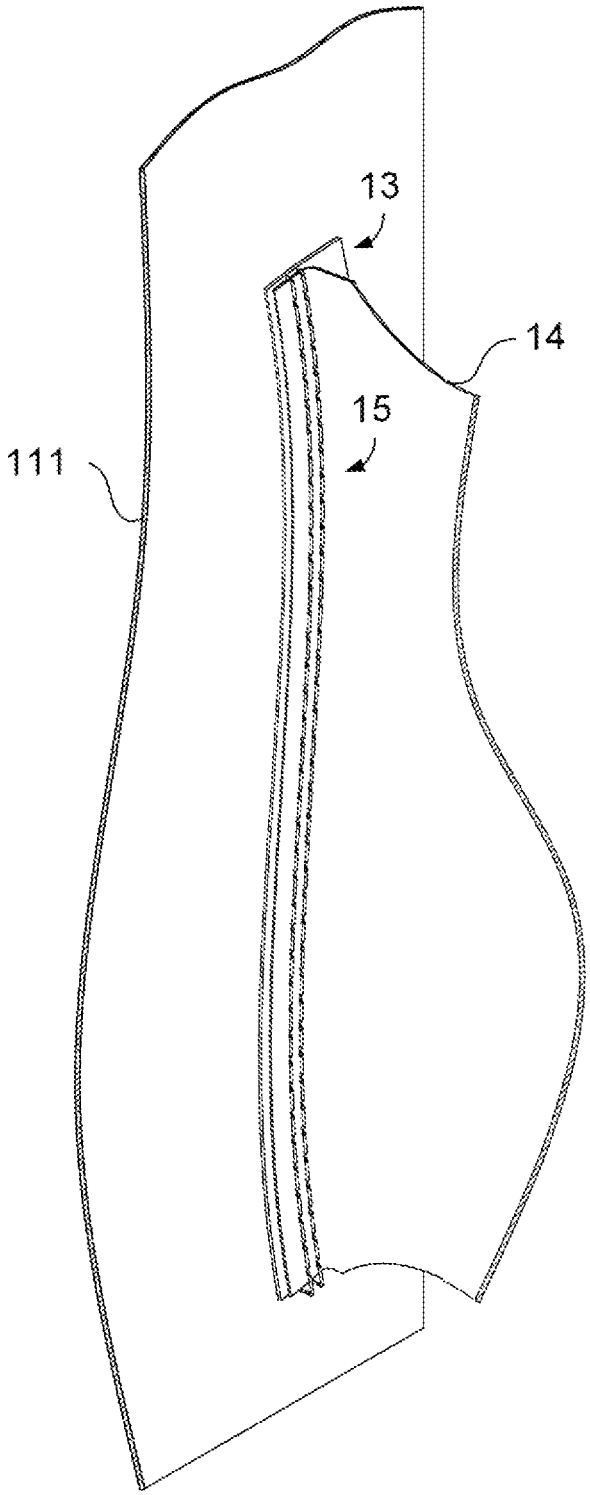
FIG. 2*b* illustrates another connection structure in which a tensioning member and a corresponding connecting member are connected to a pool wall.
Figure 2C:
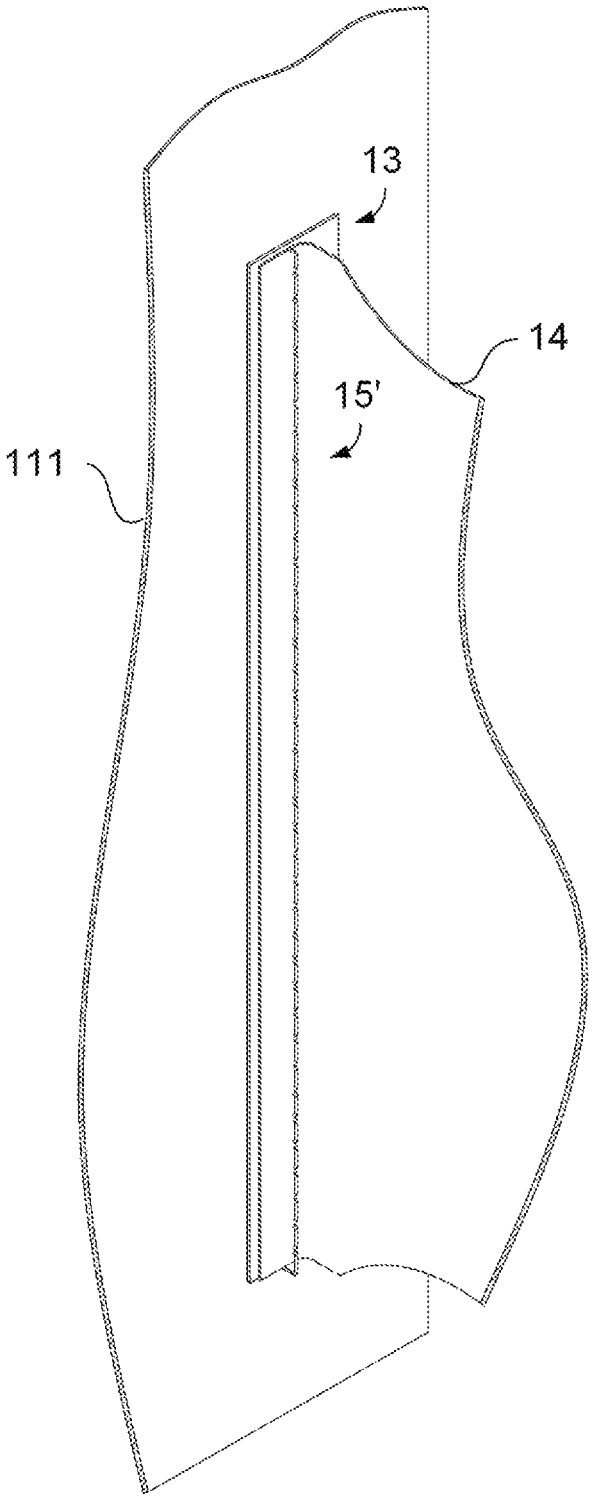
FIG. 2*c* illustrates a connection manner of a connecting member and a tensioning member, according to another example embodiment.

Referring to FIG. 2*a* and FIG. 2*b*, the tensioning member 14 and the connecting member 13 may be connected by sewing. The tensioning member 14 and the connecting member 13 may be connected to each other by one or more sewing threads. In this example embodiment, the sewing threads may form two rows of stitches 15 on a surface of the tensioning member 14. It can be understood that the row number of stitches 15 formed by the sewing threads on the surface of the tensioning member 14 is not limited to two, and may be more or fewer. For example, referring to FIG. 2*c*, a sewing thread may form a single a row of stitches 15' on a surface of the tensioning member 14.

For ease of description, the connecting member 13 and the tensioning member 14 are described below in detail based on the connecting member 13 shown in FIG. 2*a*, and a side of the tensioning member 14, close to the inner wall 111, is taken as an example to describe a connection manner between the connecting member 13 and the inner wall 111, as well as the connecting member 13 and the outer wall 112 in detail.

Connecting Member

Figure 3A:
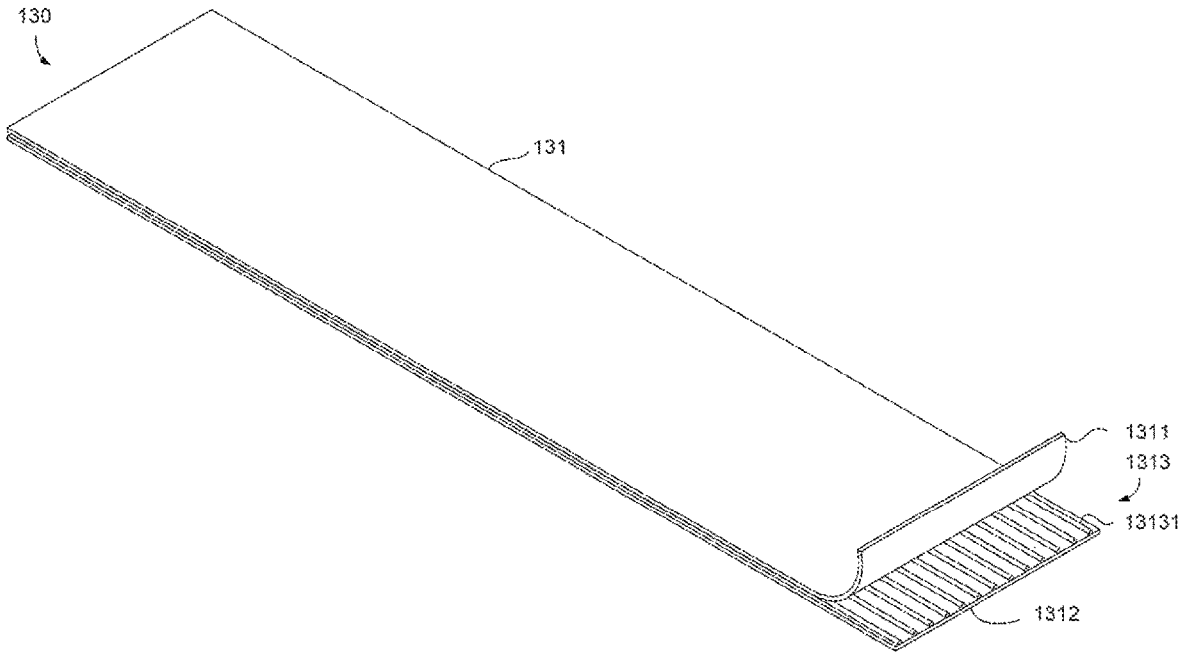
FIG. 3*a* to FIG. 3*g* each illustrate a structure of a material for constructing the connecting member of FIG. 2, according to example embodiments.

For ease of description, FIG. 3*a* is taken as an example for description at present. The connecting member comprises at least one strip-shaped structure unit 130. The structure unit 130 of the connecting member is composed of at least two materials, so that the connecting member 13 and the tensioning member 14 are joined firmly. Specifically, the structure unit 130 comprises a connecting strip 131 composed of at least one fiber layer and at least one covering layer.

A covering layer 1311 and a covering layer 1312, of FIG. 3*a*, are made of PVC material, though they may also be made of any one or more of TPU, PET, EVA, polyurethane (PU) and nylon material. These materials can be fixedly connected to the inner wall 111 by high-frequency welding, hot melting, high-strength gluing, or other high-strength connection manners.

The fiber layer 1313 comprises a plurality of fibers or strands, a flat woven fabric, or a three-dimensional woven fabric. These materials are made of one or more types of high-tensile-strength fibers such as natural fibers or chemical fibers. For example, the one or more types of fibers may be selected from, but not limited to, the following materials: cotton fibers, linen fibers, silk fibers, nylon fibers, polyacrylonitrile fibers (PAN fibers), and Ultra High Molecular Weight Polyethylene Fiber (UHMWPEF).

It can be understood that there are many kinds of natural fibers and chemical fibers, and for the sake of brevity, they are not listed here, but only some common examples are provided. These examples do not constitute a limitation on specific implementations. Specific implementations based on these fibers may be used in conjunction with one or more example embodiments.

The examples of the above-mentioned materials can be applied to any of the structure units 130 of any of the example embodiments described herein.

In some other example embodiments, the connecting strips 130 may be made of a single same material (e.g., PVC, or the TPU, PET, and Nylon material) integrally.

FIG. 3*a* illustrates a structure unit 130 for forming the connecting member 13 in FIG. 2 according to an example embodiment. In this example embodiment, the structure unit 130 of the connecting member 13 comprises a connecting strip 131 made of composite layers. The connecting strip 131 is manufactured by laminating three material layers. Specifically, the connecting strip 131 comprises a first covering layer 1311, a second covering layer 1312, and a fiber layer 1313. The first covering layer 1311 and the second covering layer 1312 are made of PVC.

The fiber layer 1313 is sandwiched between the first covering layer 1311 and the second covering layer 1312, and the first covering layer 1311 and the second covering layer 1312 are glued, or joined by welding (e.g., thermal welding or high-frequency welding), through gaps between adjacent strands 13131 of the fiber layer 1313. The fiber layer 1313 has a higher tensile strength than the first covering layer 1311 and the second covering layer 1312, so that deformation of the connecting strip 131, due to application of a tensile force, may be prevented, so as to maintain reliability of the inflatable product.

The fiber layer 1313 comprises a plurality of strands 13131. The strands 13131 each comprise one or more strands of fibers, extending along or substantially along a direction parallel to a length of the connecting strip 131, and the plurality of strands 13131 are parallel or substantially parallel to one another.

Alternatively, the strands 13131 are arranged obliquely between the first covering layer 1311 and the second covering layer 1312, that is, the strands 13131 are not arranged strictly along the length direction of the connecting strip 131, but form an angle with the length direction of the connecting strip 131.

Figure 3B:
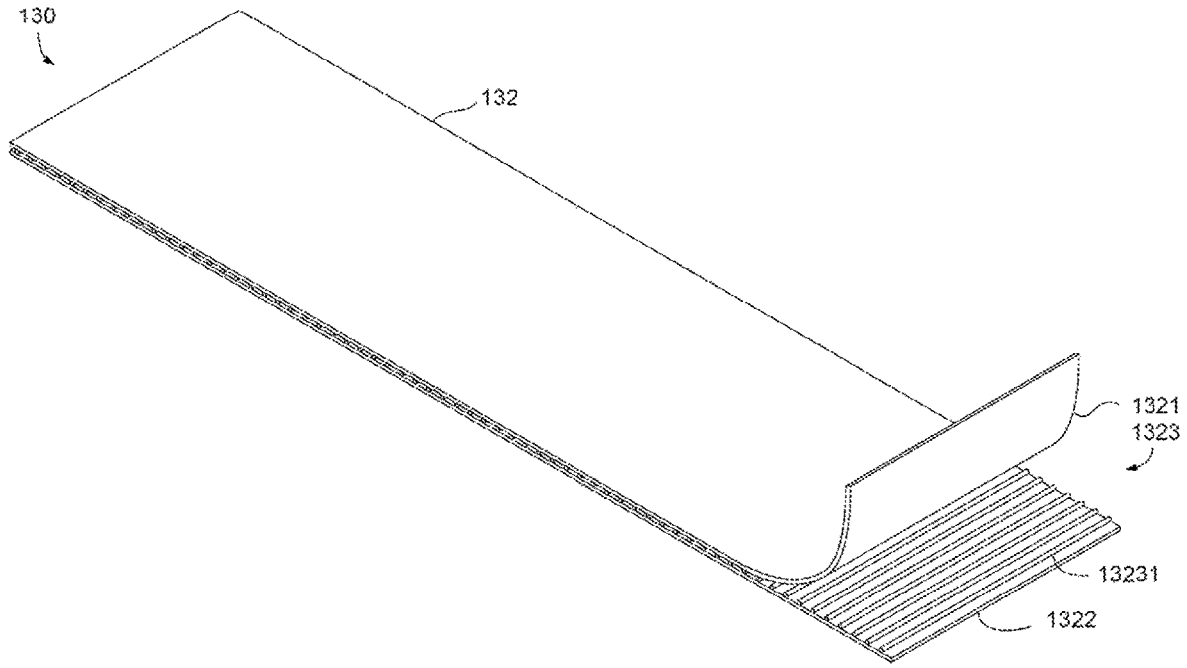

FIG. 3*b* illustrates a structure unit 130 for forming the connecting member 13 of FIG. 2 according to an example embodiment. In this example embodiment, the structure unit 130 of the connecting member 13 comprises a connecting strip 132 made of composite layers. In this example embodiment, the connecting strip 132 may be manufactured by laminating three material layers. Specifically, the connecting strip 132 comprises a first covering layer 1321, a second covering layer 1322, and a fiber layer 1323. The fiber layer comprises a plurality of strands 13231. The strands 13231 each comprise one or more strands. A difference from the structure in FIG. 3*a* lies in that, the plurality of strands 13231 of the example embodiment of FIG. 3*b* extend along or substantially along a direction parallel to a width of the connecting strip 132, and the plurality of strands 13231 are parallel or substantially parallel to one another.

Figure 3C:
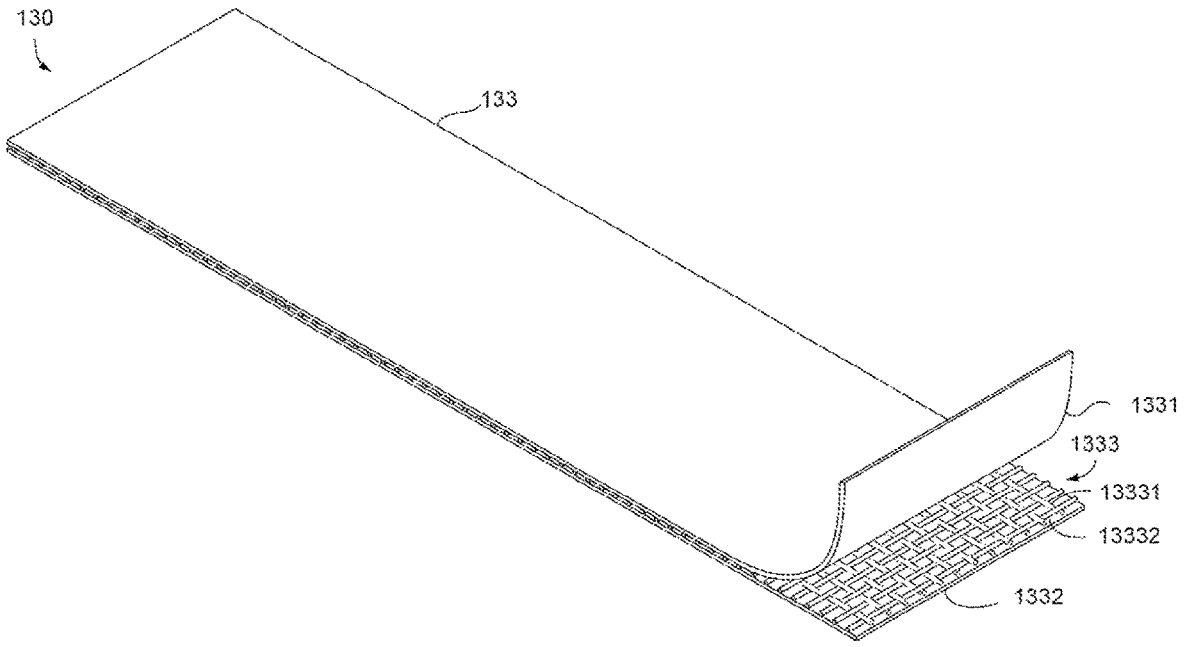

FIG. 3*c* illustrates a structure unit 130 for forming the connecting member 13 in FIG. 2 according to an example embodiment. The structure unit 130 of the connecting member 13 comprises a connecting strip 133 made of composite layers. The connecting strip 133 may be manufactured by laminating three material layers. Specifically, the connecting strip 133 comprises a first covering layer 1331, a second covering layer 1332, and a fiber layer 1333. A difference from the structure in FIG. 3*a* lies in that the fiber layer 1333 of the example embodiment of FIG. 3*c* is a woven fabric mesh structure, and the mesh structure includes a plurality of first strands 13331 and a plurality of second strands 13332. The first strands 13331 each comprise one or more strands, extending along or substantially along a direction parallel to the length of the connecting strip 133, and the plurality of first strands 13331 are parallel or substantially parallel to one another. The second strands 13332 each comprise one or more strands, extending along or substantially along a direction perpendicular to a length of the connecting strip 133, and the plurality of second strands 13332 are parallel or substantially parallel to one another. The first strands 13331 and the second strands 13332 are interwoven to constitute the foregoing mesh structure.

The fiber layer 1333 is sandwiched between the first covering layer 1331 and the second covering layer 1332. The first covering layer 1331 and the second covering layer 1332 are glued through the fiber layer 1333 and a plurality of through holes of the mesh structure of the fiber layer 1333, or connected through the plurality of through holes of the mesh structure of the fiber layer 1333 by welding (e.g., thermal welding or high-frequency welding). Thus, the fiber layer 1333 is firmly fixed between the covering layer 1331 and the second covering layer 1332.

Alternatively, the first strands 13331 and the second strands 13332 are obliquely arranged between the first covering layer 1331 and the second covering layer 1332, so that the foregoing mesh structure is obliquely arranged between the first covering layer 1331 and the second covering layer 1332. That is, there is an angle formed between the first strands 13331 and the second strands 13332 and the length direction of the connecting strip 133. This technical feature may be applied to any of the example embodiments described herein.

In another example embodiment, the first covering layer 1331 is omitted. That is, the fiber layer 1333 is only glued and/or laminated with the second covering layer 1332 (not shown). Except this, the structure of the connecting strip may be the same as that described above. This technical feature may be applied to any of the example embodiments described herein.

According to one or more example embodiments, the covering layer(s) and the fiber layer may be glued and/or laminated by rollers.

Figure 3D:
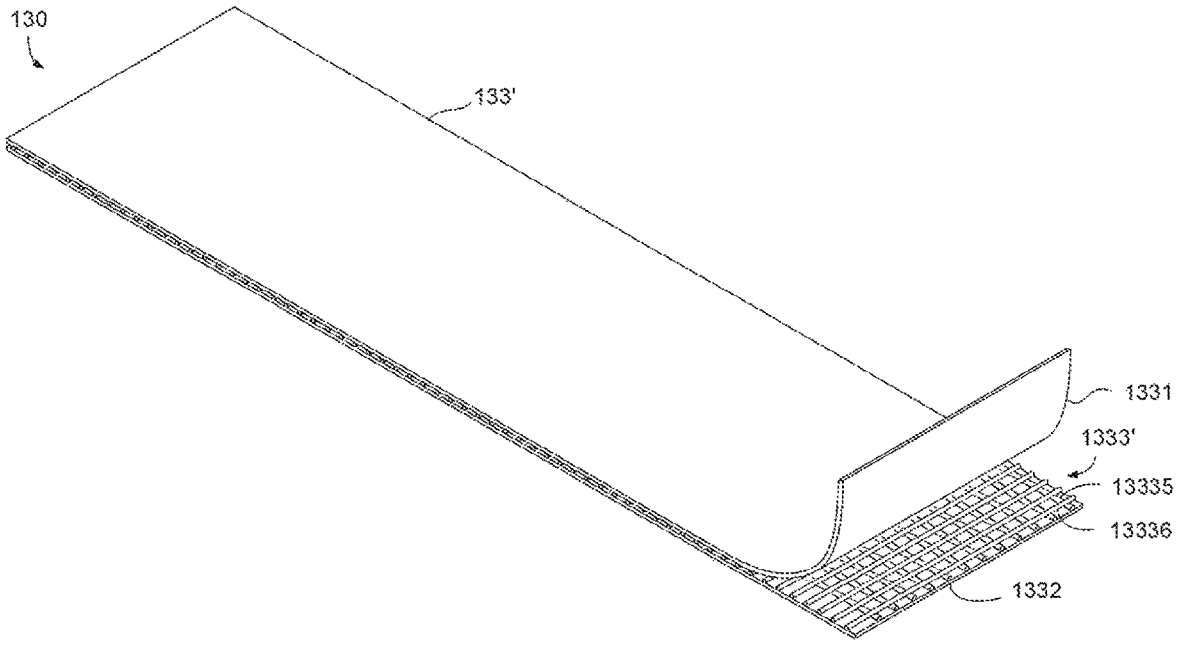

In another example embodiment, the fiber layer may be combined with the covering layer(s) by extrusion coating. That is, the fiber layer is immersed in, for example, a PVC gelatinous liquid and then taken out, an irregular gelatinous liquid on a surface of the fiber layer is removed, and a composite material required for forming the strip-shaped structure unit 130 is obtained after drying is performed. This technical feature may be applied to any of the example embodiments described herein FIG. 3*d* illustrates a structure unit 130 for forming the connecting member 13 in FIG. 2 according to an example embodiment. The connecting strip 133' is manufactured by laminating three material layers. Specifically, the connecting strip 133' comprises a first covering layer 1331, a second covering layer 1332, and a fiber layer 1333'. The fiber layer 1333' comprises a mesh structure, and the mesh structure includes a plurality of first strands 13335 and a plurality of second strands 13336.

The difference from the example embodiment shown in FIG. 3*c* lies in that, in this example embodiment, the plurality of first strands 13335 form a first parallel strand layer, and the plurality of second strands 13336 form a second parallel strand layer. The two strand layers are stacked on each other without a weaving process, and are arranged between the first covering layer 1331 and the second covering layer 1332. The plurality of first strands 13335 are arranged along a length direction of the connecting strip 133', and the plurality of second strands 13336 are arranged along a width direction of the connecting strip 133'. In this way, a production process may be greatly simplified, and production personnel may directly use a strand material for manufacturing, and a process of weaving the strand material into a mesh structure may be omitted.

In another example embodiment, the first covering layer 1331 may be omitted. That is, the fiber layer 1333' is only glued and/or laminated with the second covering layer 1332 (not shown). Except this, the structure of the connecting strip is analogous to that described above.

Figure 3E:
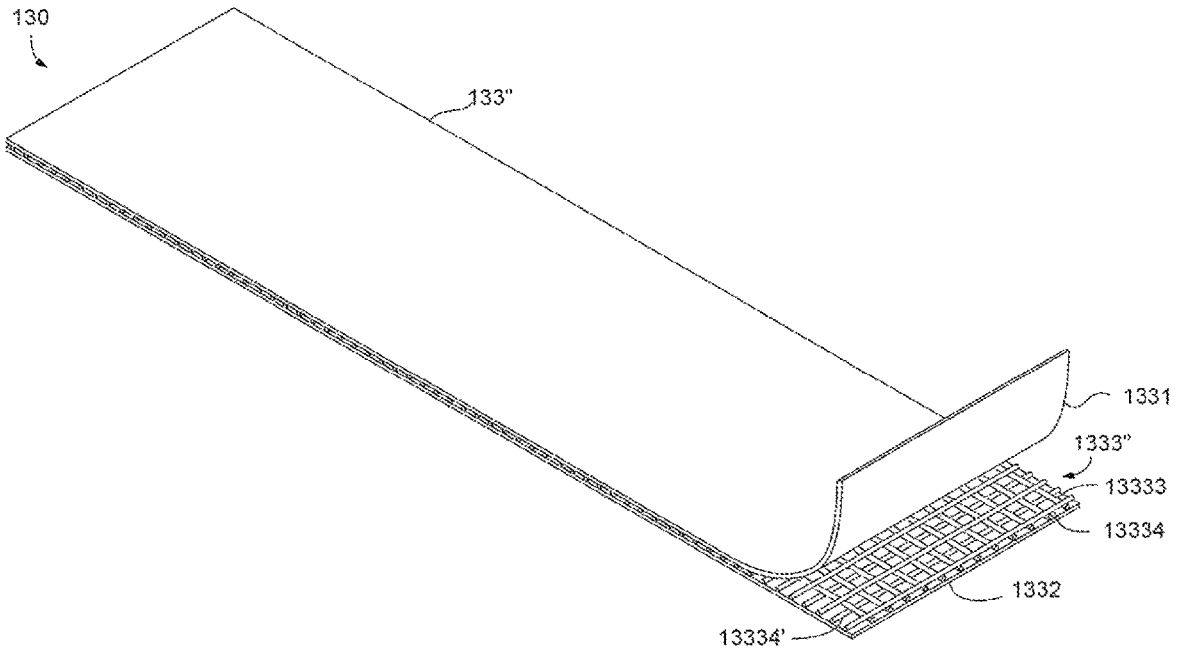

FIG. 3*e* illustrates a structure unit 130 for forming the connecting member 13 in FIG. 2 according to an example embodiment. The structure unit 130 of the connecting member 13 comprises a connecting strip 133" made of composite layers. In this example embodiment, the connecting strip 133" is manufactured by laminating three material layers. Specifically, the connecting strip 133" comprises a first covering layer 1331, a second covering layer 1332, and a fiber layer 1333". The fiber layer 1333" comprises a mesh structure, and the mesh structure includes a plurality of parallel first strands 13333, a plurality of parallel second strands 13334, and a plurality of parallel third strands 13334'.

The difference from the example embodiment shown in FIG. 3*d* lies in that, in this example embodiment, the plurality of parallel first strands 13333 form a first parallel strand layer, the plurality of parallel second strands 13334 form a second parallel strand layer, and the plurality of parallel third strands 13334' form a third parallel strand layer. The three strand layers are stacked on one another, and are arranged between the first covering layer 1331 and the second covering layer 1332. The plurality of parallel first strands 13333 are arranged along a length direction of the connecting strip 133", and the plurality of parallel second strands 13334 and the plurality of parallel third strands 13334' are arranged along a width direction of the connecting strip 133". In this way, the strength of the fiber layer is increased by using more parallel strands.

In another example embodiment, the first covering layer 1331 is omitted. That is, the fiber layer 1333" is only glued and/or laminated to the second covering layer 1332 (not shown in the figure). Except for this, the structure of the connecting strip is analogous to that described above.

Figure 3F:
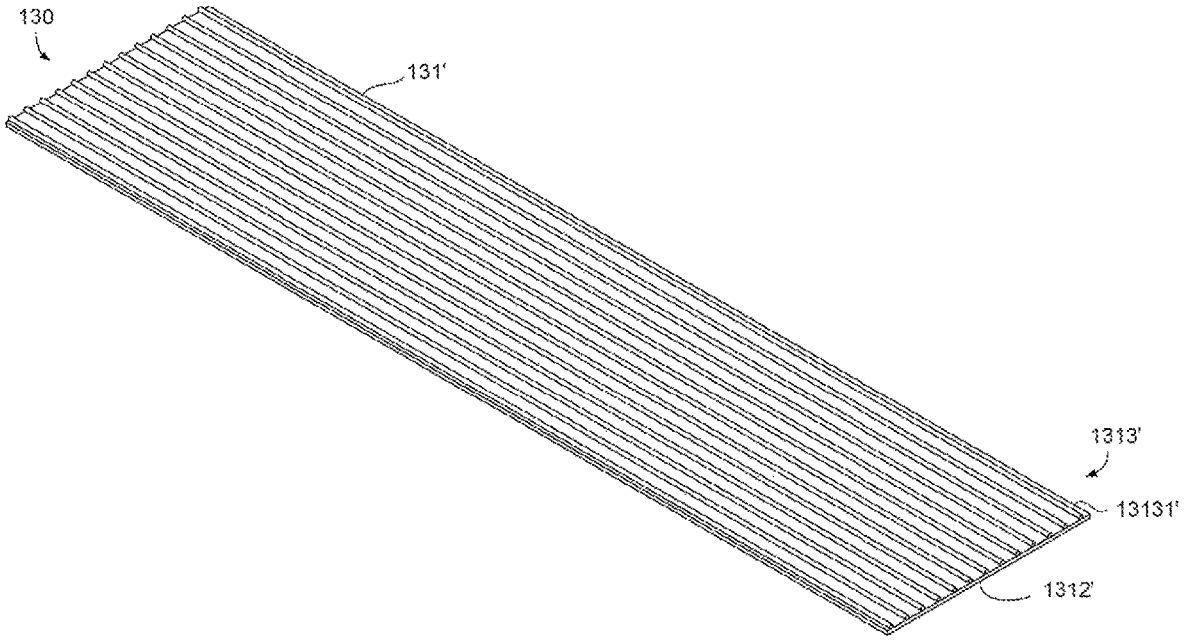

FIG. 3*f* illustrates a structure unit 130 for forming the connecting member 13 in FIG. 2 according to an example embodiment. The structure unit 130 of the connecting member 13 comprises a connecting strip 131' made of composite layers. The connecting strip 131' comprises two layers of materials. Specifically, the connecting strip 131' comprises a second covering layer 1312' and a fiber layer 1313'. The fiber layer 1313' includes a plurality of strands 13131'. The strands 13131' each comprise one or more strands, extending along or substantially along a direction parallel to a length of the connecting strip 131', and the plurality of strands 13131' are parallel or substantially parallel to one another.

The strands 13131' are fixed to the covering layer 1312' by gluing, heat melting or other manners.

Alternatively, the strands 13131' may be arranged obliquely on a surface of the second covering layer 1312'. That is, there is an angle formed between the strands 13131' and the longitudinal direction of the connecting strip 131'.

Figure 3G:
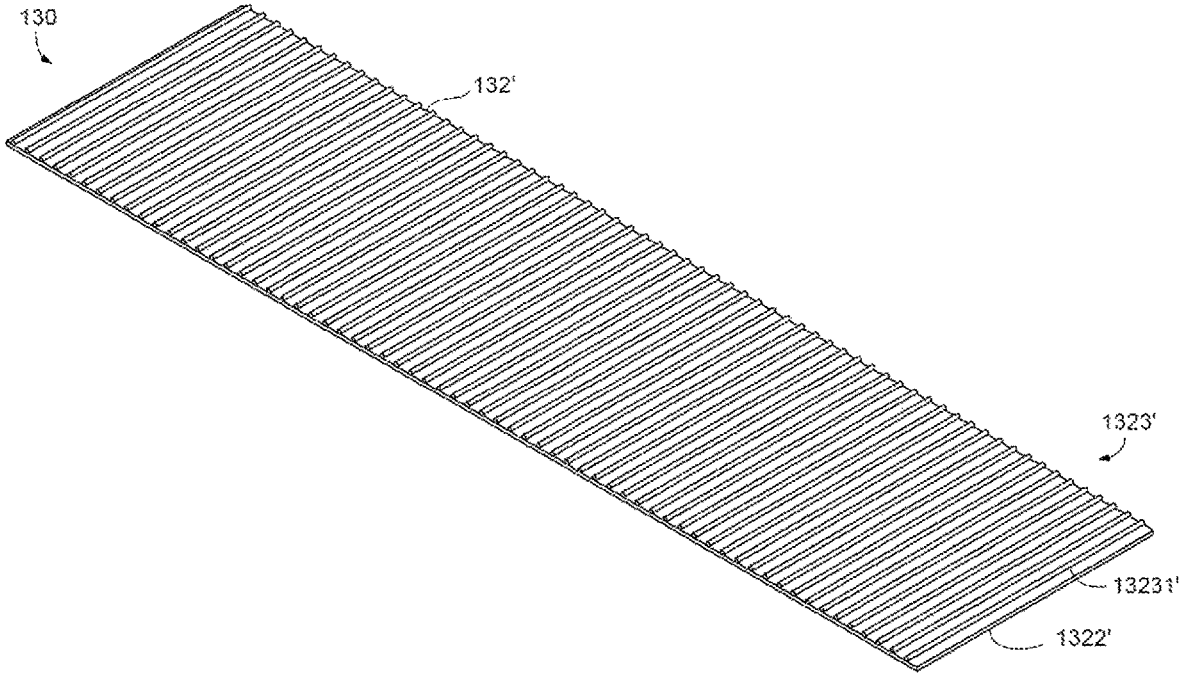

FIG. 3*g* illustrates a structure unit 130 for forming the connecting member 13 in FIG. 2 according to an example embodiment. The structure unit 130 of the connecting member 13 comprises a connecting strip 132' made of composite layers. The connecting strip 132' comprises two layers of materials. Specifically, the connecting strip 132' comprises a second covering layer 1322' and a fiber layer 1323'. The fiber layer 1323' includes a plurality of strands 13231'. The difference from the structure in FIG. 3*f* lies in that, the strands 13231' extend along or substantially along a direction parallel to a width of the connecting strip 131', and the plurality of strands 13131' are parallel or substantially parallel to one another.

Figure 4A:
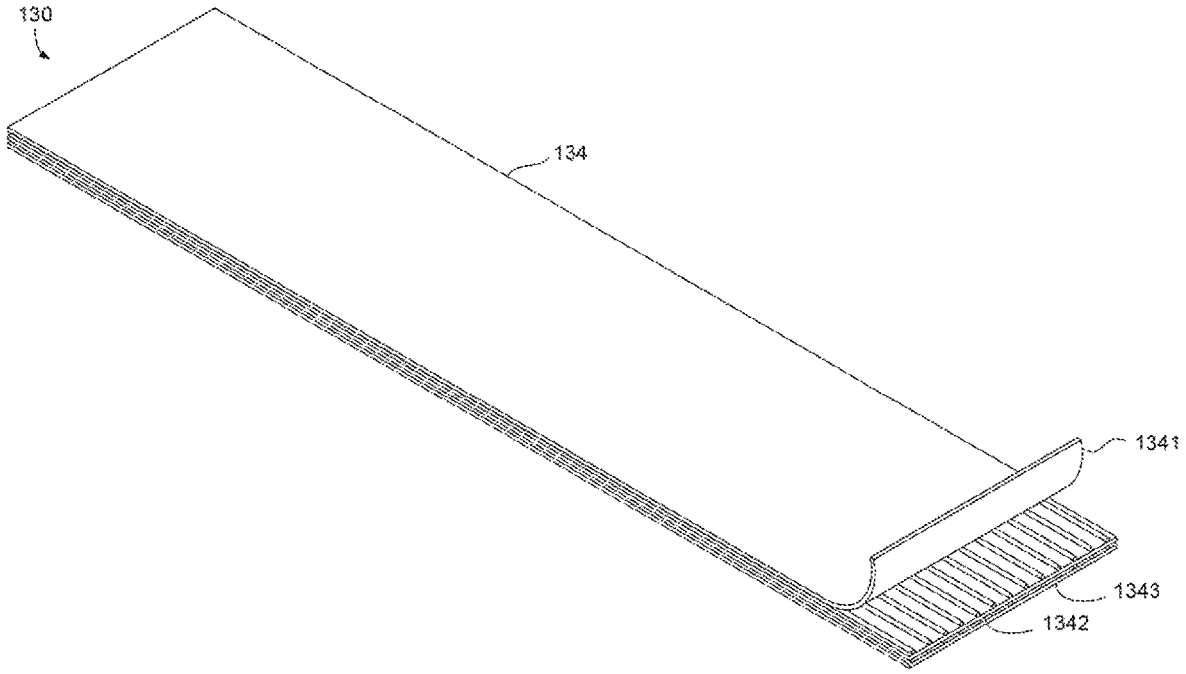
FIG. 4*a* and FIG. 4*b* each illustrate the composition of a material for constructing the connecting member in FIG. 2, according to an example embodiment.
Figure 4B:
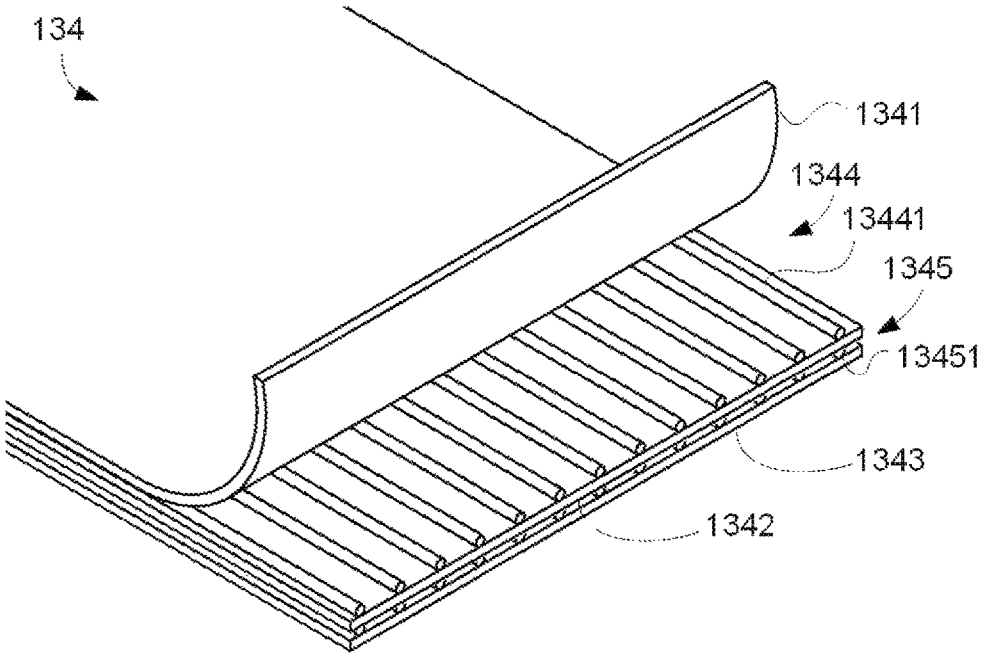

FIG. 4*a* and FIG. 4*b* illustrate a structure unit 130 for forming the connecting member 13 in FIG. 2 according to an example embodiment. In the example embodiment, the structure unit 130 comprises a connecting strip 134 manufactured by lamination of five material layers. Specifically, the connecting strip 134 comprises a first covering layer 1341, an interlayer 1342, and a second covering layer 1343. A first fiber layer 1344 is arranged between the first covering layer 1341 and the interlayer 1342, and a second fiber layer 1345 is arranged between the second covering layer 1343 and the interlayer 1342.

The first fiber layer 1344 includes a plurality of first strands 13441. The first strands 13441 each comprise one or more strands, extending along or substantially along a direction parallel to a length of the connecting strip 134, and the plurality of first strands 13441 are parallel or substantially parallel to one another. The second fiber layer 1345 includes a plurality of second strands 13451. The second strands 13451 each comprise one or more strands, extending along or substantially along a direction parallel to a length of the connecting strip 134, and the plurality of second strands 13451 are parallel or substantially parallel to one another. In one example embodiment, the first covering layer 1341, the interlayer 1342 and the second covering layer 1343 may each be made of PVC, and the first strands 13441 and the second strands 13451 may be made of one or more types of fibers (such as natural fibers or chemical fibers).

Alternatively, at least one of the first strands 13441 and the second strands 13451 may be arranged obliquely between the first covering layer 1341 and the second covering layer 1342. That is, there may be an angle formed between the first strands 13441 and/or the second strands 13451 and the longitudinal direction of the connection strip 134.

The first covering layer 1341, the first fiber layer 1344, the interlayer 1342, the second fiber layer 1345, and the second covering layer 1343 may be manufactured by gluing and/or roller pressing.

Alternatively, one of the first covering layer 1341 and the second covering layer 1343 may be omitted in some example embodiments. Except this, the structure of the connecting strip may be analogous to that described above.

Figure 4C:
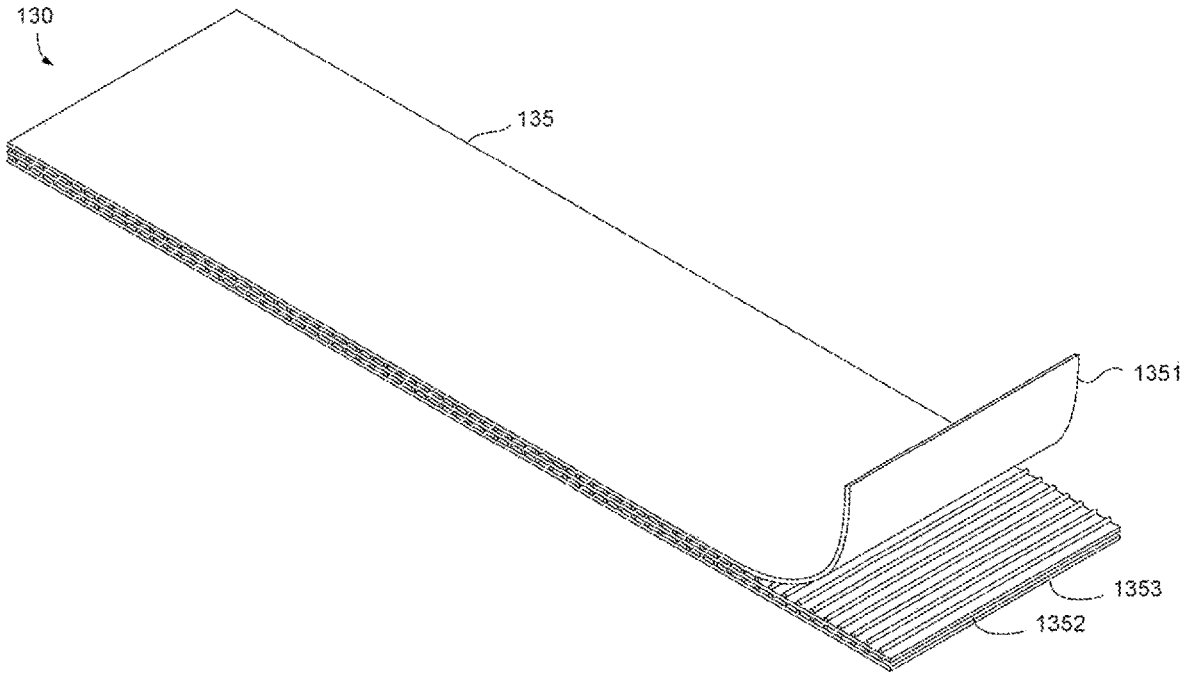
FIG. 4*c* and FIG. 4*d* each illustrate the composition of a material for constructing the connecting member in FIG. 2, according to another example embodiment.
Figure 4D:
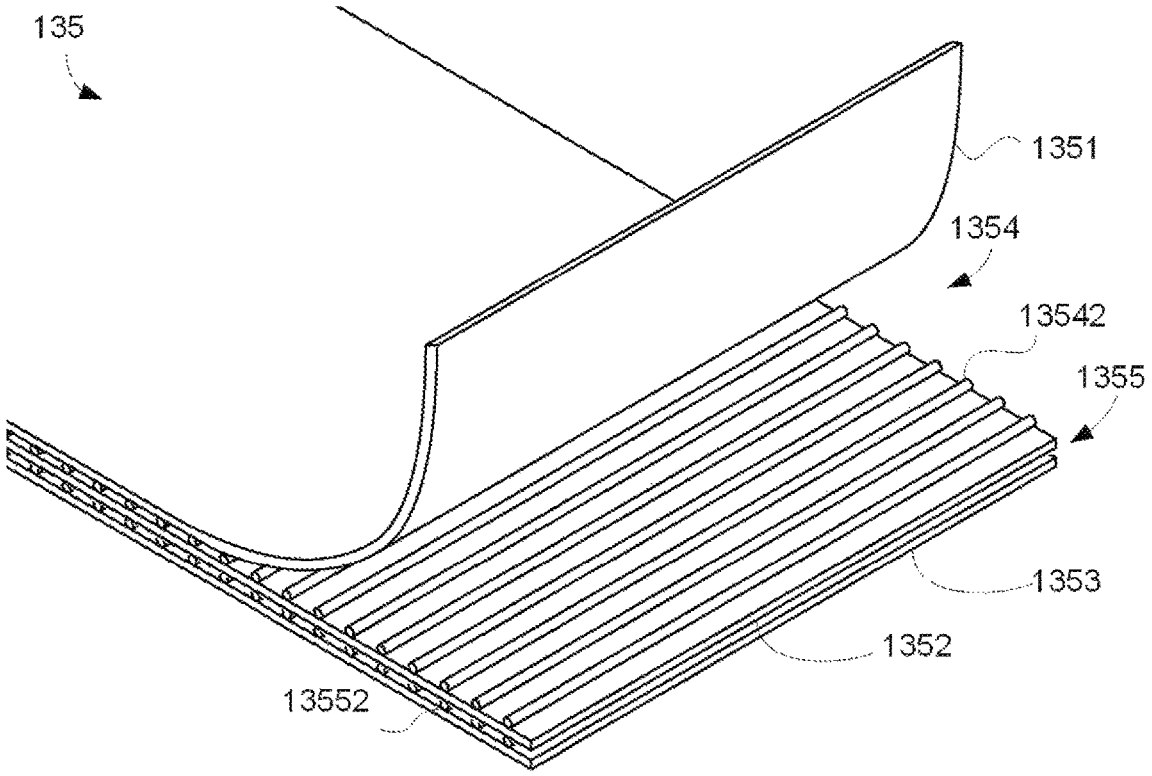

FIG. 4*c* and FIG. 4*d* illustrate a structure unit 130 for forming the connecting member 13 in FIG. 2 according to an example embodiment. In the example embodiment, the structure unit 130 comprises a connecting strip 135 manufactured by lamination of five material layers. Specifically, the connecting strip 135 comprises a first covering layer 1351, an interlayer 1352, and a second covering layer 1353. A first fiber layer 1354 is arranged between the first covering layer 1351 and the interlayer 1352, and a second fiber layer 1355 is arranged between the second covering layer 1353 and the interlayer 1352.

The difference from the example embodiment shown in FIG. 4*a* and FIG. 4*b* lies in that the first fiber layer 1354 includes a plurality of first strands 13542; the second fiber layer 1355 includes a plurality of second strands 13552; and the plurality of first strands 13542 and the plurality of second strands 13552 extend along or substantially along a direction parallel to a width of the connecting strip 135, and the plurality of first strands 13552 and the plurality of second strands 13542 are parallel or substantially parallel to one another.

One of the first covering layer 1351 and the second covering layer 1353 may be omitted in some example embodiments. Except for this, the structure of the connecting strip may be analogous to that described above.

Figure 4E:
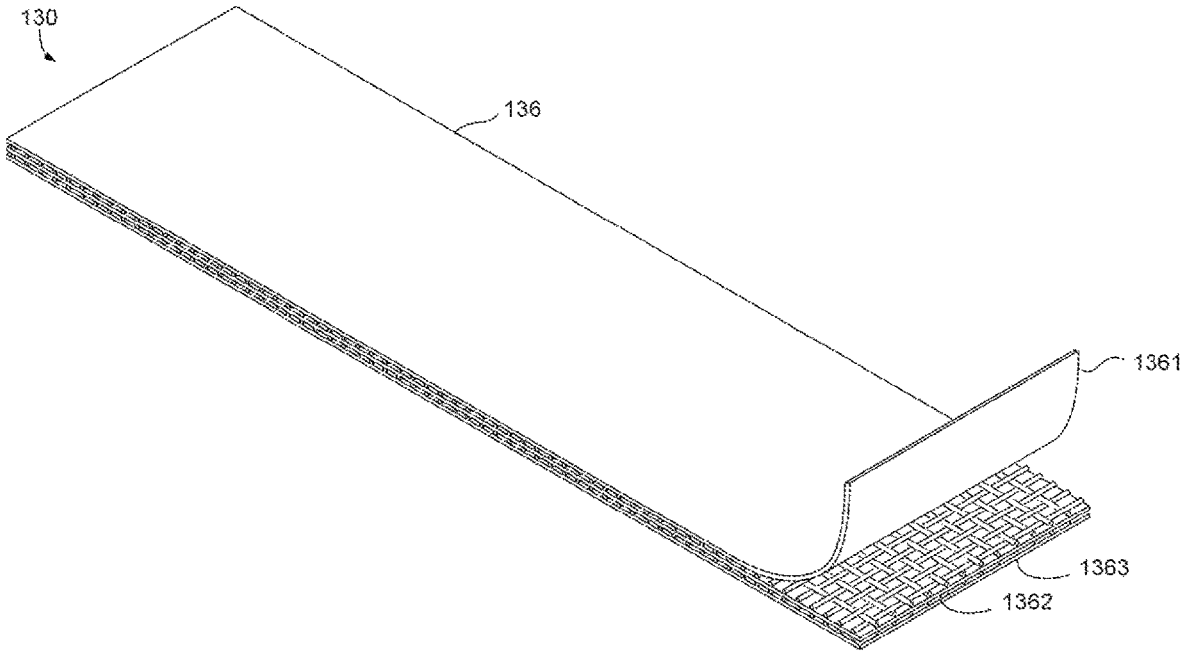
FIG. 4*e* and FIG. 4*f* each illustrate the composition of a material for constructing the connecting member in FIG. 2, according to another example embodiment.
Figure 4F:
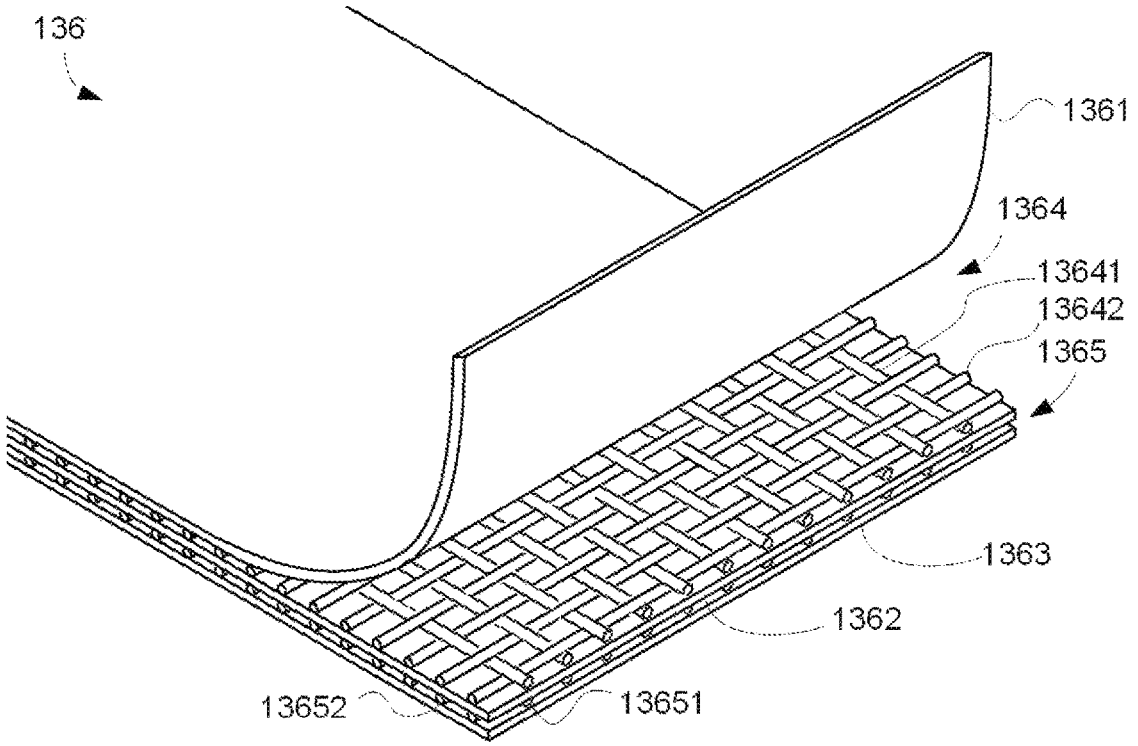

FIG. 4*e* and FIG. 4*f* illustrate a structure unit 130 for forming the connecting member 13 in FIG. 2 according to an example embodiment. The structure unit 130 comprises a connecting strip 136 manufactured by lamination of five material layers. Specifically, the connecting strip 136 comprises a first covering layer 1361, an interlayer 1362, and a second covering layer 1363. A first fiber layer 1364 is arranged between the first covering layer 1361 and the interlayer 1362, and a second fiber layer 1365 is arranged between the second covering layer 1363 and the interlayer 1362.

The fiber layer 1364 comprises a first mesh structure, and the first mesh structure includes a plurality of first strands 13641 and a plurality of second strands 13642. The first strands 13641 are each one or more strands, extending along or substantially along a direction parallel to a length of the connecting strip 136, and the plurality of first strands 13641 are parallel or substantially parallel to one another. The second strands 13642 are each one or more strands, extending along or substantially along a direction perpendicular to a length of the connecting strip 136, and the plurality of second strands 13642 are parallel or substantially parallel to one another. The first strands 13641 and the second strands 13642 are interwoven to constitute the foregoing mesh structure. The second fiber layer 1365 comprises a second mesh structure, and the second mesh structure includes a plurality of third strands 13651 and a plurality of fourth strands 13652. The third strands 13651 are each one or more strands, extending along or substantially along a direction parallel to a length of the connecting strip 136, and the plurality of third strands 13651 are parallel or substantially parallel to one another. The fourth strands 13652 are each one or more strands, extending along or substantially along a direction perpendicular to a length of the connecting strip 136, and the plurality of fourth strands 13652 are parallel or substantially parallel to one another. The strands third 13651 and the fourth strands 13652 are interwoven to constitute the foregoing mesh structure.

In an alternative example embodiment, the strands first 13641 and the second strands 13642 may be arranged obliquely between the first covering layer 1361 and the interlayer 1362, that is, there is an angle formed between the first strands 13641 and the second strands 13642 and the longitudinal direction of the connection strip 136.

The first mesh structure of the first fiber layer 1364 may be replaced with the plurality of first strands 13441 in the first fiber layer 1344 as shown in FIG. 4*a* or FIG. 4*b*, or replaced with the plurality of second strands 13542 in the first fiber layer 1354 as shown in FIG. 4*c* or FIG. 4*d*. In other example embodiments, the first mesh structure of the first fiber layer 1364 may be replaced with the mesh structure of the fiber layer 1333 shown in FIG. 3*d* or FIG. 3*e*. In some other example embodiments, the first mesh structure of the first fiber layer 1364 may be replaced with the plurality of first strands 13441 in the first fiber layer 1344 as shown in FIG. 4*a* or FIG. 4*b*, or replaced with the plurality of second strands 13542 in the first fiber layer 1354 as shown in FIG. 4*c* or FIG. 4*d*. Alternatively, the second mesh structure of the second fiber layer 1365 may be replaced with the mesh structure of the fiber layer 1333 shown in FIG. 3*d* or FIG. 3*e*.

Alternatively, at least two parallel strand layers, each formed of a plurality of parallel strands, may be stacked on each other and arranged between the first covering layer 1361 and the second covering layer 1362, thereby forming the above-mentioned first mesh structure and/or the second mesh structure. In this way, a strength of the fiber layer may be increased by using more parallel strands.

Alternatively, one of the first covering layer 1361 and the second covering layer 1363 may be omitted in some example embodiments. Except for this, the structure of the connecting strip may be analogous to that described above.

Figure 4G:
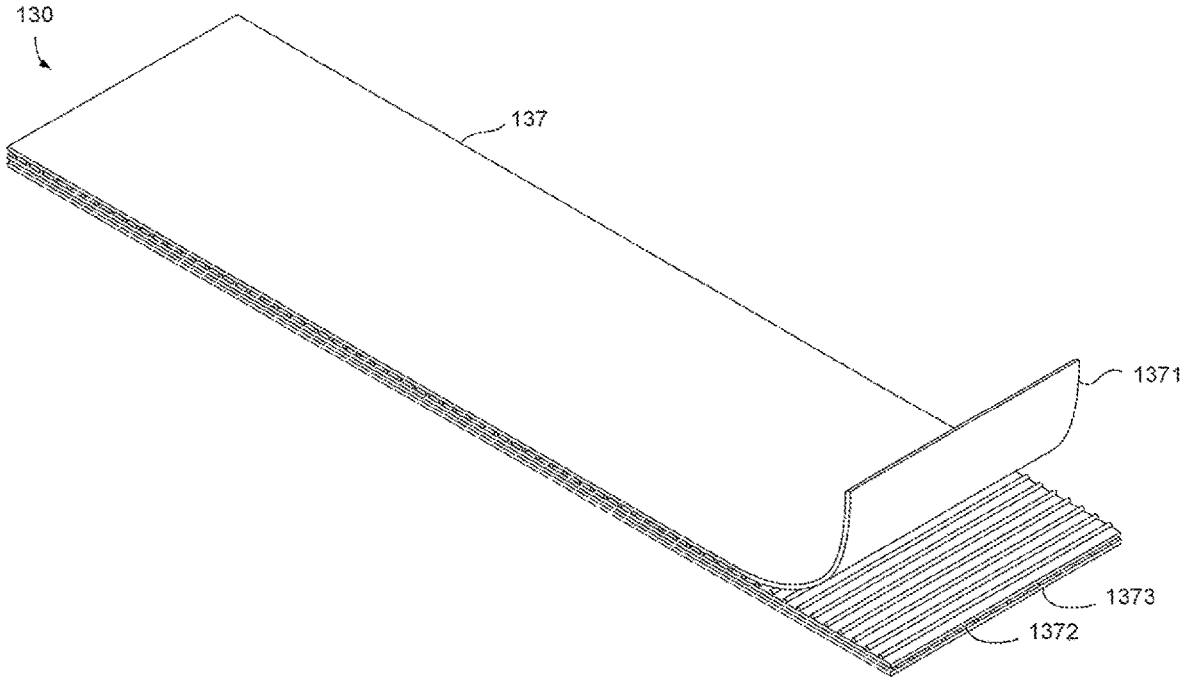
FIG. 4*g* and FIG. 4*h* each illustrate the composition of a material for constructing the connecting member in FIG. 2, according to another example embodiment.
Figure 4H:
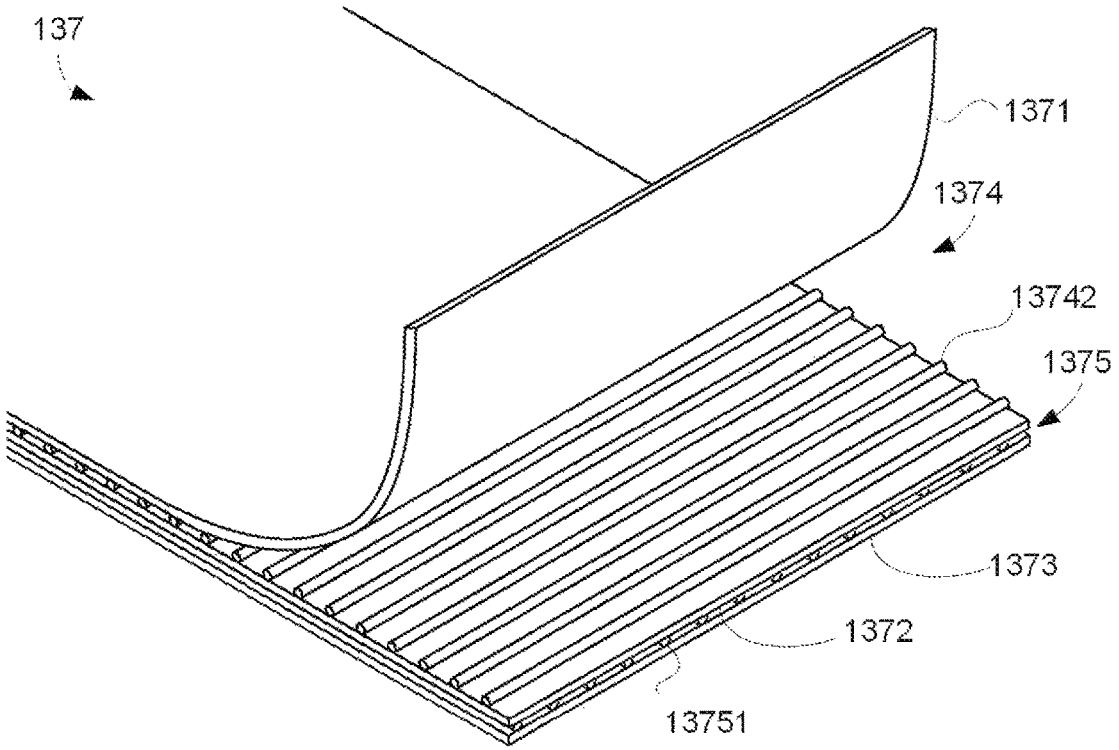

FIG. 4*g* and FIG. 4*h* illustrate a structure unit 130 for forming the connecting member 13 in FIG. 2 according to an example embodiment. The structure unit 130 may comprise a connecting strip 137 manufactured by lamination of five material layers. Specifically, the connecting strip 137 comprises a first covering layer 1371, an interlayer 1372, and a second covering layer 1373. A first fiber layer 1374 is arranged between the first covering layer 1371 and the interlayer 1372, and a second fiber layer 1375 is arranged between the second covering layer 1373 and the interlayer 1372.

The difference from the example embodiment shown in FIG. 4*a* and FIG. 4*b* lies in that, the first fiber layer 1374 includes a plurality of strands 13742 extending along or substantially along a direction parallel to a width of the connecting strip 137, and the plurality of strands 13742 are parallel or substantially parallel to one another. The second fiber layer 1375 includes a plurality of strands 13751 extending along or substantially along a direction parallel to a length of the connecting strip 137, and the plurality of strands 13751 are parallel or substantially parallel to one another.

An acute angle may be formed between the plurality of strands 13742 and the plurality of strands 13751, where the specific angle is adjusted according to processing conditions of manufacturing sites.

Alternatively, one of the first covering layer 1371 and the second covering layer 1373 may be omitted in some example embodiments. Except for this, the structure of the connecting strip may be analogous to that described above.

Tensioning Member

For ease of illustration, a tensioning member 14 is described herein with reference to FIG. 2*a*. The tensioning member 14 is made of a high tensile-resistance material with an elastic modulus allowing the tensioning member to only have a small deformation when applied with a large tensile force. According to one or more example embodiments, the tensioning member 14 may be made of a woven fabric, so that the tensioning member 14 and the connecting member 13 may be connected by sewing.

The woven fabric is a flat woven fabric or a three-dimensional woven fabric, which is made of one or more types of fibers (such as natural fibers or chemical fibers). For example, the one or more types of fibers may be selected from, but not limited to, the following materials: cotton fibers, linen fibers, silk fibers, nylon fibers, polyacrylonitrile fibers (PAN fibers), and Ultra High Molecular Weight Polyethylene Fiber (UHMWPEF).

It should be understood that there are many kinds of natural fibers or chemical fibers, and for the sake of brevity, they are not listed here, but only some common examples are provided, and these examples do not constitute a limitation to the example embodiments described herein.

The tensioning member may be made of a woven fabric, which has a tensile resistance performance better than that of an elastic chemical material. The fabric may be cotton fabrics, linen fabrics, wool fabrics, silk fabric, chemical fiber fabric (e.g., oxford cloth), or another fabric, as would be understood by one of skill in the art. After being treated, these fabrics generally have capacities to retain properties in wet environments and can be directly exposed to an air chamber of the inflatable product without the need to further provide a coating on the surface during production. Manufacturing costs and weights of the fabrics are generally less than those of the elastic chemical materials of the same area. In this way, the manufacturing costs and weight of the inflatable product manufactured with the tensioning member may be reduced. Moreover, the woven fabrics may be easy-to-degrade materials such as cotton fibers or linen fabrics, so that the inflatable product may be friendly to the natural environment.

The tensioning member may alternately be made of a non-woven fabric. Any material that can be firmly joined with the connecting member by sewing or gluing can be used, for example, a leather material with a high tensile strength.

Figure 5A:
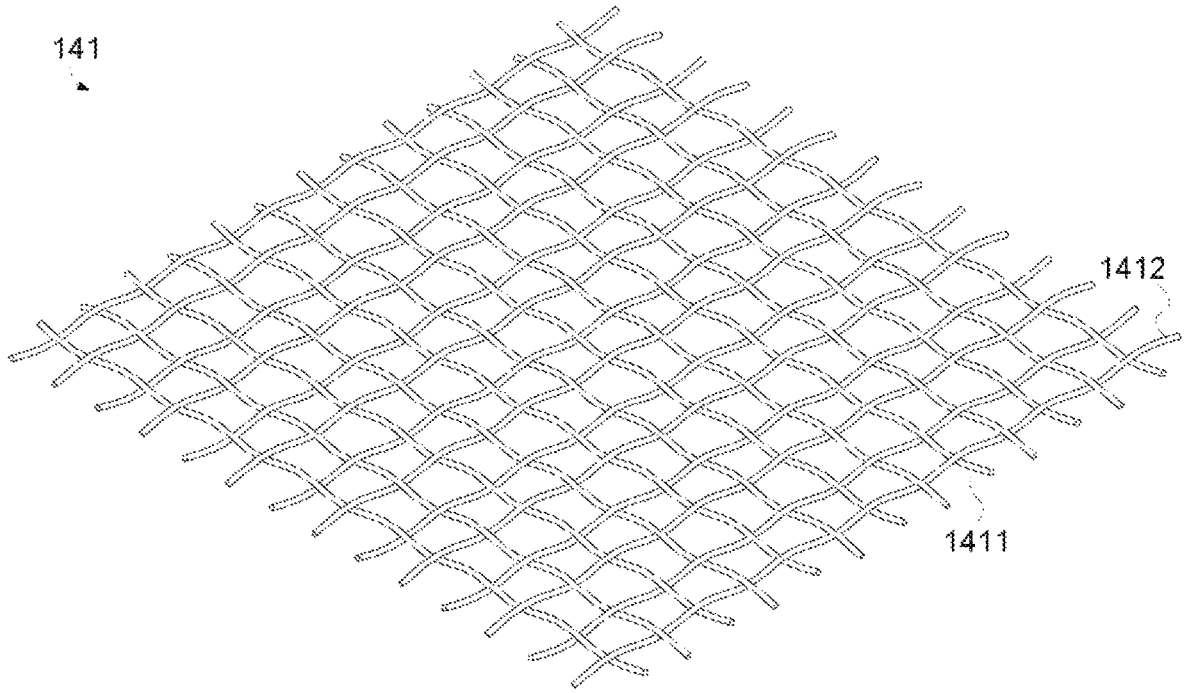
FIG. 5*a* to FIG. 5*e* each illustrate a structure of a fabric for manufacturing a tensioning member according to an example embodiment.

Referring to FIG. 5*a*, in an embodiment, a woven fabric 141 used to make the tensioning member 14 is interwoven from a plurality of first strands 1411 and a plurality of second strands 1412, and the first strands 1411 and the second strands 1412 may each be made of one or more types of fibers (such as natural fibers or chemical fibers).

Figure 5B:
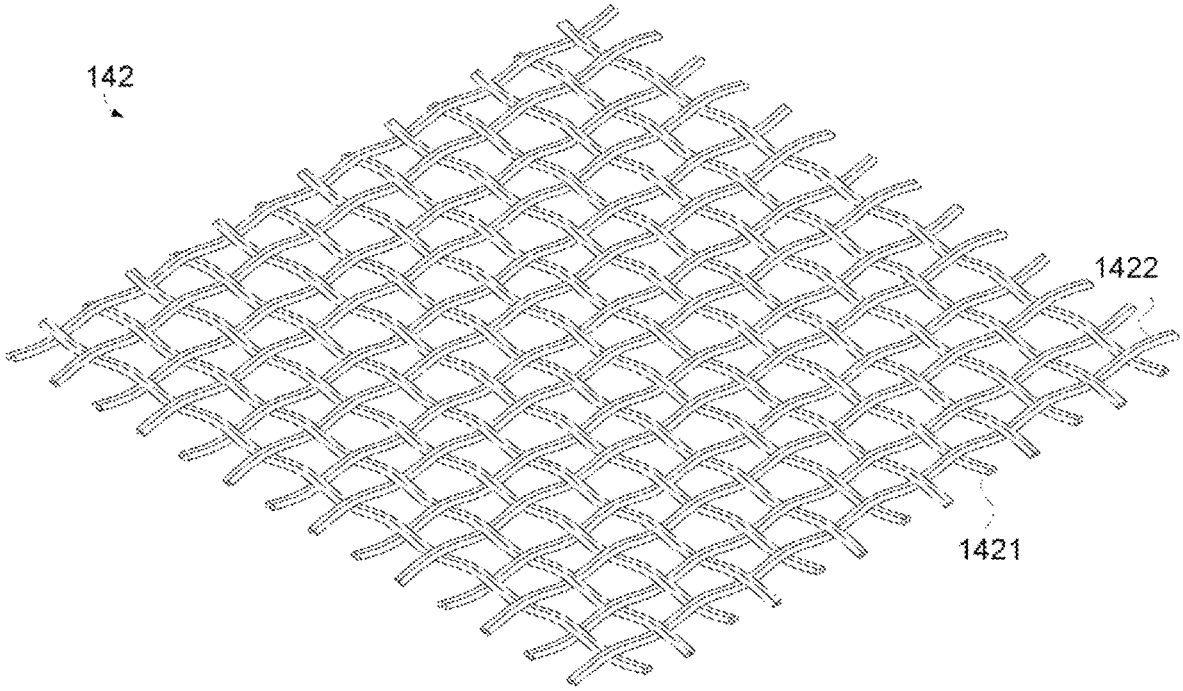

Referring to FIG. 5*b*, in another example embodiment, a woven fabric 142 used to make the tensioning member 14 is interwoven from a plurality of first strand groups 1421 and a plurality of second strand groups 1422. The first strand groups 1421 each include at least two strands, and the second strand groups 1422 each include at least two strands. The strands in the first strand groups 1421 and the second strand groups 1422 may be made of one or more types of fibers (e.g., natural fibers or chemical fibers).

Figure 5C:
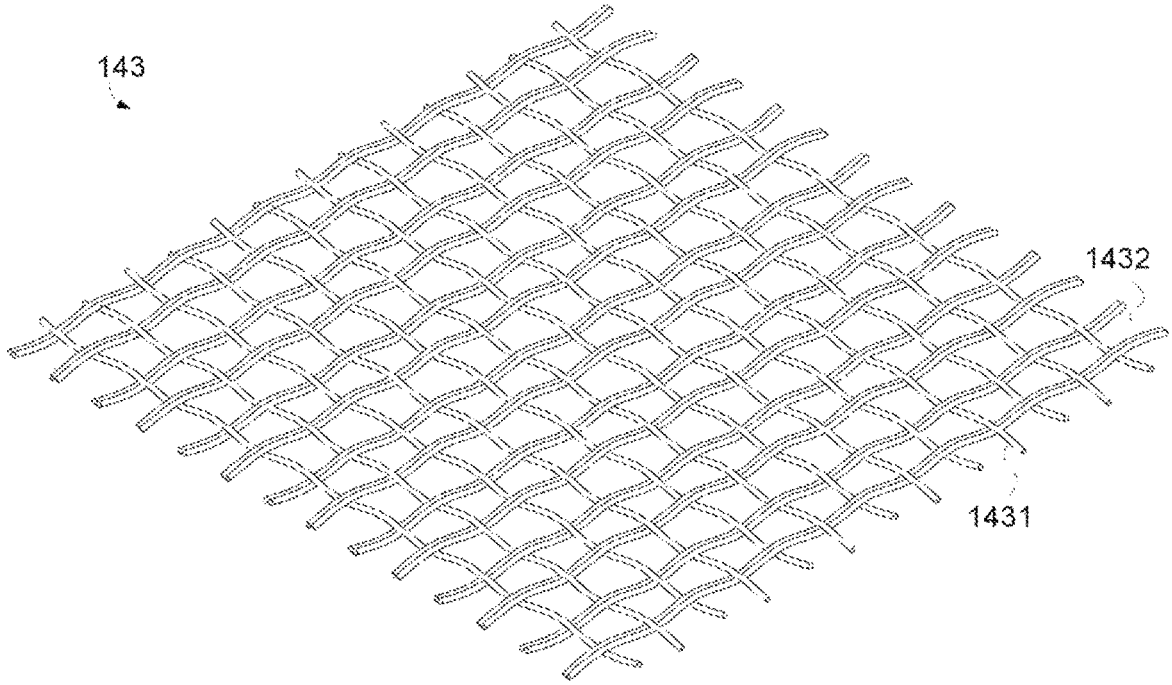

Referring to FIG. 5*c*, in another example embodiment, a woven fabric 143 used to make the tensioning member 14 is interwoven from a plurality of strands 1431 and a plurality of strand groups 1432. The strand groups 1432 may each include at least two strands. The strands of the strand group 1432 and the strands 1431 may be made of one or more types of fibers (e.g., natural fibers or chemical fibers).

Figure 5D:
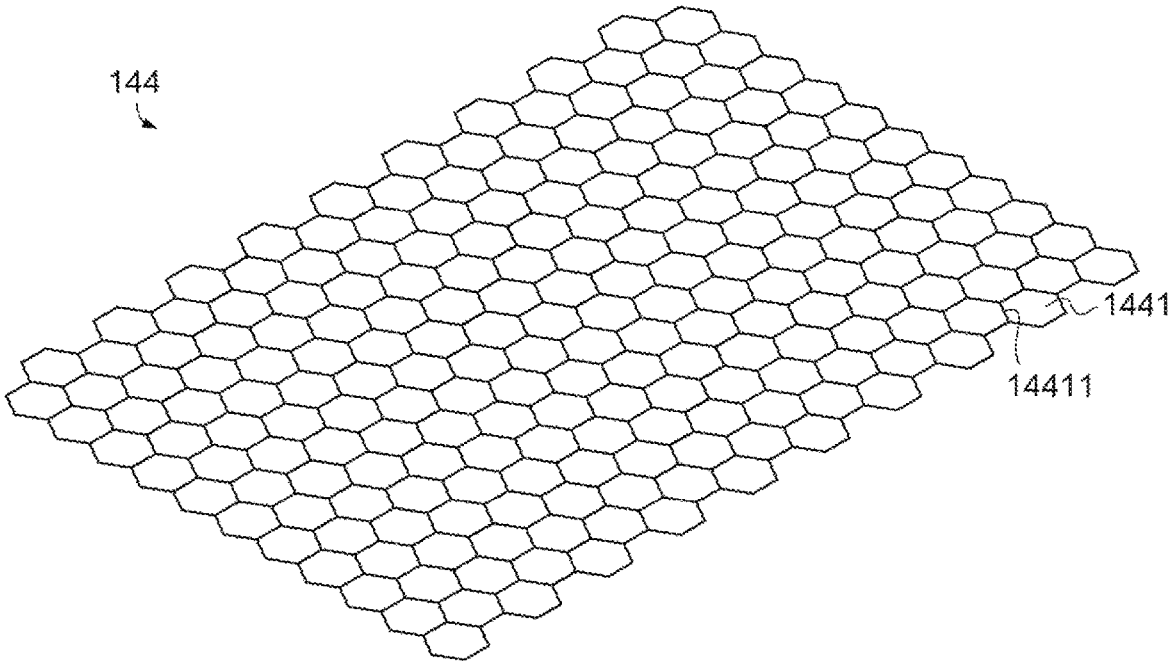

Referring to FIG. 5*d*, in another example embodiment, a woven fabric 144 used to make the tensioning member 14 includes an array containing a plurality of hexagonal elements 1441. Each element 1441 may be defined by a hexagonal frame 14411, and each hexagonal frame 14411 may comprise one or more fibers. The elements 1441 in the grid array are staggered and evenly distributed, allowing the woven fabric 144 a substantially constant tensile strength in different directions. The woven fabric may be made of any of the various fibers described above.

Figure 5E:
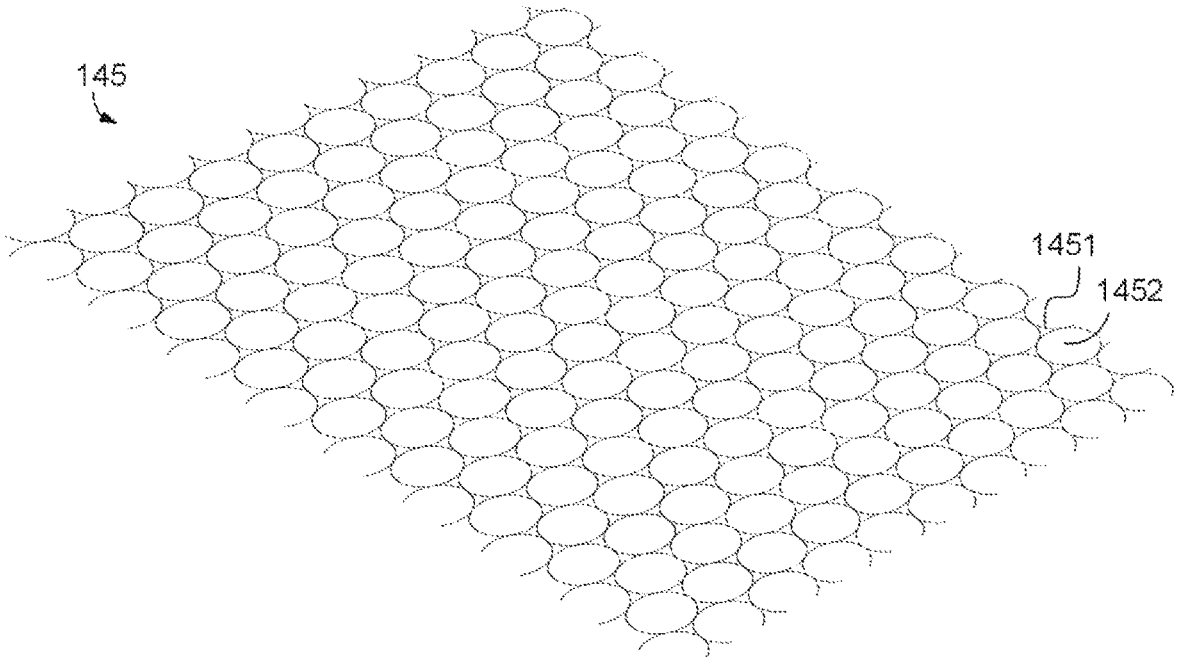

Referring to FIG. 5*e*, in another example embodiment, a woven fabric 145 used to make the tensioning member 14 may include an array containing a plurality of round elements 1451. Each element 1451 may be defined by a frame 14511, and each frame 14511 may comprise one or more fibers. The elements 1451 in the grid array are staggered and uniformly distributed, so that the fabric 145 may have a substantially constant tensile strength in different directions. The woven fabric may be made of any of the various fibers described above.

In some example embodiments, the woven fabric used to make the tensioning member 14 may be a three-dimensional woven fabric. The three-dimensional woven fabric may be formed by arranging or entangling fibers. For example, a three-dimensional woven fabric may be constructed by connecting multiple layers of woven fabrics together with knot strands.

Installation of Tensioning Members and Connecting Members

Various tensioning members according to various example embodiments are described above and may be made of, for example, woven fabrics. However, it may be is difficult to directly fix such tensioning members to a wall of the inflatable product by hot pressing, welding (e.g., thermal welding or high-frequency welding), or the like. While these tensioning members may be fixed to the wall of the inflatable product by gluing, if the gluing strength is insufficient, the material may separate under a high inflation pressure of the inflatable product.

In view of the above situation, in some example embodiments, tensioning members made of woven fabrics are connected to suitable connecting members, and the connecting members may be welded to the wall of the inflatable product. Thus, a firm connection between the tensioning members and the wall of the inflatable product may be provided, allowing the inflatable product to bear a relatively high internal air pressure.

In some example embodiments, tensioning members are connected to connecting members, and the connecting members are connected to the wall of the inflatable chamber of the inflatable product, so that the tensioning members are indirectly connected to the wall of the inflatable chamber of the inflatable product through the connecting members. For example, the tensioning members may be connected to the connecting members by sewing, and the connecting members may be connected to the wall of the inflatable chamber by gluing, hot pressing, welding (e.g., thermal welding or high-frequency welding) or another manner. In this way, provided that the wall of the inflatable chamber remains intact and is not punctured, the tensioning members and the connecting members may be reliably connected to the wall of the inflatable chamber (e.g., the inner wall 111 and the outer wall 112 of the pool wall 11 of the inflatable pool 1), so the wall of the inflatable chamber is less prone to leakage at the positions of the connecting members, limiting quality problems of the inflatable product.

Example embodiments of installing the tensioning members in an inflatable product are described below by taking the installation of the tensioning members on the inner wall 111 of the pool wall 11 of the inflatable pool 1 as an example. These example embodiments are fit for any wall of an inflatable product. In some example embodiments, the connecting members used to connect the tensioning members to different walls of the inflatable product (e.g., the inner wall 111 and the outer wall 112) have the same or substantially the same structure. In some other example embodiments, the connecting members used to connect the tensioning members to different walls of the inflatable product (e.g., the inner wall 111 and the outer wall 112) have different structures.

Figure 6A:
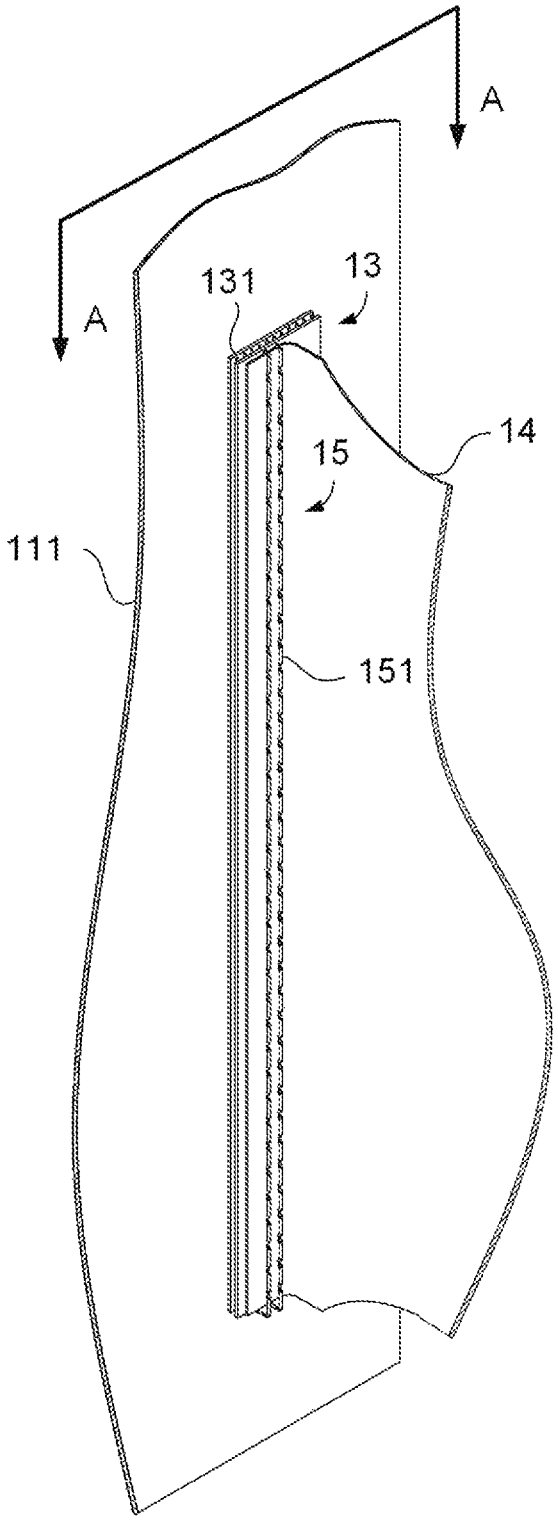
FIG. 6*a* and FIG. 6*b* illustrate a connection manner of a connecting member and a tensioning member according to an example embodiment.
Figure 6B:
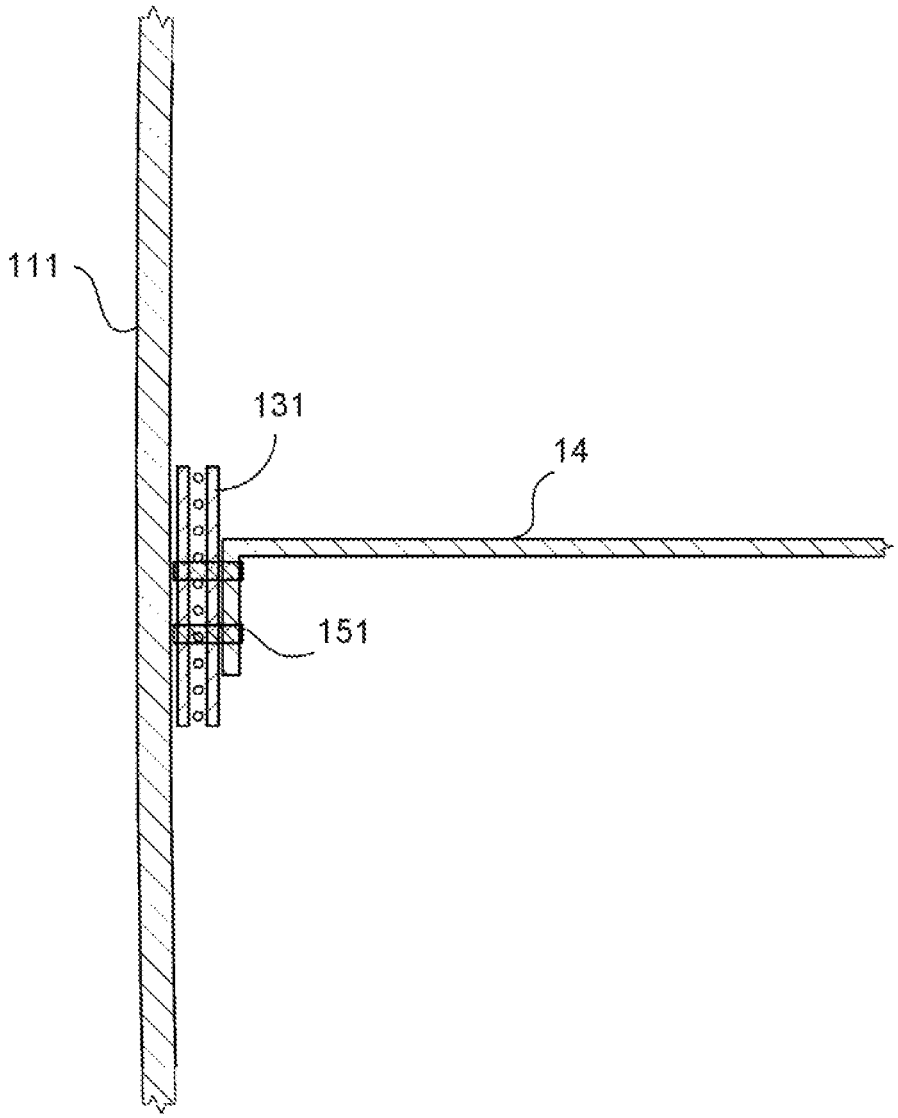

FIG. 6*a* and FIG. 6*b* illustrate an example embodiment in which the tensioning member 14 in FIG. 2 is connected to the inner wall of the inflatable chamber through the connecting member 13. In this example embodiment, the tensioning member 14 is fixed to the connecting member 13 by sewing using one or more sewing threads 151. FIG. 6*b* is a view in a direction A-A of FIG. 6*a*. Two rows of stitches 15 are formed by the sewing threads 151, and the stitches 15 extend along or substantially along a length of the connecting member 13. The connecting member 13 comprises the connecting strip 131 (see e.g., FIG. 3*a*). In this way, the tensioning member 14 is connected to the connecting strip 131 by sewing. More specifically, the woven fabric structure of the tensioning member 14 and the fiber layer in the connecting strip 131 are connected by the sewing threads 151. Subsequently, one covering layer of the connecting strip 131 may be connected to the inner wall 111 by high-frequency welding.

Alternatively, the strands 13131 are arranged obliquely between the first coating layer 1311 and the second coating layer 1312, and the same sewing thread 151 may intersect the plurality of strands 13131 to be interlaced and fixed.

Figure 6C:
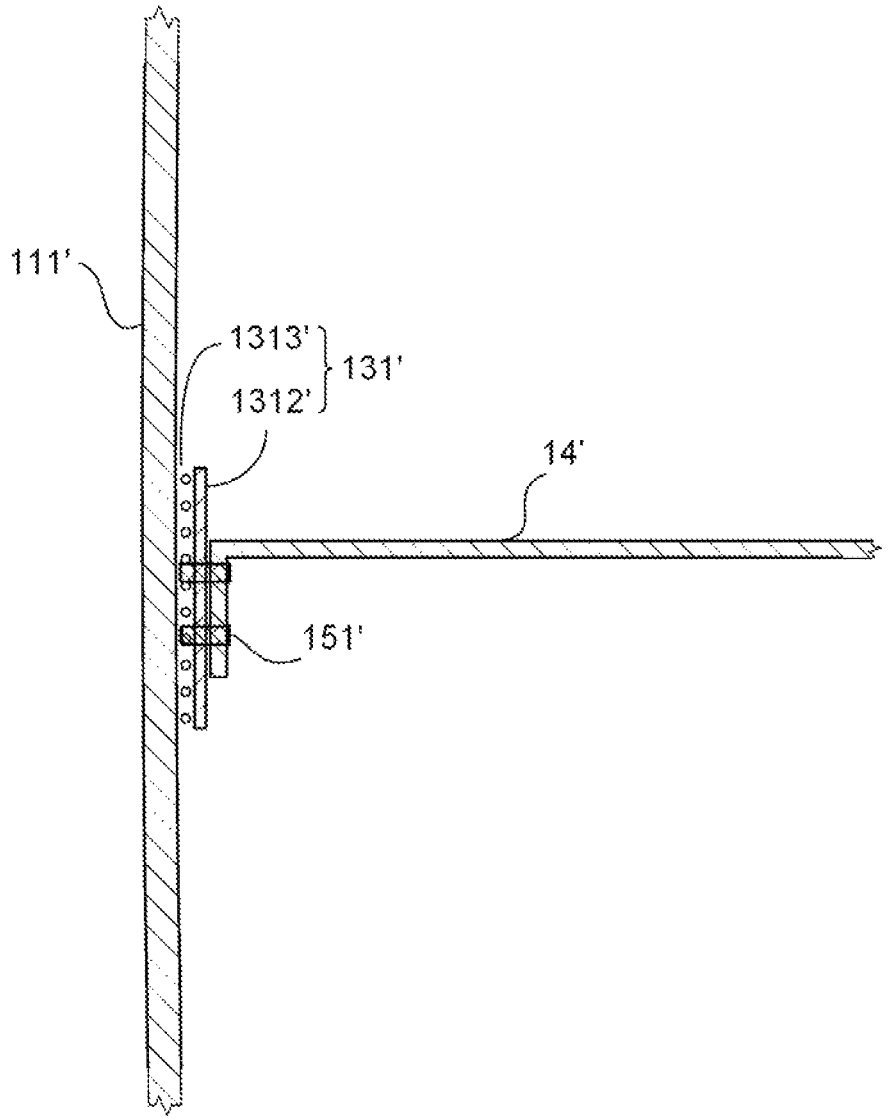
FIG. 6*c* illustrates a connection manner of a connecting member and a tensioning member according to an example embodiment.

FIG. 6*c* illustrates an example embodiment in which the tensioning member 14 in FIG. 2 is connected to the inner wall of the inflatable chamber through the connecting member 13. The difference from the example embodiment shown in FIG. 6*a* and FIG. 6*b* lies in that one of the covering layers of the connecting strip 131 may be omitted. The connecting strip 131' comprises the second covering layer 1312' and the fiber layer 1313' (see e.g., to FIG. 3*f*). Via sewing threads 151', a tensioning member 14' is fixed to a connecting strip 131'. The fiber layer 1313' is arranged between the second covering layer 1312' and an inner wall 111'. The second covering layer 1312' is connected to the inner wall 111' by gluing, hot pressing, welding (e.g., thermal welding or high-frequency welding) or other manners.

It can be understood that the stitches formed by the sewing threads on the surface of the tensioning member are not limited to two lines, and may be of more or fewer lines.

Figure 6D:
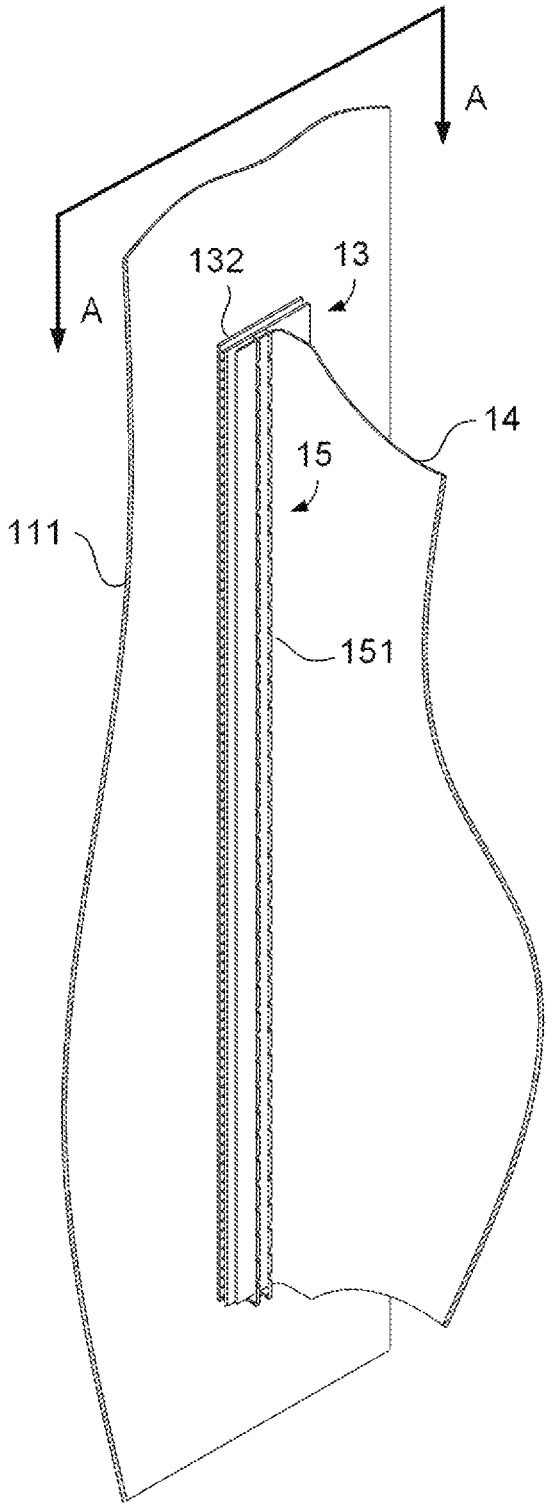
FIG. 6*d* and FIG. 6*e* illustrate a connection manner of a connecting member and a tensioning member according to an example embodiment.
Figure 6E:
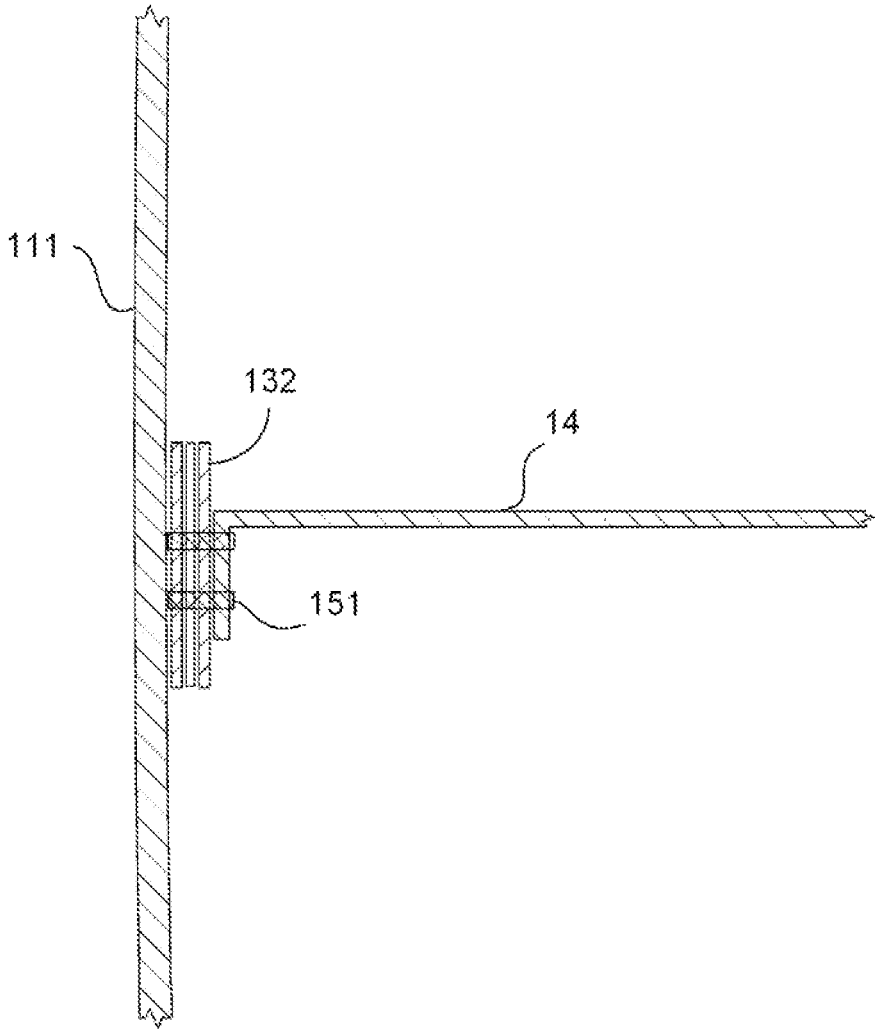

FIG. 6*d* and FIG. 6*e* illustrate an example embodiment in which the tensioning member 14 in FIG. 2 is connected to the inner wall of the inflatable chamber through the connecting member 13 according to an embodiment. In this example embodiment, the tensioning member 14 is fixed to the connecting member 13 by sewing through one or more sewing threads 151. FIG. 6*e* is a view in a direction A-A of FIG. 6*d*. Two lines of stitches 15 are formed by the sewing threads 151, and the stitches 15 extend along or substantially along a length of the connecting member 13. The connecting member 13 comprises the connecting strip 132 (see e.g., FIG. 3*b*). In this way, the tensioning member 14 is connected to the connecting strip 132 by sewing. More specifically, the woven fabric structure of the tensioning member 14 and the fiber layer in the connecting strip 132 are connected by the sewing threads 151. Subsequently, one covering layer of the connecting strip 132 may be connected to the inner wall 111 by high-frequency welding.

The strands 13231 may be parallel or substantially parallel to the width direction of the connecting member 13, and the sewing threads 151 may intersect the strands 13231 to be interlaced and fixed.

Figure 6F:
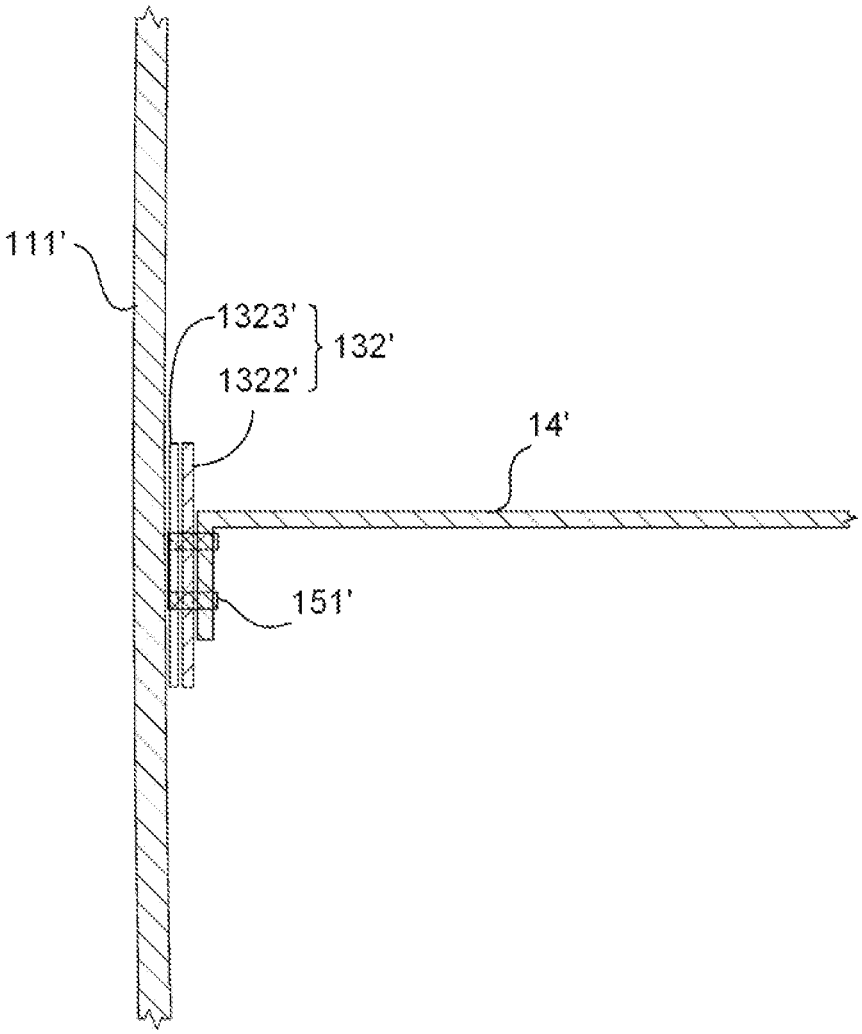
FIG. 6*f* illustrates a connection manner of a connecting member and a tensioning member according to an example embodiment.

FIG. 6*f* illustrates an example embodiment in which the tensioning member 14 in FIG. 2 is connected to the inner wall of the inflatable chamber through the connecting member 13. The difference from the example embodiment shown in FIG. 6*d* and FIG. 6*e* lies in that one covering layer of the connecting strip 132 may be omitted.

It can be understood that the stitches formed by the sewing threads on the surface of the tensioning member are not limited to two lines, and may be more or fewer lines.

Figure 6G:
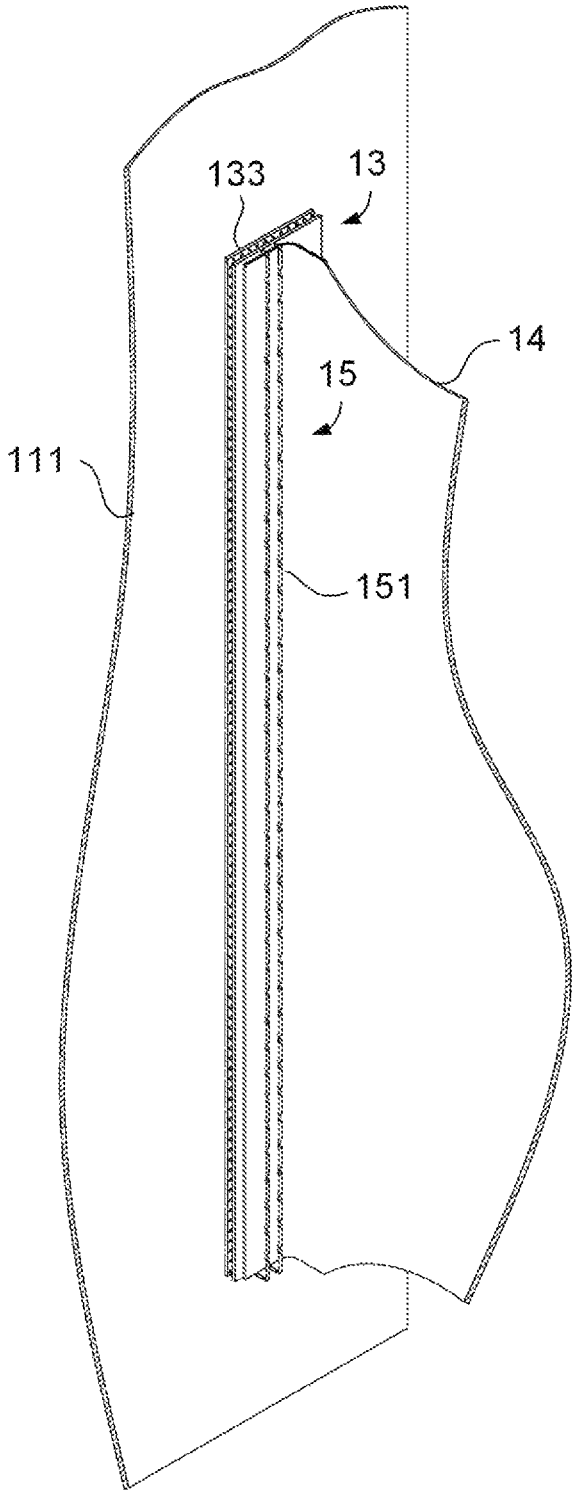
FIG. 6*g* illustrates a connection manner of a connecting member and a tensioning member in an embodiment according to an example embodiment.

FIG. 6*g* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along a length of the connecting member 13. The connecting member 13 comprises the connecting strip 133 (see e.g., FIG. 3*c*, FIG. 3*d*, and FIG. 3*e*). In this way, the tensioning member 14 is connected to the connecting strip 133 by sewing. More specifically, the fabric structure of the tensioning member 14 and the fiber layer in the connecting strip 133 are connected by the sewing threads 151. Subsequently, one covering layer of the connecting strip 133 may be connected to the inner wall 111 by high-frequency welding.

The fiber layer 1333 may comprise a mesh structure, and the sewing thread 151 may be interlaced and fixed with the mesh structure.

Figure 6H:
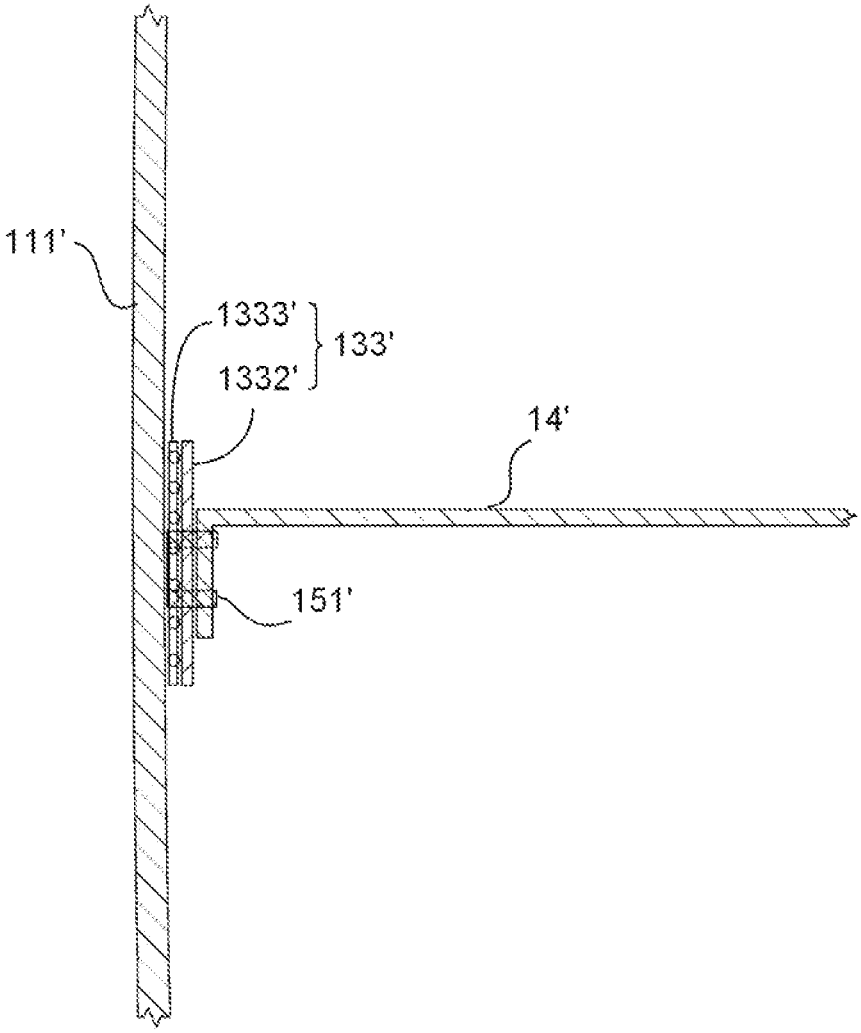
FIG. 6*h* illustrates a connection manner of a connecting member and a tensioning member according to an example embodiment.

FIG. 6*h* illustrates an example embodiment in which the tensioning member 14 in FIG. 2 is connected to the inner wall of the inflatable chamber through the connecting member 13. The difference from the example embodiment shown in FIG. 6*g* lies in that one covering layer of the connecting strip 133 may be omitted.

It can be understood that the stitches formed by the sewing threads on the surface of the tensioning member are not limited to be two lines, and may be more or fewer lines.

Figure 7A:
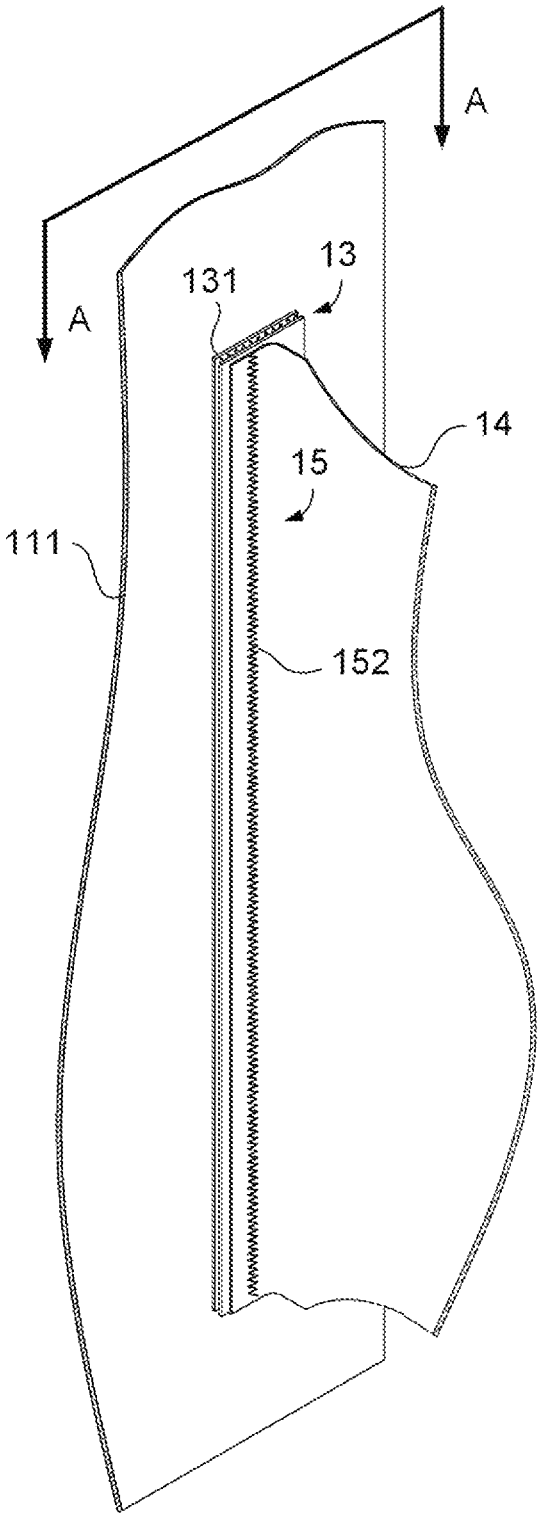
FIG. 7*a* and FIG. 7*b* illustrate a connection manner of a connecting member and a tensioning member according to an example embodiment.
Figure 7B:
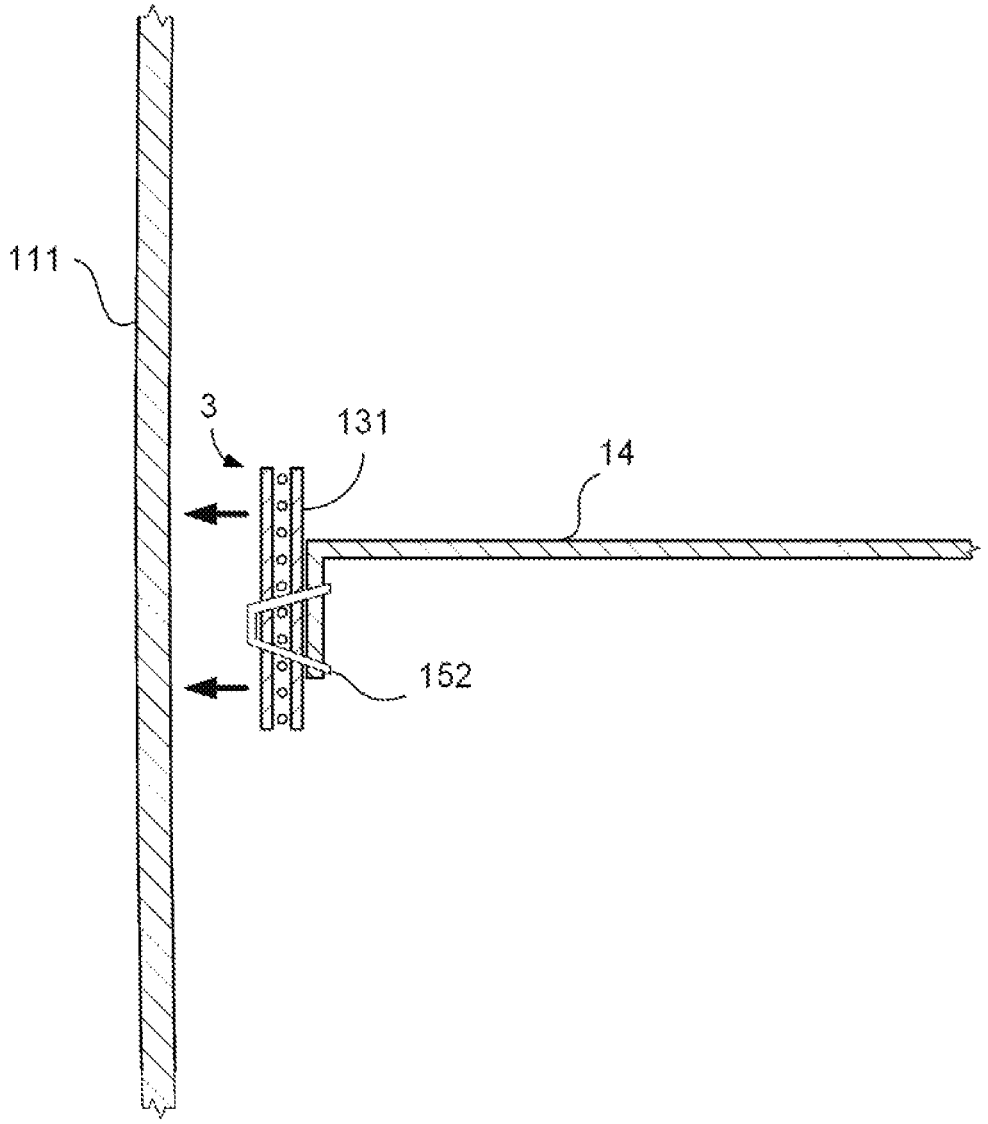

FIG. 7*a* illustrates an example embodiment in which the tensioning member 14 in FIG. 2 is connected to the inner wall of the inflatable chamber through the connecting member 13. In this embodiment, stitches 15 are formed in a zig-zag formation form with a sewing thread 152 used to sew the tensioning member 14 to the connecting member 13. FIG. 7*b* is a view in a direction A-A of FIG. 7*a*. The sewing thread 152 extending in zig-zag and crosses at least one strand of the fiber layer of the connecting member 13 and is interlaced and fixed with the same.

It can be understood that the stitches 15 formed by the sewing thread 152 in a zig-zag form can be applied to any one or more of the example embodiments described herein.

Figure 8A:
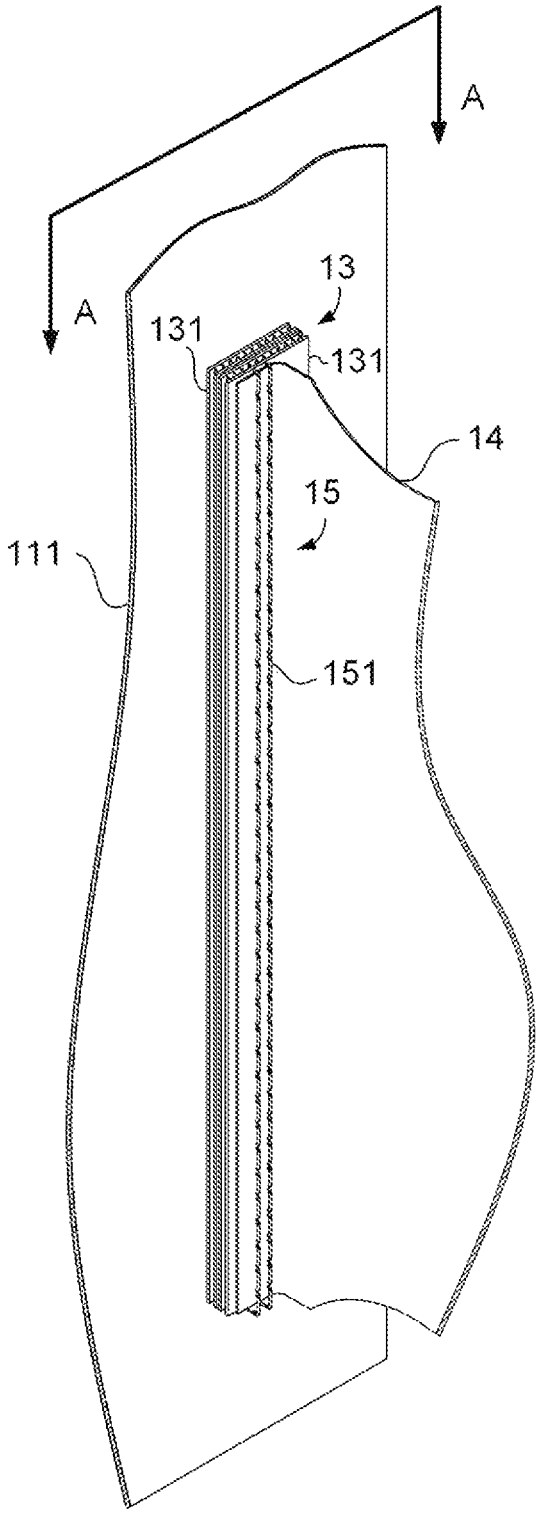
FIG. 8*a* and FIG. 8*b* illustrate a connection manner of a connecting member and a tensioning member according to an example embodiment.
Figure 8B:
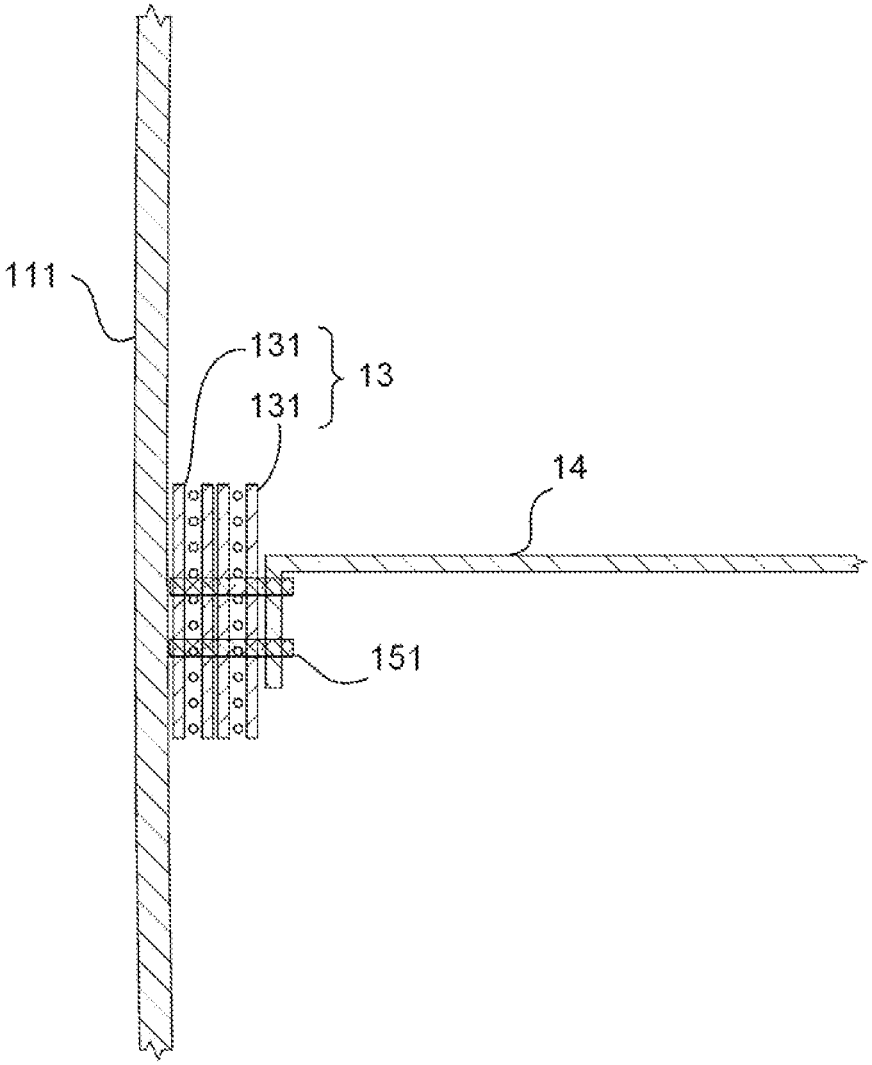

FIG. 8*a* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. FIG. 8*b* is a view in a direction A-A of FIG. 8*a*. Two lines of stitches 15 are formed by the sewing threads 151, and the stitches 15 extend along or substantially along a length of the connecting member 13. The connecting member 13 comprises at least two connecting strips 131 (see e.g., FIG. 3*a*) stacked on each other. In this way, the tensioning member 14 is connected to the two connecting strips 131 by sewing. More specifically, the two connecting strips are joined by welding, and the woven fabric structure of the tensioning member 14 and the fiber layers in the two connecting strips 131 are connected by the sewing threads 151. Subsequently, one covering layer of one of the connecting strips 131 may be connected to the inner wall 111 by high-frequency welding. Optionally, the connecting strips 131 stacked on each other are connected by gluing, hot pressing, welding (e.g., thermal welding or high-frequency welding) or another manner.

Then, the two fiber layers are sewn with the sewing thread, which may reduce loose thread due to accidental broken stitch, and may further improve firmness of the connection.

According to one or more example embodiments, a covering layer, closer to the inner wall 111, of the connecting strips 131 may be omitted.

It can be understood that the stitches formed by the sewing threads on the surface of the tensioning member are not limited to two lines, and may be more or fewer lines.

Figure 8C:
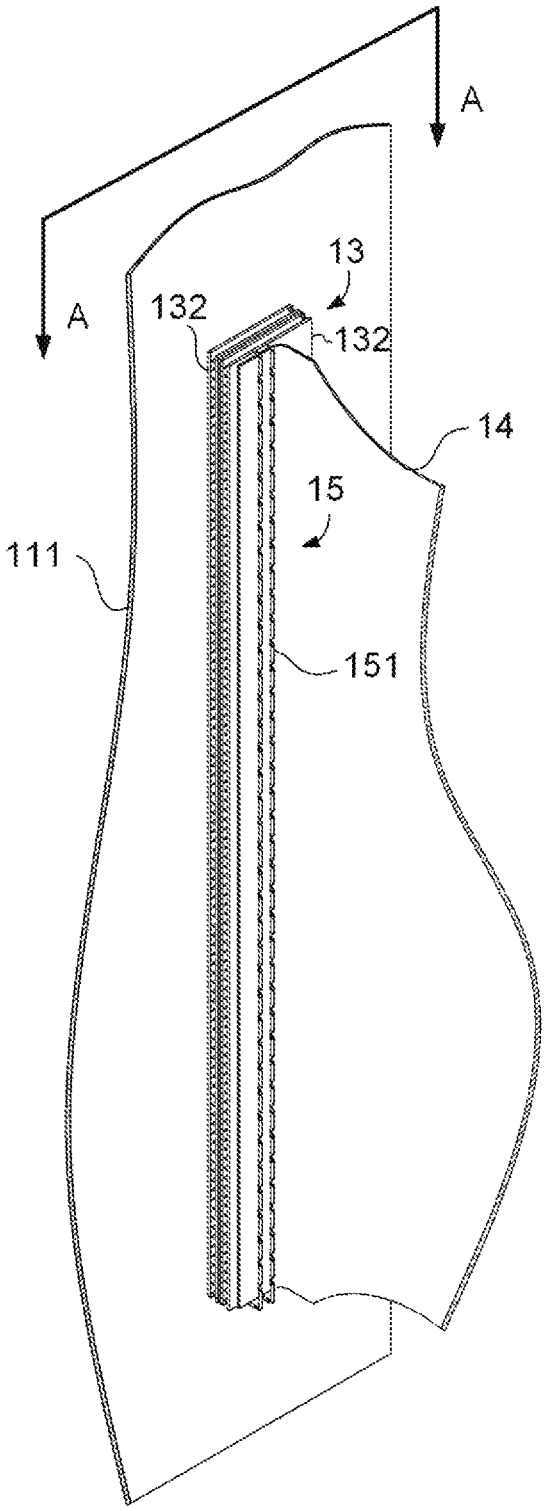
FIG. 8*c* and FIG. 8*d* illustrate a connection manner of a connecting member and a tensioning member according to an example embodiment.
Figure 8D:
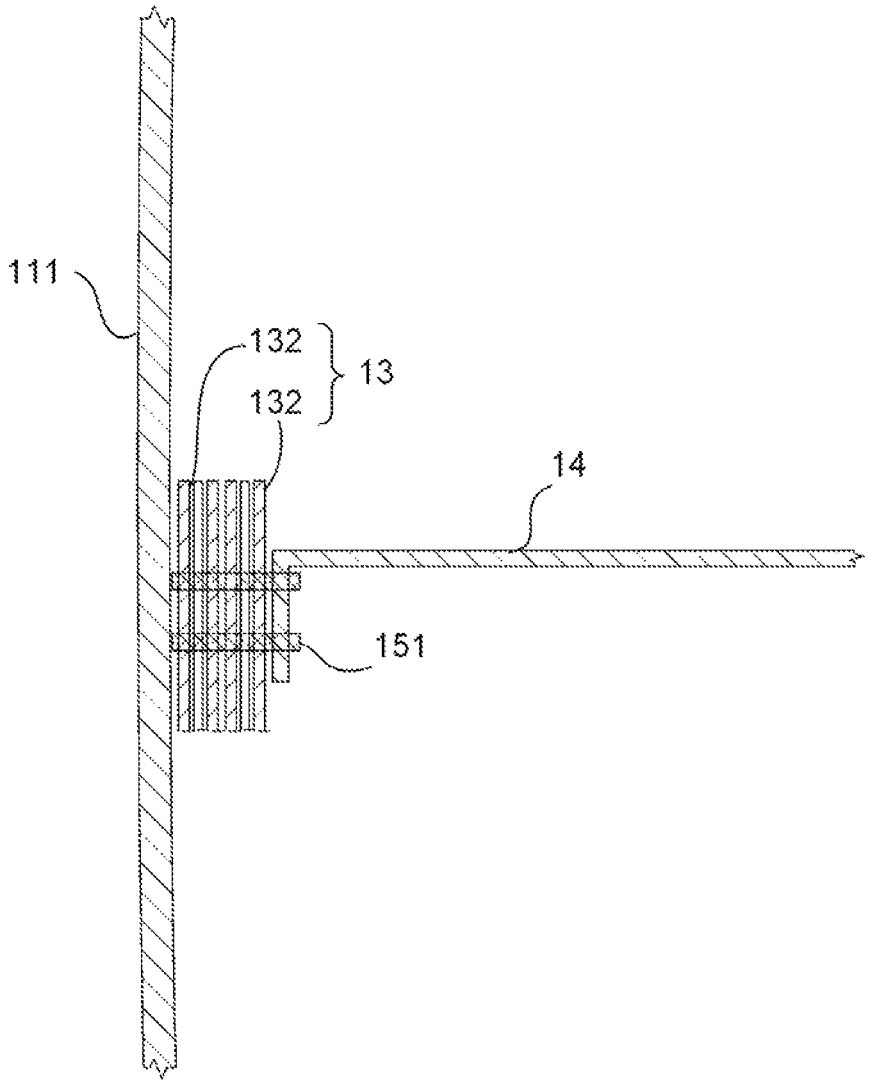

FIG. 8*c* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. FIG. 8*d* is a view in a direction A-A of FIG. 8*c*. Two lines of stitches 15 are formed by the sewing threads 151, and the stitches 15 extend along or substantially along a length of the connecting member 13. The connecting member 13 includes at least two connecting strips 132 (see e.g., FIG. 3*b*) stacked on each other. In this way, the tensioning member 14 is connected to the two connecting strips 132 by sewing. More specifically, the woven fabric structure of the tensioning member 14 and the fiber layers in the two connecting strips 132 are connected by the sewing threads 151. Subsequently, one covering layer of the two connecting strips 132 may be connected to the inner wall 111 by high-frequency welding.

Optionally, the connecting strips 132 stacked on each other are connected by gluing, hot pressing, welding (e.g., thermal welding or high-frequency welding) or another manner.

Alternatively, a covering layer, closer to the inner wall 111, of the connecting strips 131 may be omitted.

It can be understood that the stitches formed by the sewing threads on the surface of the tensioning member are not limited to two, and may be more or fewer lines.

Figure 8E:
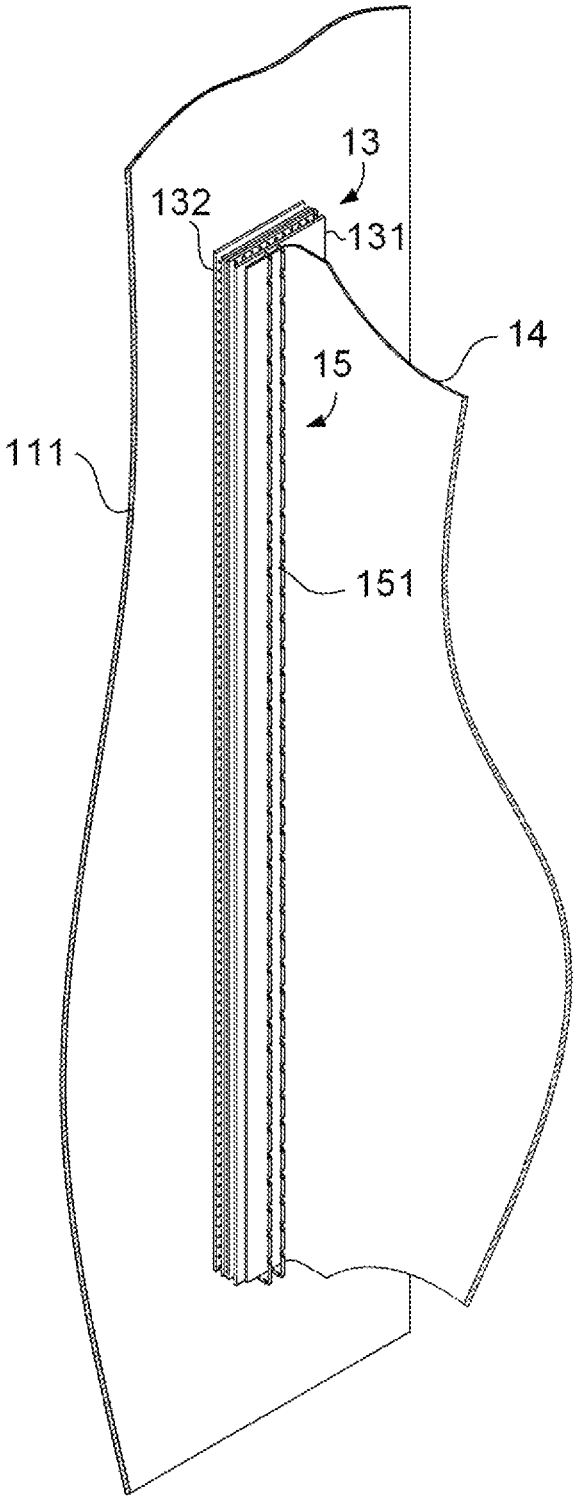
FIG. 8*e* to FIG. 8*g* each illustrate a connection manner of a connecting member and a tensioning member according to an example embodiment.

FIG. 8*e* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along a length of the connecting member 13. The connecting member 13 comprises a connecting strip 131 and a connecting strip 132 (refer to FIG. 3*a* and FIG. 3*b*), and the connecting strip 131 and the connecting strip 132 are stacked. The connecting strip 132 is arranged between the inner wall 111 and the connecting strip 131.

Optionally, the connecting strip 131 and the connecting strip 132 may be connected by gluing, hot pressing, welding (e.g., thermal welding or high-frequency welding) or another manner.

For the connecting strip 132, the strands 13231 are parallel or substantially parallel to the width direction of the connecting member 13, and the sewing threads 151 are interlaced and fixed with the strands 13231.

Alternatively, one covering layer of the connecting strip 132 may be omitted.

It can be understood that the stitches formed by the sewing threads on the surface of the tensioning member are not limited to two lines, and may be more or fewer lines.

Figure 8F:
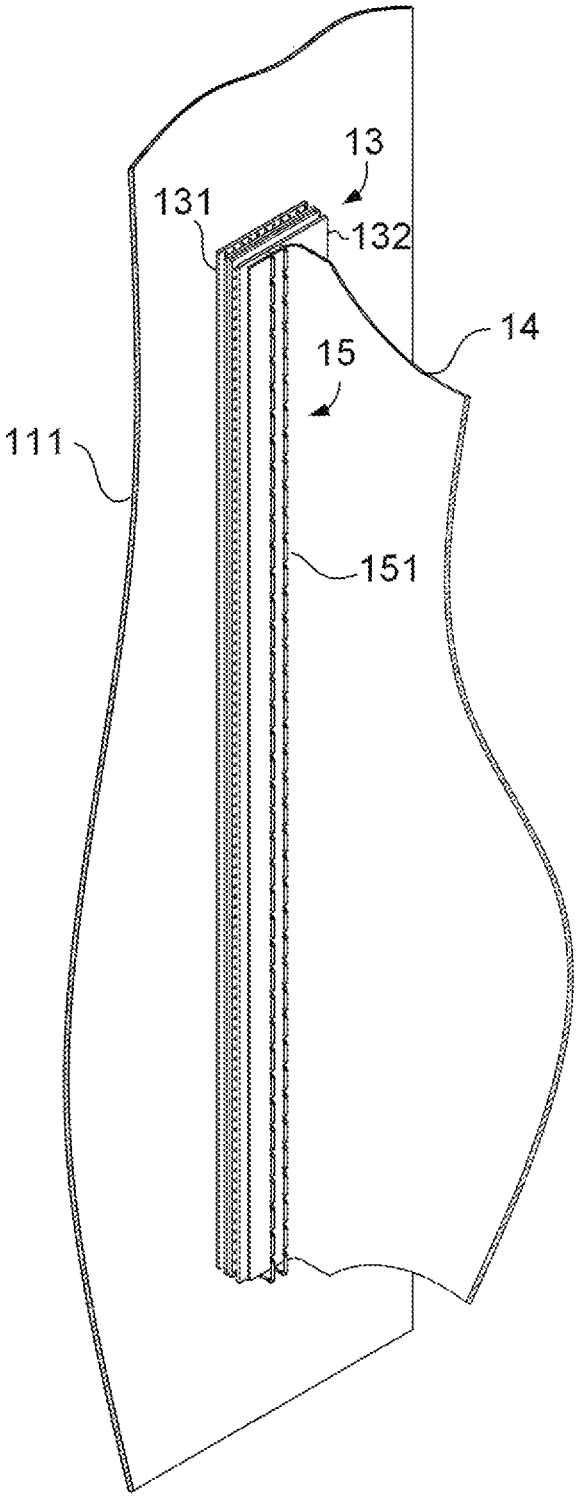

FIG. 8*f* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along a length of the connecting member 13.

The difference from the example embodiment shown in FIG. 8*e* lies in that, in this example embodiment, the connecting strip 131 is arranged between the inner wall 111 and the connecting strip 132.

Alternatively, one covering layer of the connecting strip 131 may be omitted. It can be understood that the stitches formed by the sewing threads on the surface of the tensioning member are not limited to be two lines, and may be more or fewer lines.

Figure 8G:
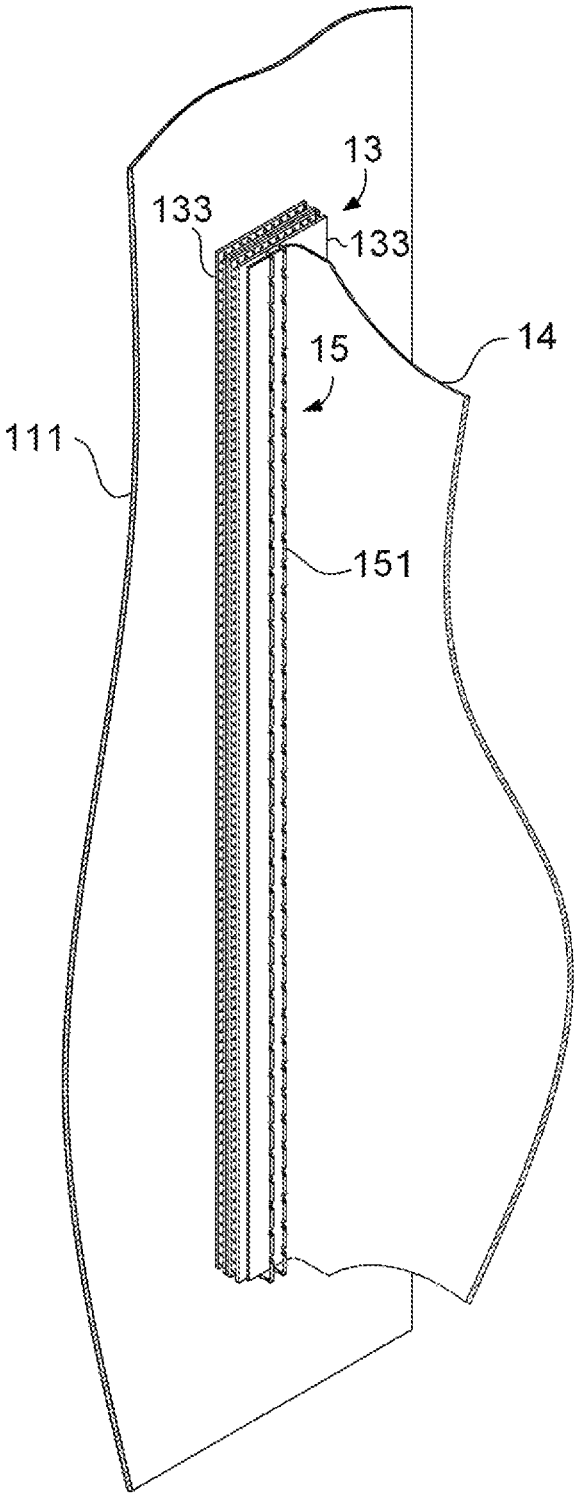

FIG. 8*g* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along a length of the connecting member 13. The connecting member 13 comprises two connecting strips 133 (see e.g., FIG. 3*d* to FIG. 3*e*) stacked on each other.

Optionally, the two connecting strips 133 stacked on each other may be connected by gluing, hot pressing, welding (e.g., thermal welding or high-frequency welding) or another manner.

For each connecting strip 133, the fiber layer 1333 comprises a mesh structure, and the sewing thread 151 is interlaced and fixed with the mesh structure.

Alternatively, a covering layer, closer to the inner wall 111, of the connecting strip 133 may be omitted.

It can be understood that the stitches formed by the sewing threads on the surface of the tensioning member are not limited to two lines, and may be more or fewer lines.

Alternatively, one of the two connecting strips 133 may be replaced with one of the connecting strip 131 shown in FIG. 3*a*, the connecting strip 131' shown in FIG. 3*f*, the connecting strip 132 shown in FIG. 3*b*, and the connecting strip 132' shown in FIG. 3*g*, the connecting strip 134 shown in FIG. 4*a*, the connecting strip 135 shown in FIG. 4*c*, the connecting strip 136 shown in FIG. 4*e* and the connecting strip 137 shown in FIG. 4*g*.

Figure 9A:
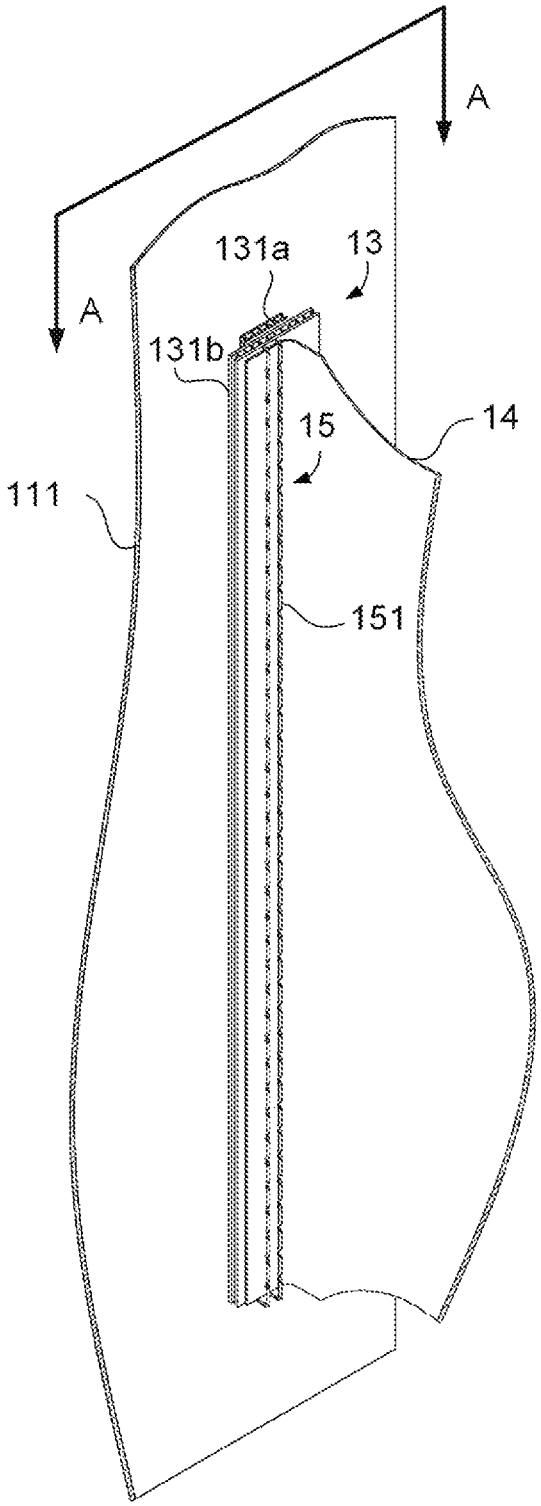
FIG. 9*a* and FIG. 9*b* illustrate a connection manner of a connecting member and a tensioning member according to an example embodiment.
Figure 9B:
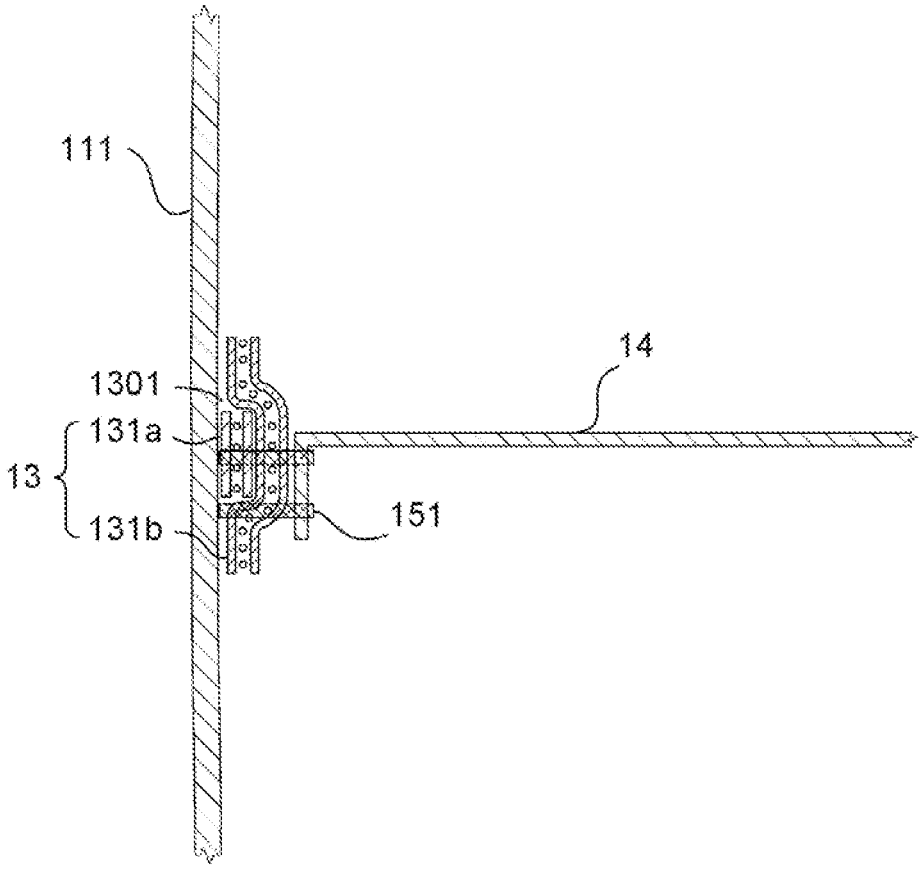

FIG. 9*a* and FIG. 9*b* illustrate an example embodiment in which the tensioning member 14 in FIG. 2 is connected to the inner wall of the inflatable chamber through the connecting member 13. In this example embodiment, the difference from the example embodiment shown in FIG. 8*a* and FIG. 8*b* lies in that a width of the connecting strip 131*a* is smaller than that of a connecting strip 131*b*. The tensioning member 14 is fixed to the connecting member 13 by sewing through one or more sewing threads 151. FIG. 9*b* is a view in a direction A-A of FIG. 9*a*. Two lines of stitches 15 are formed by the sewing threads 151, and the stitches 15 extend along or substantially along the length of the connecting member 13. One sewing thread 151 is interlaced with both the connecting strips 131*a* and 131*b*, and another sewing thread 151 is only interlaced with the connecting strip 131*b*, so that the stitches 15 are formed. It can be understood the width of the connecting strip 131*a* may be appropriately increased, so that the two sewing threads 151 are both interlaced with the connecting strips 131*a* and 131*b*, according to one or more example embodiments.

The connecting strips 131*a* and 131*b* are connected by, for example, high-frequency welding, and then are respectively connected to the inner wall 111 by gluing, hot pressing, welding (e.g., thermal welding or high-frequency welding) or another manner.

As shown in FIG. 9*b*, both ends of the connecting strip 131*b* may be connected to the inner wall 111, and the connecting strip 131*b* and the inner wall 111 together may define an accommodating space 1301. The connecting strip 131*a* is accommodated in the accommodating space 1301. It can be understood that this structure can be applied to any one or more of the example embodiments described herein.

Optionally, the connecting strip 131*a* and at least one of the connecting strip 131*b* and the inner wall 111 may be connected together by gluing, hot pressing, welding (e.g., thermal welding or high-frequency welding) or another manner. It can also be understood that this technical feature can be applied to any one or more of the example embodiments described herein.

Alternatively, the sewing threads 151 forming the stitches 15 may be replaced with a sewing thread 152 extending in a zig-zag form.

It can be understood that the stitches formed by the sewing threads on the surface of the tensioning member are not limited to two lines, and may be more or fewer lines.

Figure 9C:
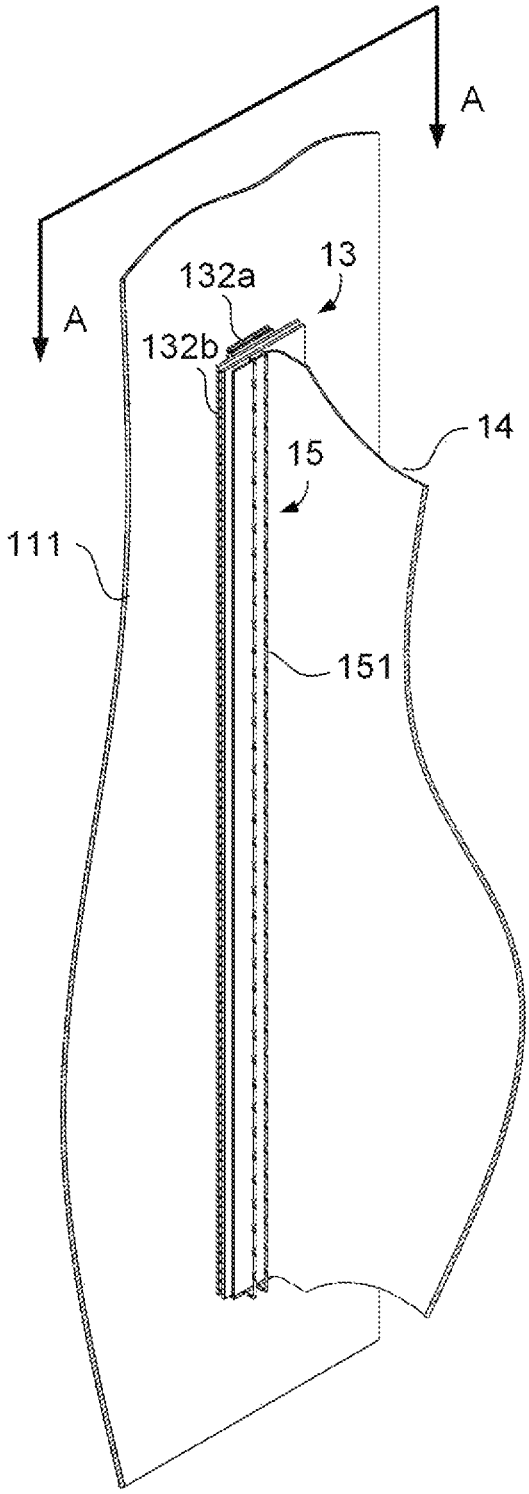
FIG. 9*c* and FIG. 9*d* illustrate a connection manner of a connecting member and a tensioning member according to an example embodiment.
Figure 9D:
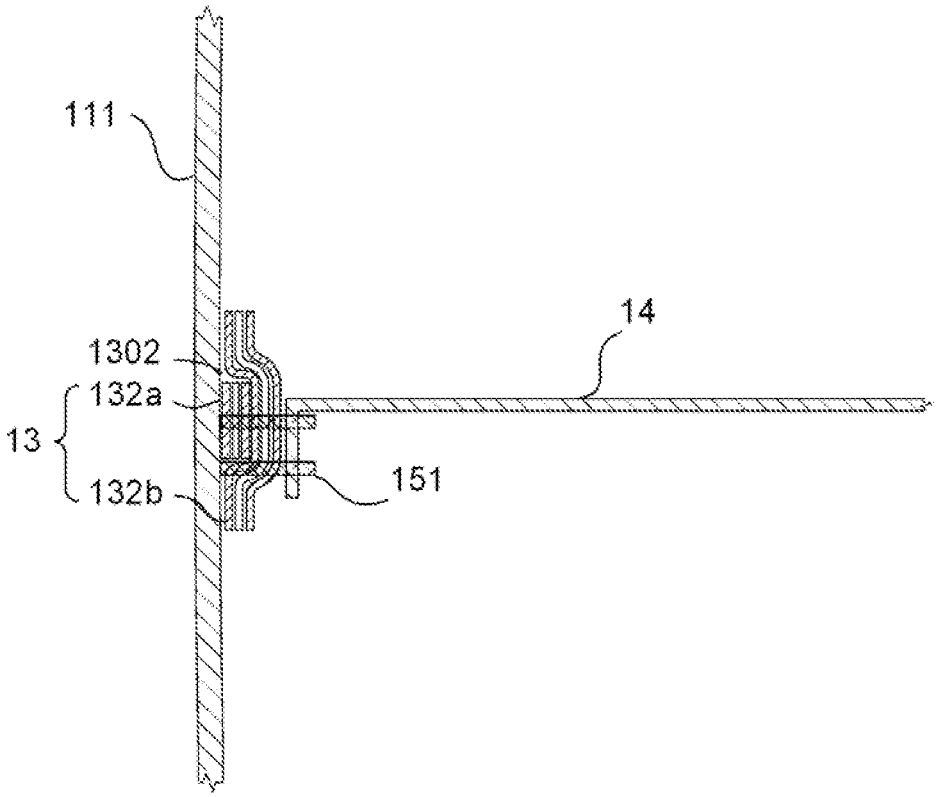

FIG. 9*c* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. The difference from the example embodiment shown in FIG. 8*c* and FIG. 8*d* lies in that a width of a connecting strip 132*a* may be smaller than that of a connecting strip 132*b*. FIG. 9*d* is a view in a direction A-A of FIG. 9*c*. Two lines of stitches 15 are formed by the sewing threads 151, and the stitches 15 extend along or substantially along the length of the connecting member 13. One sewing thread 151 is interlaced with both the connecting strips 132*a* and 132*b*, and another sewing thread 151 is only interlaced with the connecting strip 132*b*, so that the stitches 15 are formed. It can be understood that, according to one or more example embodiments, the width of the connecting strip 132*a* may be appropriately increased, so that the two sewing threads 151 are both interlaced with the connecting strips 132*a* and 132*b*. Alternatively, the sewing threads 151 forming the stitches 15 may be replaced with a sewing thread 152 extending in a zig-zag form. It can be understood that the stitches formed by the sewing threads on the surface of the tensioning member are not limited to two lines, and may be more or fewer lines.

Figure 9E:
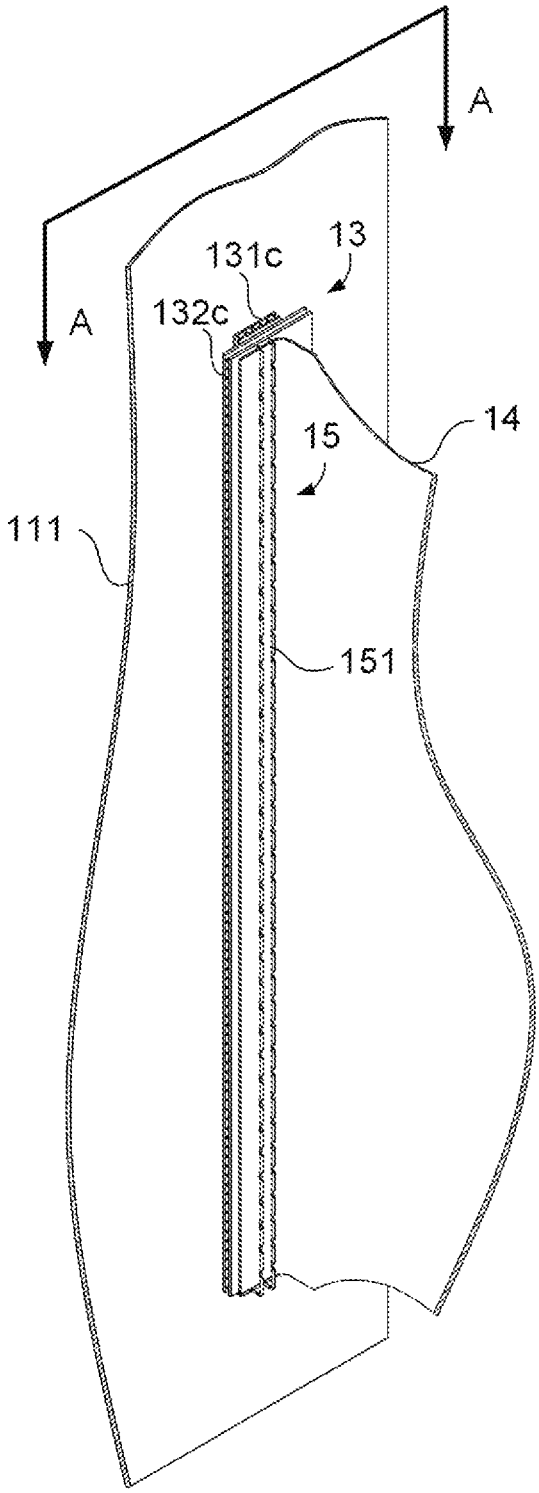
FIG. 9*e* and FIG. 9*f* illustrate a connection manner of a connecting member and a tensioning member according to an example embodiment.
Figure 9F:
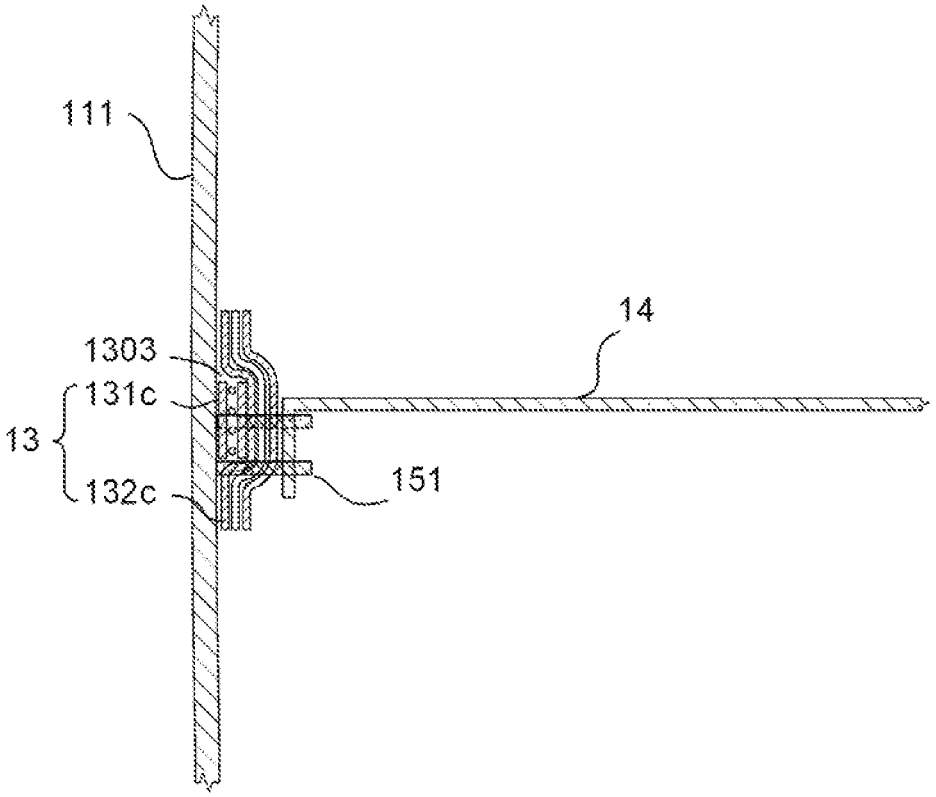

FIG. 9*e* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. The difference from the example embodiment shown in FIG. 8*f* lies in that a width of a connecting strip 131*c* is smaller than that of a connecting strip 132*c*. FIG. 9*f* is a view in a direction A-A of FIG. 9*e*. Two lines of stitches 15 are formed by the sewing threads 151, and the stitches 15 extend along or substantially along the length of the connecting member 13. One sewing thread 151 is interlaced with both the connecting strips 131*c* and 132*c*, and another sewing thread 151 is only interlaced with the connecting strip 132*c*, so that the stitches 15 are formed. It can be understood that, in some other example embodiments, the width of the connecting strip 131*c* may be appropriately increased, so that the two sewing threads 151 are both interlaced with the connecting strips 131*c* and 132*c*, according to one or more example embodiments.

Alternatively, in some example embodiments, the sewing threads 151 used to form the stitches 15 are replaced with a sewing thread 152 extending in a zig-zag form.

It can be understood that the stitches formed by the sewing threads on the surface of the tensioning member are not limited to two lines, and may be more or fewer lines.

Figure 9G:
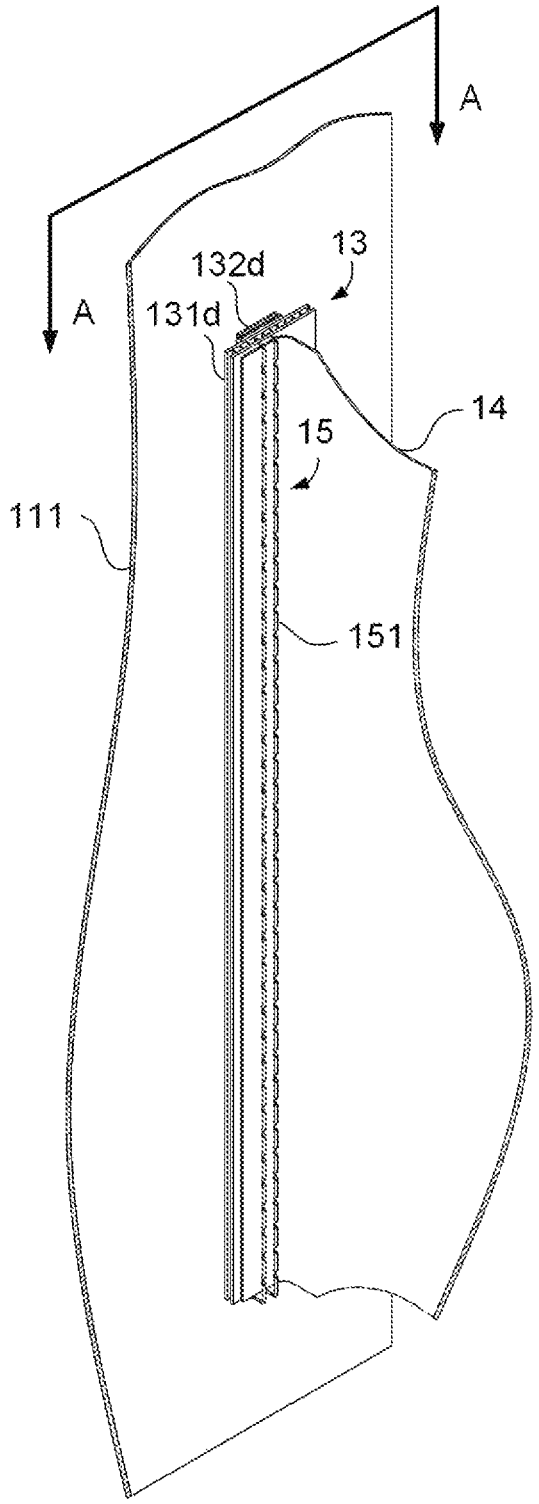
FIG. 9*g* and FIG. 9*h* illustrate a connection manner of a connecting member and a tensioning member according to an example embodiment.

FIG. 9*g* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. The difference from the example embodiment shown in FIG. 8*e* lies in that a width of a connecting plate 131*c* may be smaller than that of a connecting plate 132*c*.

Figure 9H:
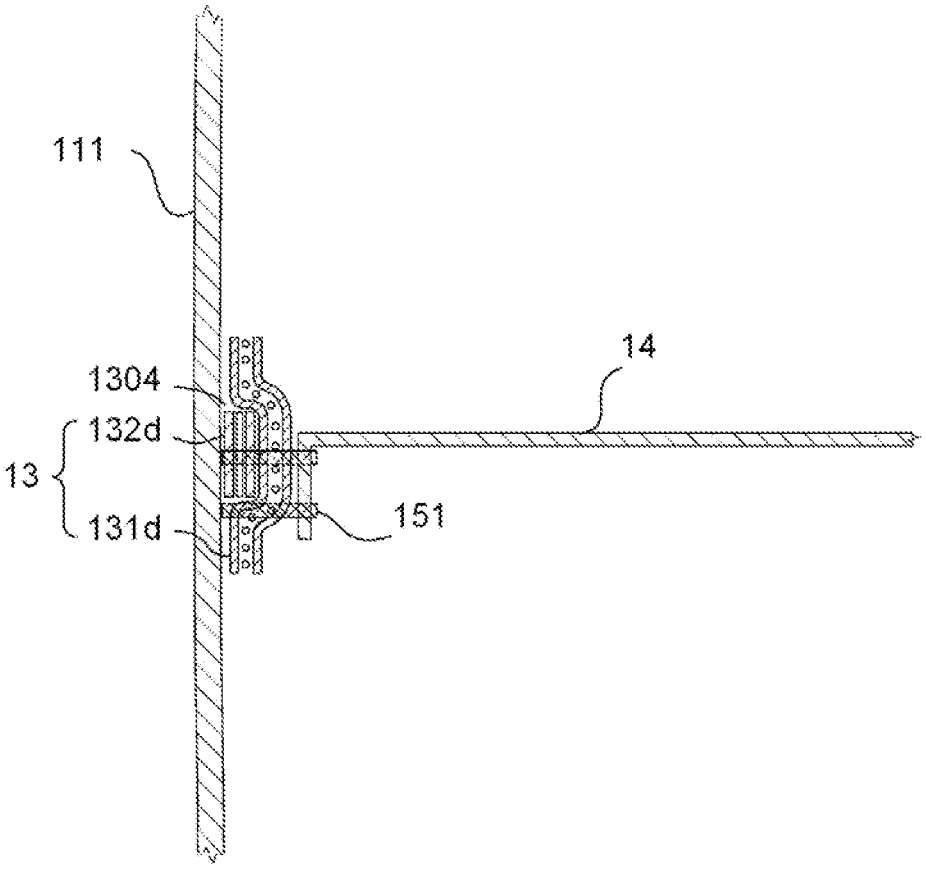

FIG. 9*h* is a view in a direction A-A. Two lines of stitches 15 are formed by the sewing threads 151, and the stitches 15 extend along or substantially along the length of the connecting member 13. The difference from the embodiment shown in FIG. 9*f* lies in that the positions of the connecting strip 131 and the connecting strip 132 are interchanged. One sewing thread 151 is interlaced with both the connecting strips 131*d* and 132*d*, and another sewing thread 151 is only interlaced with the connecting strip 131*d*, so that the stitches 15 are formed. It can be understood that, in some other example embodiments, the width of the connecting strip 132*d* may be appropriately increased, so that the two sewing threads 151 are both interlaced with the connecting strips 131*d* and 132*d*.

Alternatively, in some example embodiments, the sewing threads 151 used to form the stitches 15 may be replaced with a sewing thread 152 extending in a zig-zag form.

It can be understood that the stitches formed by the sewing threads on the surface of the tensioning member are not limited to two lines, and may be more or fewer lines.

Figure 10A:
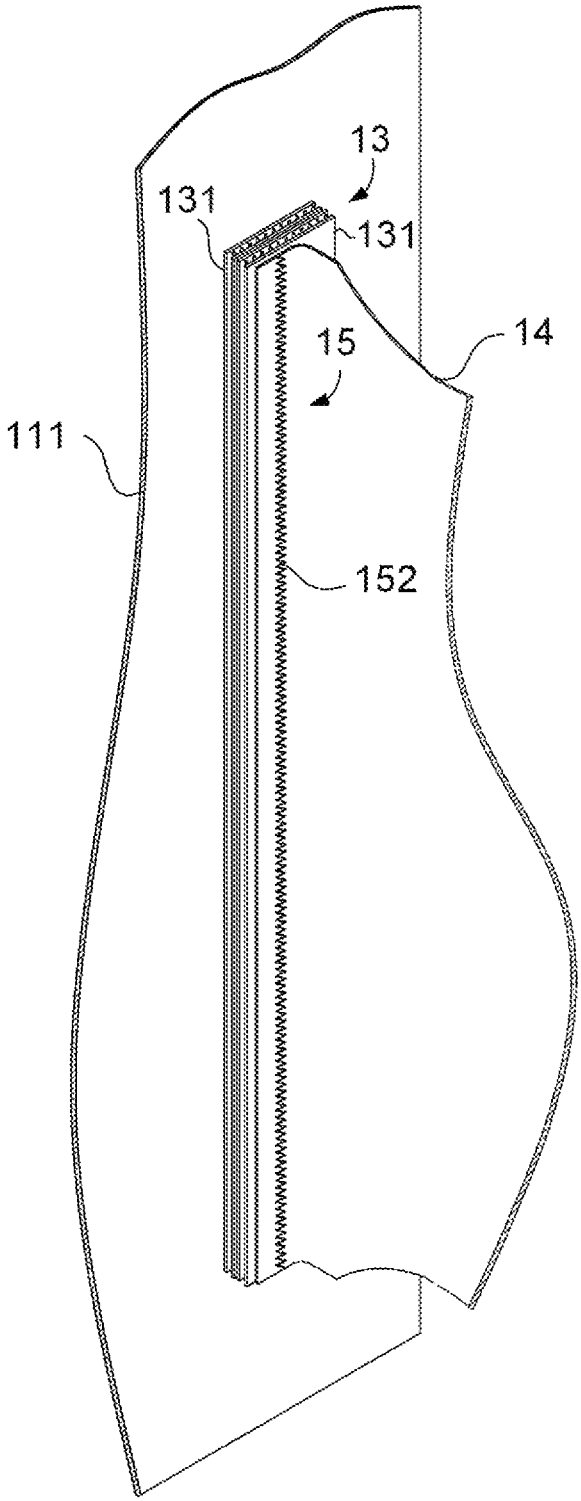
FIG. 10*a* to FIG. 10*c* respectively illustrate a connection manner of a connecting member and a tensioning member according to an example embodiment.

FIG. 10*a* illustrates an example embodiment in which the tensioning member 14 in FIG. 2 is connected to the inner wall of the inflatable chamber through the connecting member 13. In this example embodiment, the difference from the example embodiment shown in FIG. 8*a* and FIG. 8*b* lies in that the tensioning member 14 is fixed to the connecting member 13 by sewing through the sewing thread 152. The sewing thread 152 extends in a zig-zag form to form the stitches 15. The sewing thread 152 extending in the zig-zag form is interlaced and fixed with the strands in the connecting member 13.

Figure 10B:
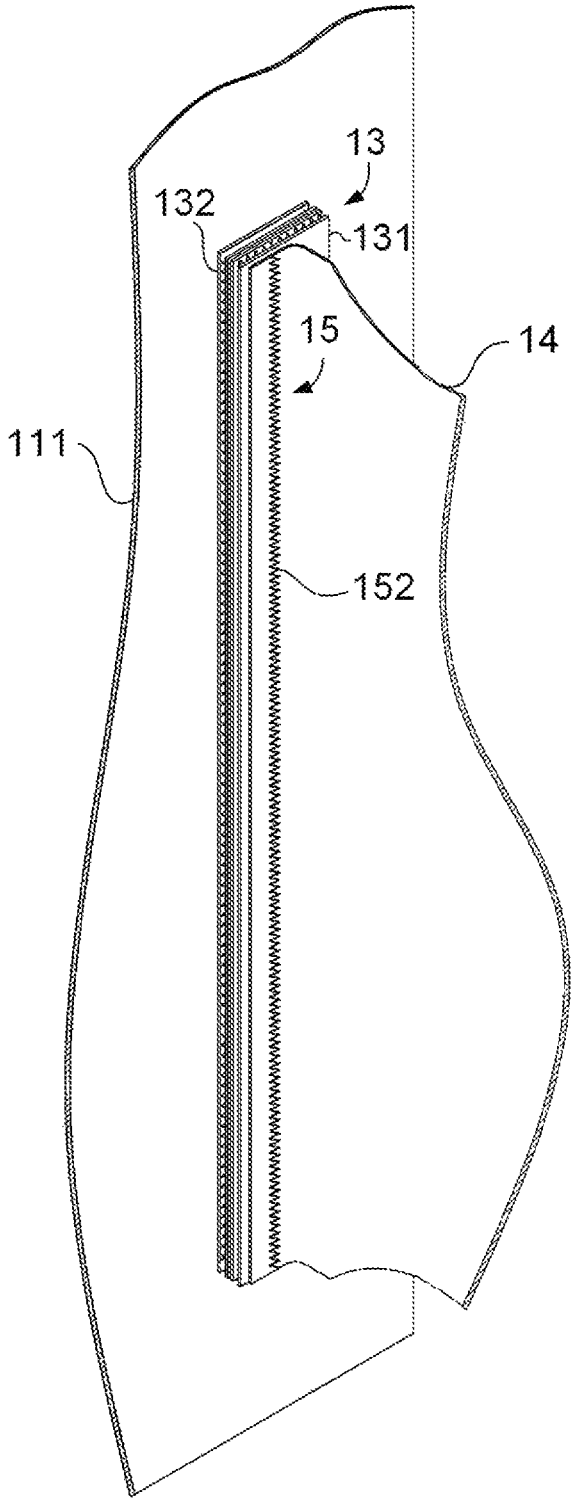

FIG. 10*b* illustrates an example embodiment in which the tensioning member 14 in FIG. 2 is connected to the inner wall of the inflatable chamber through the connecting member 13. In this example embodiment, the difference from the example embodiment shown in FIG. 8*e* lies in that the tensioning member 14 is fixed to the connecting member 13 by sewing through one or more sewing threads 152. The sewing thread 152 extends in a zig-zag form to form the stitches 15. The sewing thread 152 extending in the zig-zag form is interlaced and fixed with the strands in the connecting member 13.

Figure 10C:
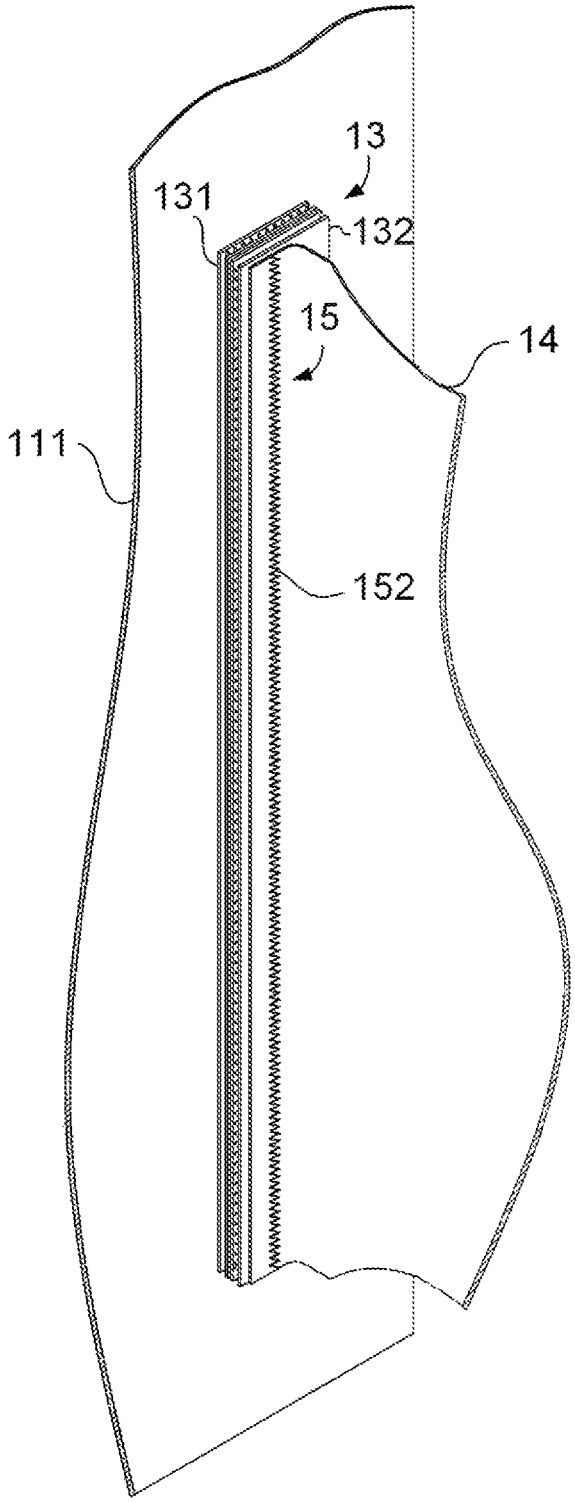

FIG. 10*c* illustrates an example embodiment in which the tensioning member 14 in FIG. 2 is connected to the inner wall of the inflatable chamber through the connecting member 13. In this example embodiment, the difference from the example embodiment shown in FIG. 8*f* lies in that the tensioning member 14 is fixed to the connecting member 13 by sewing through the sewing thread 152. The sewing thread 152 extends in a zig-zag form to form the stitches 15. The sewing thread 152 extending in the zig-zag form is interlaced and fixed with the strands in the connecting member 13.

Alternatively, in another example embodiment, the connecting strip 131 may be replaced by a connecting strip 132, and the tensioning member 14 may include two stacked connecting strips 132. The specific implementation of this example embodiment may be analogous to that of the above-described example embodiments.

Figure 11A:
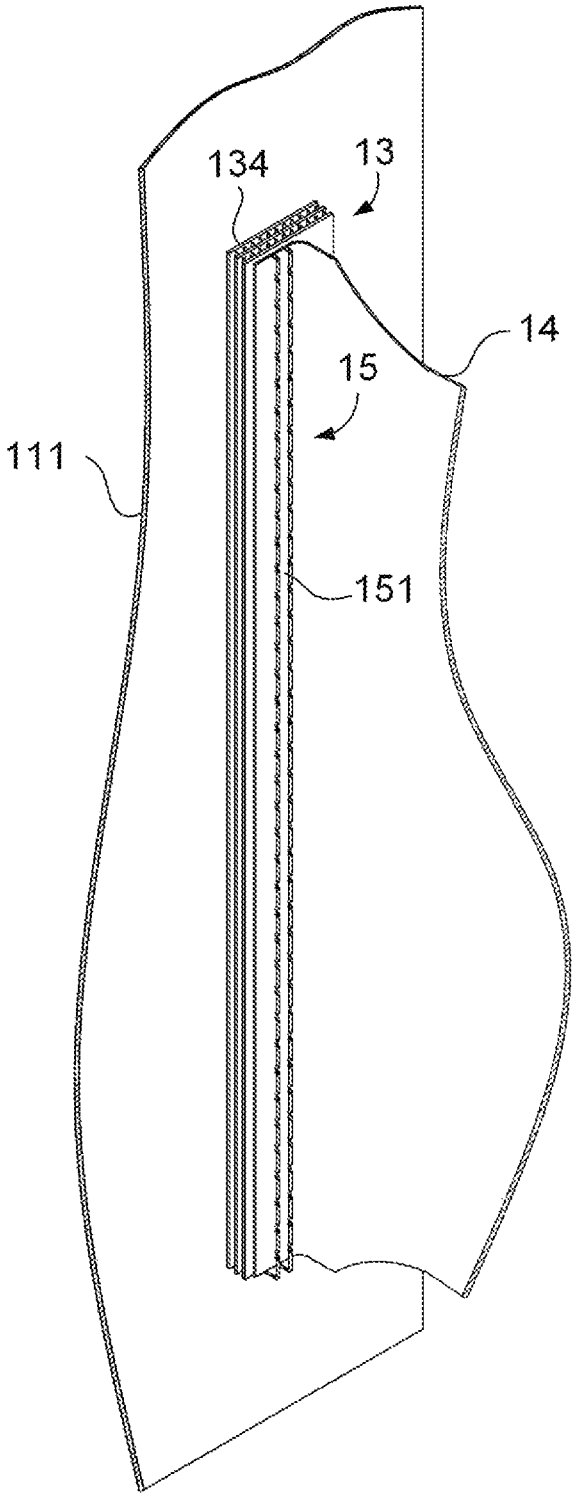
FIG. 11*a* to FIG. 11*d* each illustrate a connection manner of a connecting member and a tensioning member according to an example embodiment.

FIG. 11*a* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along the length of the connecting member 13. The difference from the example embodiment shown in FIG. 6*a* and FIG. 6*b* lies in that the connecting member 13 is the connecting strip 134 (refer to FIG. 4*a* and FIG. 4*b*).

Alternatively, according to one or more example embodiments, the sewing threads 151 forming the stitches 15 are replaced with a sewing thread 152 extending in a zig-zag form.

It can be understood that the stitches formed by the sewing threads on the surface of the tensioning member are not limited to two lines, and may be more or fewer lines.

Figure 11B:
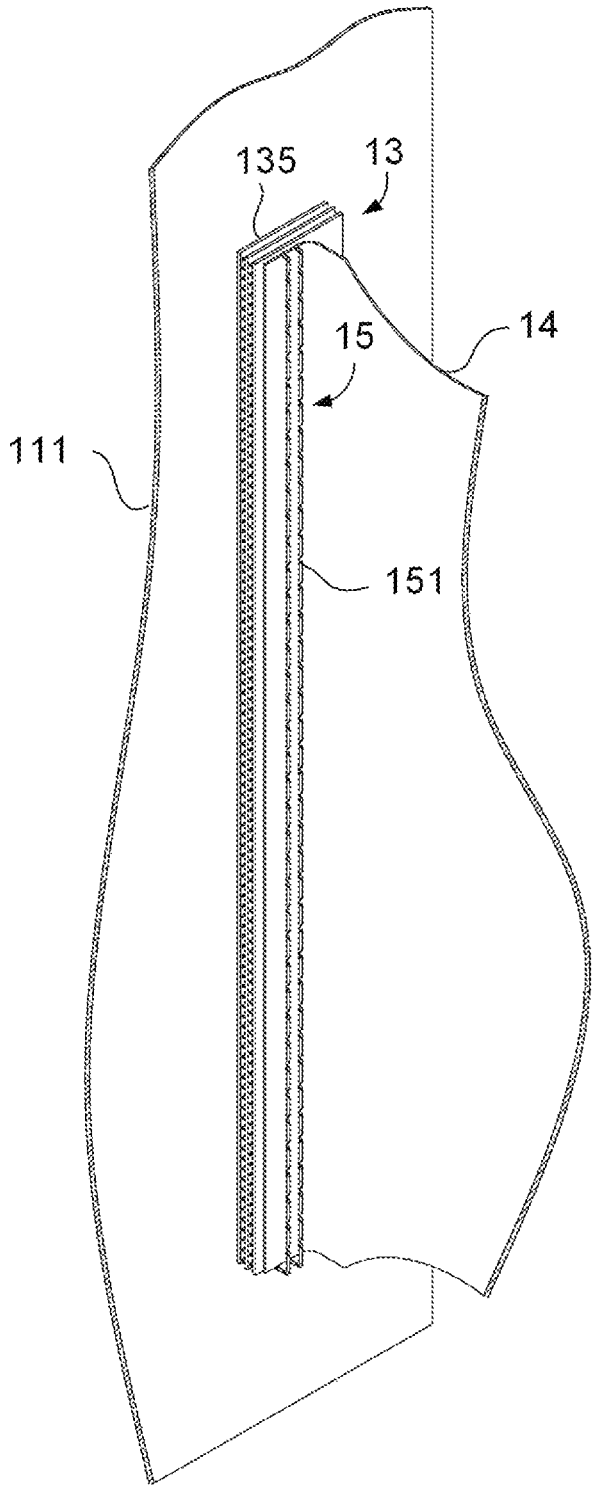

FIG. 11*b* illustrates an example embodiment in which the tensioning member 14 in FIG. 2 is connected to the inner wall of the inflatable chamber through the connecting member 13 according to an embodiment. In this example embodiment, the tensioning member 14 is fixed to the connecting member 13 by sewing through one or more sewing threads 151. Two lines of stitches 15 are formed by the sewing threads 151, and the stitches 15 extend along or substantially along the length of the connecting member 13. The difference from the example embodiment shown in FIG. 11*a* lies in that the connecting member 13 is the connecting strip 135 (refer to FIG. 4*c* and FIG. 4*d*).

Alternatively, according to one or more example embodiments, the sewing threads 151 forming the stitches 15 may be replaced with a sewing thread 152 extending in a zig-zag form.

It can be understood that the stitches formed by the sewing threads on the surface of the tensioning member are not limited to two lines, and may be more or fewer lines.

Figure 11C:
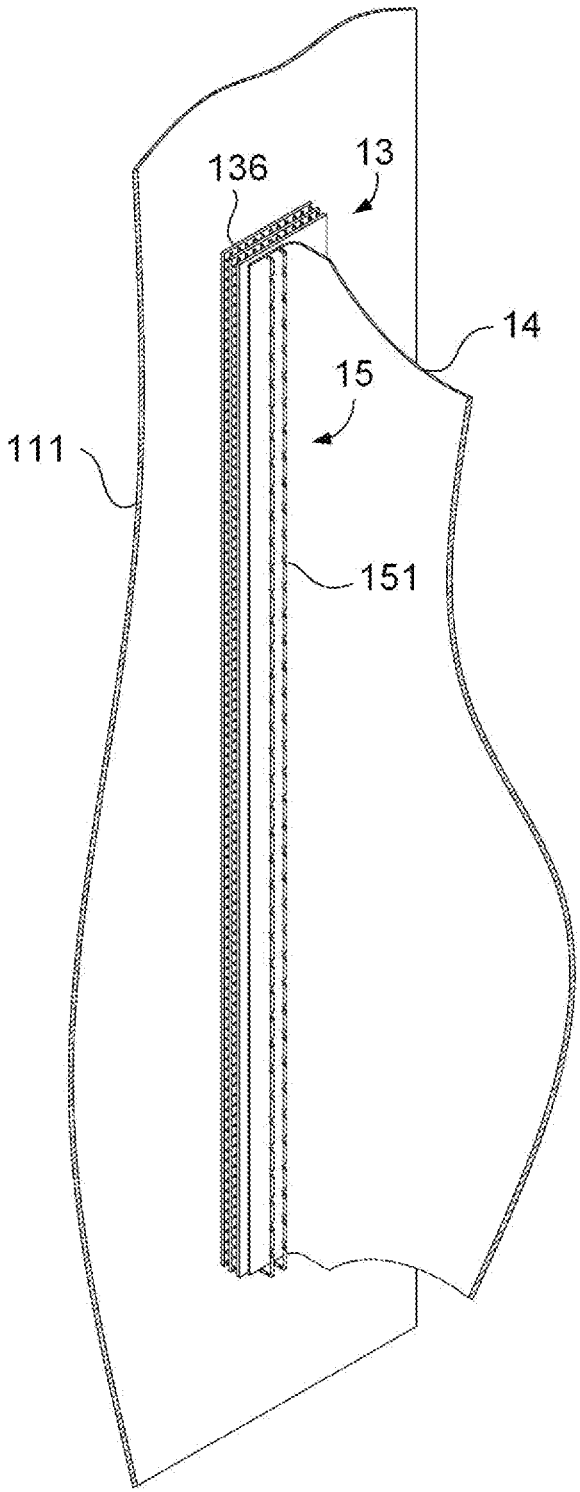

FIG. 11*c* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along the length of the connecting member 13. The difference from the example embodiment shown in FIG. 11*a* lies in that the connecting member 13 is the connecting strip 136 (see e.g., FIG. 4*e* and FIG. 4*f*).

Alternatively, one or two fiber layers in the connecting strip 136 may be replaced with the plurality of strands 13441 in the first fiber layer 1344 as shown in FIG. 4*a* and FIG. 4*b*, or replaced with the plurality of strands 13542 in the first fiber layer 1354 as shown in FIG. 4*c* or FIG. 4*d*.

Alternatively, the first mesh structure of the first fiber layer 1364 may be replaced with the mesh structure of the fiber layer 1333 shown in FIG. 3*d* or FIG. 3*e*. In some other example embodiments, the first mesh structure of the first fiber layer 1364 may be replaced with the plurality of strands 13441 in the first fiber layer 1344 as shown in FIG. 4*a* or FIG. 4*b*, or replaced with the plurality of strands 13542 in the first fiber layer 1354 as shown in FIG. 4*c* or FIG. 4*d*. Alternatively, the second mesh structure of the second fiber layer 1365 may be replaced with the mesh structure of the fiber layer 1333 shown in FIG. 3*d* or FIG. 3*e*.

Alternatively, in some example embodiments, the sewing threads 151 forming the stitches 15 may be replaced with a sewing thread 152 extending in a zig-zag form.

It can be understood that the stitches formed by the sewing threads on the surface of the tensioning member are not limited to two, and may be more or fewer lines.

Figure 11D:
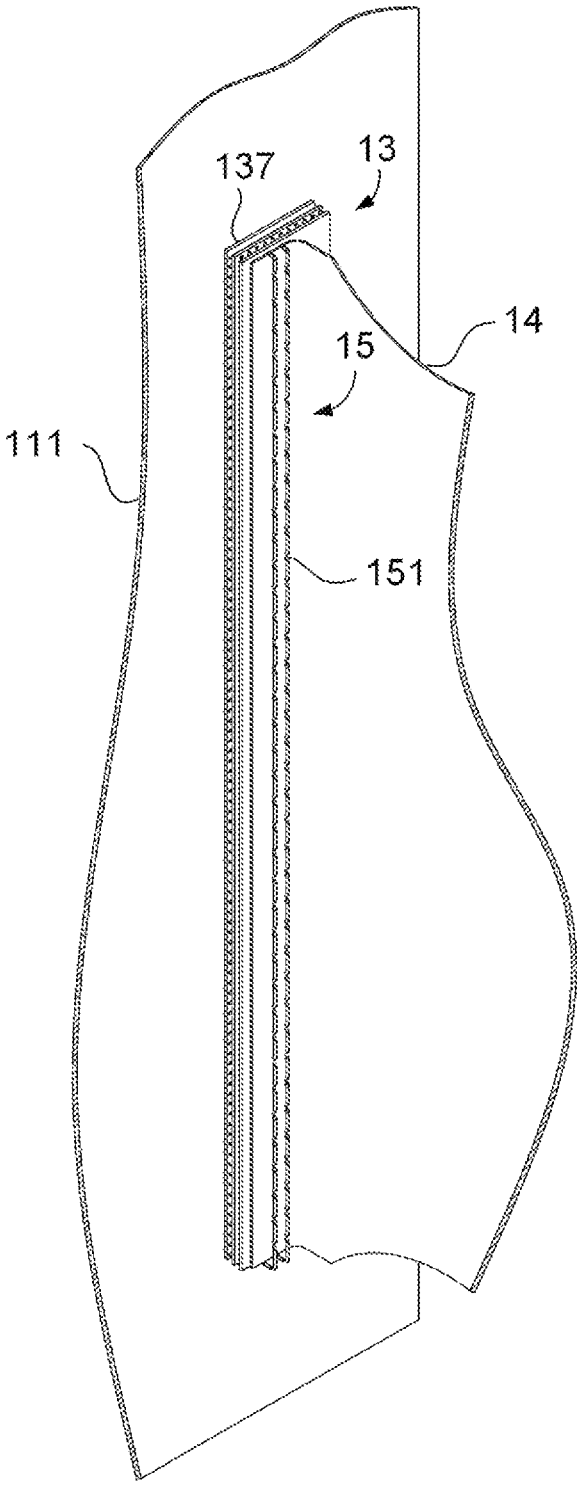

FIG. 11*d* illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through one or more sewing threads 151. Two lines of stitches 15 are formed by the sewing threads 151, and the stitches 15 extend along or substantially along the length of the connecting member 13. The difference from the example embodiment shown in FIG. 11*a* lies in that the connecting member 13 comprises the connecting strip 137.

Alternatively, in some example embodiments, the sewing threads 151 forming the stitches 15 may be replaced with a sewing thread 152 extending in a zig-zag form.

It can be understood that the stitches formed by the sewing threads on the surface of the tensioning member are not limited to two lines, and may be more or fewer lines.

Figure 12:
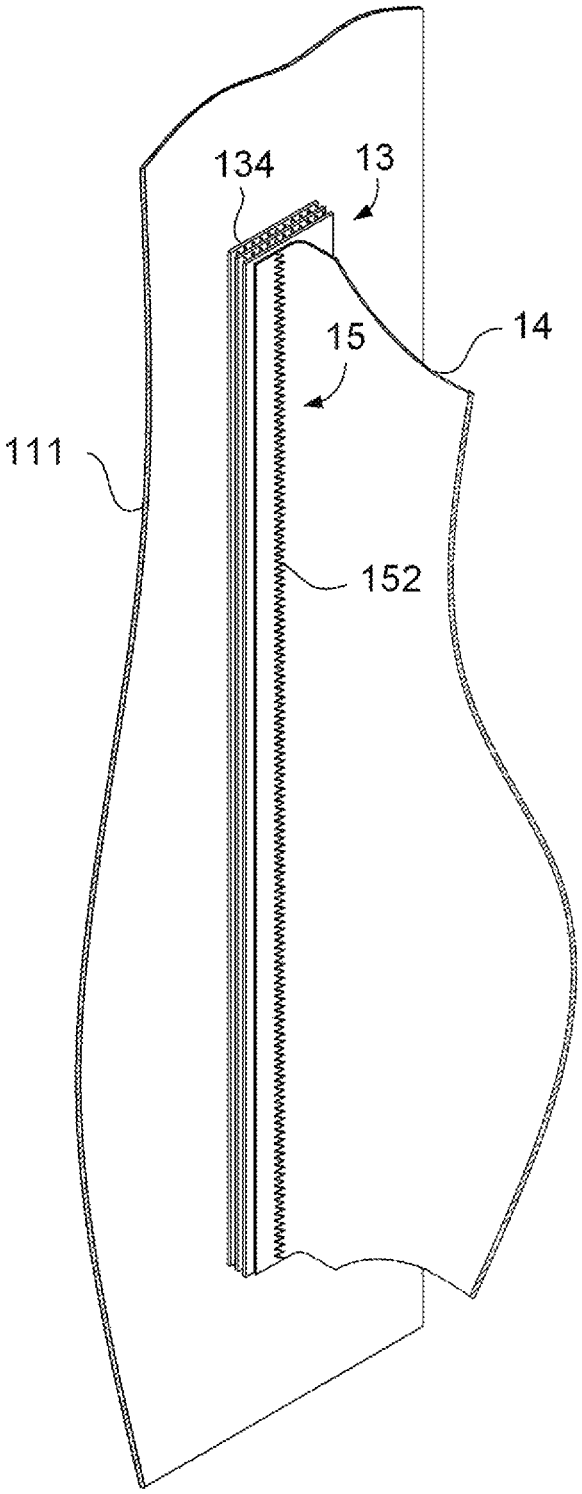
FIG. 12 illustrates a connection manner of a connecting member and a tensioning member according to an example embodiment.

FIG. 12 illustrates an example embodiment in which the tensioning member 14 in FIG. 2 is connected to the inner wall of the inflatable chamber through the connecting member 13. In this example embodiment, the tensioning member 14 is fixed to the connecting member 13 by sewing through the sewing thread 152. The sewing thread 152 extends in a zig-zag form to form the stitches 15. The difference from the example embodiment shown in FIG. 10*a* lies in that the connecting member 13 comprises the connecting strip 134.

Alternatively, in some example embodiments, the connecting strip 134 may be replaced by the connecting strip 135 shown in FIG. 4*c* and FIG. 4*d*, or by the connecting strip 136 shown in FIG. 4*e* and FIG. 4*f*, or by the connecting strip 137 shown in FIG. 4*g* and FIG. 4*h*. The specific structures of the connecting strip 135, the connecting strip 136 and the connecting strip 137 may be referred to as described in the "connecting member" section.

As an alternative example embodiment, a coating layer of the connecting strip may be omitted, and a fiber layer of the connecting strip may be adjacent to the inner wall 111. An interlayer of the connecting strip may be connected to the inner wall 111 by gluing, hot pressing, welding (e.g., thermal welding or high-frequency welding) or another manner.

It can be understood that the above-mentioned connecting strips can be combined with one another to form the connecting member 13. Without limitation, for example, the connecting strip 131 shown in FIG. 3*a*, the connecting strip 132 shown in FIG. 3*b*, and the connecting strip 133 shown in FIG. 3*c* to FIG. 3*e* can be respectively attached to the connecting strip 131' shown in FIG. 3*f*, or the connecting strips 132' shown in FIG. 3*g* to form the connecting member 13.

Figure 13A:
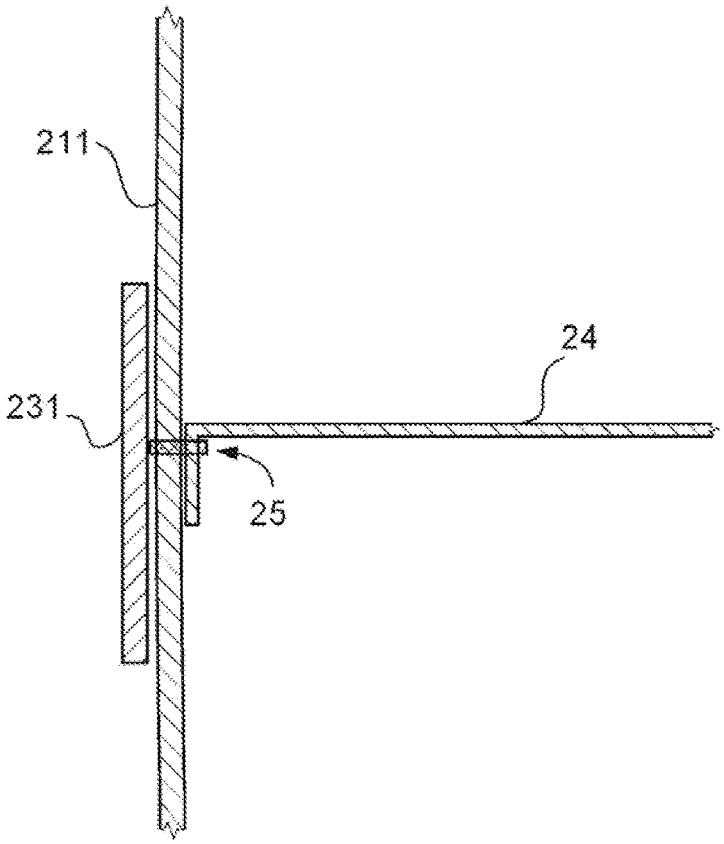
FIG. 13*a* to FIG. 13*e* each illustrate a connection manner of a connecting member and a tensioning member according to an example embodiment.

FIG. 13*a* illustrates an example embodiment in which a tensioning member is directly connected to an inner wall of an inflatable chamber. The following description will be given by taking the installation of the tensioning members on the inner wall 211 of the pool wall of the inflatable pool as an example. However, the tensioning member is fit for any wall of the inflatable product. In some example embodiments, the connecting members connecting the tensioning members to different walls of the inflatable product may have the same or substantially the same structure. In other example embodiments, the connecting members connecting the tensioning members to different walls of the inflatable product may have different structures.

Specifically, referring to FIG. 13*a*, a tensioning member 24 may be fixed to the inner surface of the inner wall 211 of the pool wall by sewing through one or more sewing threads. The one or more sewing threads form stitches 25. The tensioning member 24 comprises a woven fabric. For example, the tensioning member 24 may comprise, but is not limited to, the woven fabric shown in any one of FIG. 5*a* to FIG. 5*e*.

Since the outer wall of the inflatable chamber may be sewn, air leakage may occur, and a sealing member 231 may additionally be attached to the other side of the wall of the inflatable product opposite to the tensioning member, for example, to the other side of the inner wall 211. In some example embodiments, the sealing member 231 may be made substantially of a homogenous material (e.g., polyvinyl chloride, i.e., PVC, or silicone). In some other example embodiments, the sealing member 231 may be composed of at least two materials, for example, the sealing member 231 may have the same or substantially the same structure as the connecting strip shown in any one of FIG. 3*a* to FIG. 3*g*, or the sealing member 231 may have the same or substantially the same structure as the connecting strip shown in any one of FIG. 4*a* to FIG. 4*h*.

The sealing member 231 covers the stitches 25 to seal the inflatable chamber of the inflatable product. Such a structure for installing the tensioning member 24 within the inflatable product may reduce the manufacturing costs of the inflatable product and may have sufficient strength.

FIG. 13*a* illustrates an example embodiment in which a tensioning member is connected to an inner wall of an inflatable chamber through a connecting sheet. The tensioning member is fixed to the wall of the inflatable product through the connecting sheet. The following description will be given by taking the installation of the tensioning members on the inner wall 211 of the pool wall of the inflatable pool as an example. However, the tensioning member is adaptable to any wall of the inflatable product. In some example embodiments, the connecting members used to connect the tensioning members to different walls of the inflatable product may have the same or substantially the same structure. In other example embodiments, the connecting members used to connect the tensioning members to different walls of the inflatable product may have different structures.

Figure 13B:
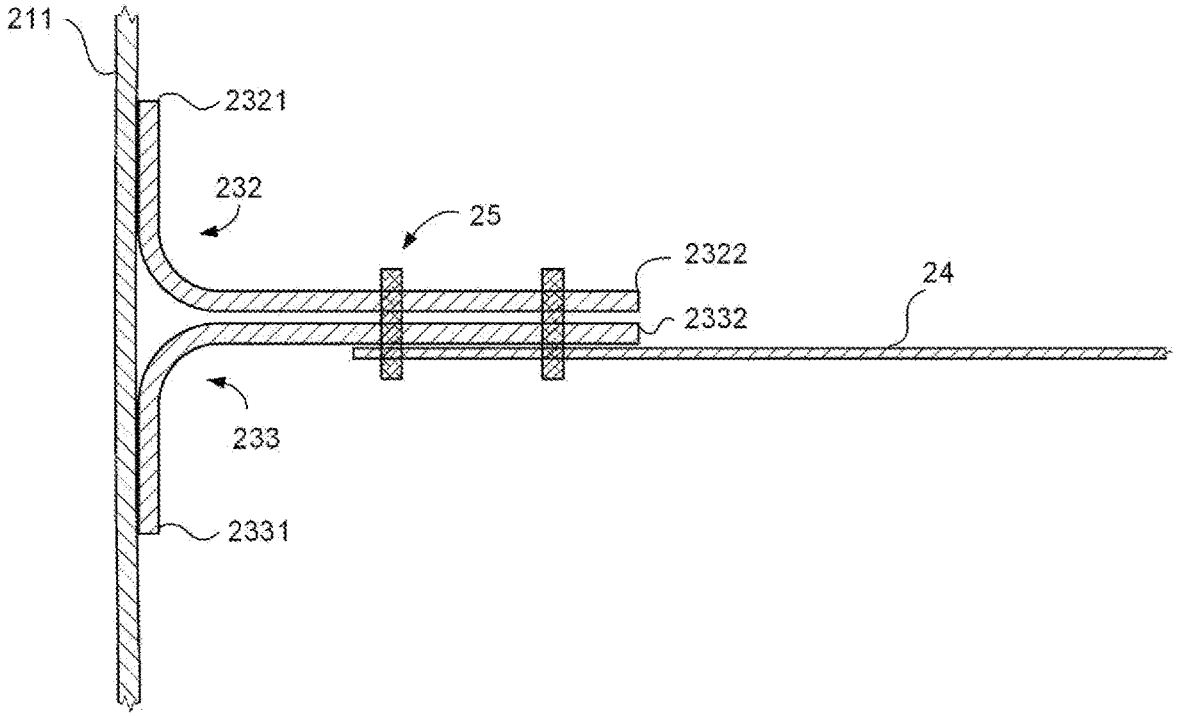

FIG. 13*b* illustrates an example embodiment in which a tensioning member 24 is connected to an inner wall of an inflatable chamber by a connection manner. The tensioning member 24 is fixed to a first connecting sheet 232 and a second connecting sheet 233 by sewing through one or more sewing threads. The one or more sewing threads form stitches 25. The tensioning member 24 comprises a woven fabric. For example, the tensioning member 24 may comprise, but is not limited to, the woven fabric shown in any one of FIG. 5*a* to FIG. 5*e*.

The first connecting sheet 232 has a first end 2321 and a second end 2322. The first end 2321 is fixed to the inner wall 211. The second connecting sheet 233 has a first end 2331 and a second end 2332. The first end 2331 is fixed to the inner wall 211. The first end 2322 of the first connecting sheet 232 is attached to the second end 2332 of the second connecting sheet 233, and the second end 2332 of the second connecting sheet 233 is attached to the tensioning member 24. Alternatively, in some example embodiments, the tensioning member 24 may be arranged between the first end 2322 of the first connecting sheet 232 and the second end 2332 of the second connecting sheet 233, and may be attached to the first connecting sheet 232 and the second connecting sheet 233.

The first connecting sheet 232 may be substantially entirely made of a homogenous material (e.g., polyvinyl chloride, i.e., PVC, or silicone), and the second connecting sheet 233 may be substantially made of a homogenous material (e.g., polyvinyl chloride, i.e., PVC, or silicone). In some other example embodiments, the first connecting sheet 232 and the second connecting sheet 233 may each be composed of at least two materials, for example, the first connecting sheet 232 and the second connecting sheet 233 may have the same or substantially the same structure as that of the connecting strip shown in any one of FIG. 3*a* to FIG. 3*g*, or the first connecting sheet 232 and the second connecting sheet 233 may have the same or substantially the same structure as that of the connecting strip shown in any one of FIG. 4*a* to FIG. 4*h*.

Figure 13C:
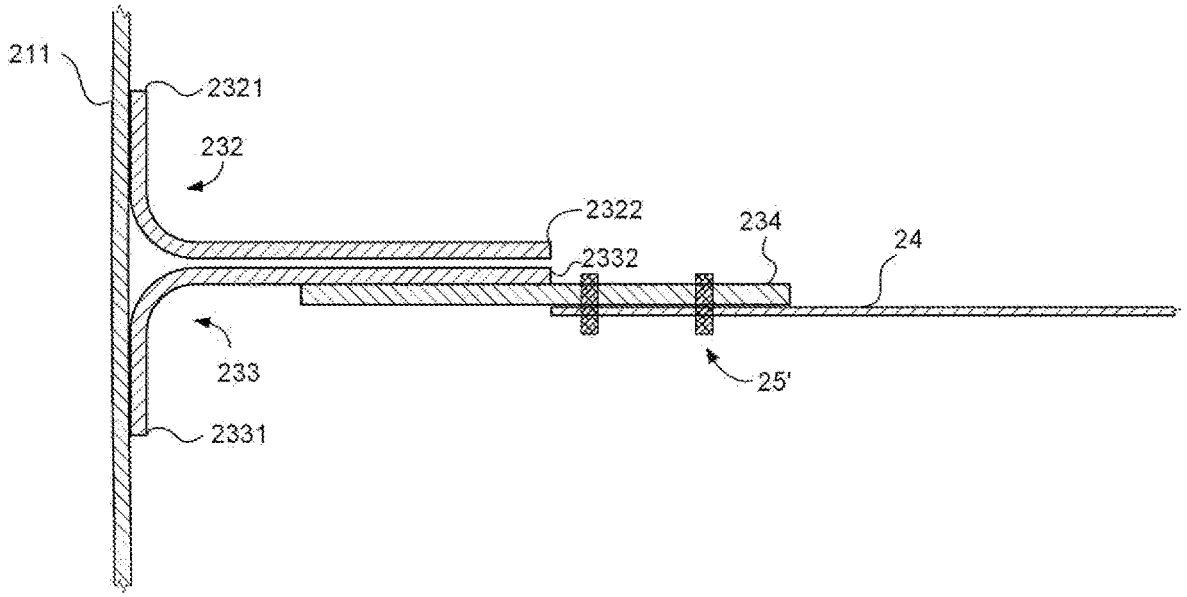

Referring to FIG. 13*c*, in some example embodiments, the tensioning member 24 may not directly connected to the first connecting sheet 232 or the second connecting sheet 233, but may be indirectly connected to the first connecting sheet 232 or the second connecting sheet 233. The tensioning member 24 is fixed to a third connecting sheet 234 by sewing through one or more sewing threads. The one or more sewing threads form stitches 25'. The third connecting sheet 234 is substantially all made of the same material (e.g., polyvinyl chloride, i.e., PVC, or silicone), or the third connecting sheet 234 is composed of at least two materials. For example, the third connecting sheet 234 has the same or substantially the same structure as that of the connecting strip shown in any one of FIG. 3*a* to FIG. 3*g*, or the third connecting sheet 234 has the same or substantially the same structure as that of the connecting strip shown in any one of FIG. 4*a* to FIG. 4*h*. The third connecting sheet 234 is connected to the second end 2322 of the first connecting sheet 232 or the second end 2332 of the second connecting sheet 233 by gluing, hot pressing, welding (e.g., thermal welding or high-frequency welding) or another manner. Optionally, the third connecting sheet 234 may be fully or partially sandwiched between the first connecting sheet 232 and the second connecting sheet 233.

Optionally, one of the first connecting sheet 232 and the second connecting sheet 233 may be omitted in some example embodiments.

Alternatively, the stitches 25' may be provided at a connection position of the third connecting sheet 234 and the first connecting sheet 232 and/or the second connecting sheet 233. The sewing threads thread the tensioning member 24 and the third connecting sheet 234 and also thread the first connecting sheet 232 and/or the second connecting sheet 233.

Figure 13D:
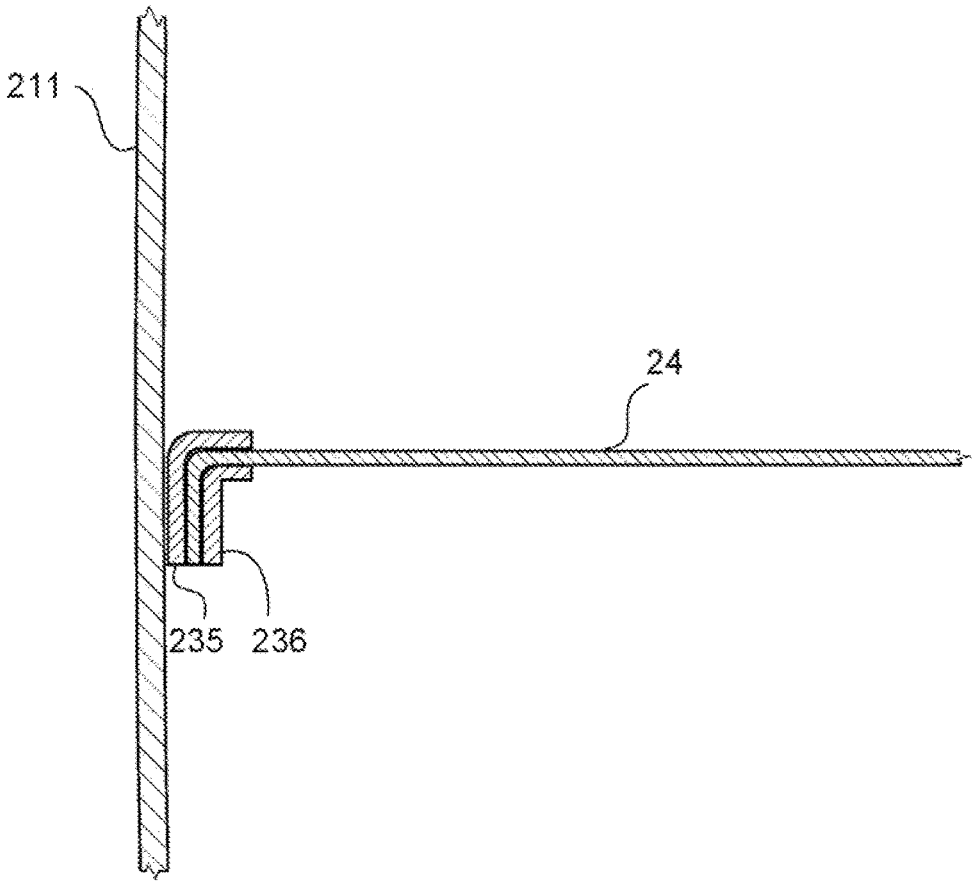

FIG. 13*d* illustrates an example embodiment in which a tensioning member is connected to an inner wall of an inflatable chamber through clamping sheets. The following description will be given by taking the installation of the tensioning members on the inner wall 211 of the pool wall of the inflatable pool as an example. However, the tensioning member is adaptable to any wall of the inflatable product. In some example embodiments, the connecting members used to connect the tensioning members to different walls of the inflatable product may have the same or substantially the same structure. In other example embodiments, the connecting members used to connect the tensioning members to different walls of the inflatable product may have different structures.

Specifically, the tensioning member 24 is sandwiched between a first clamping sheet 235 and a second clamping sheet 236. The tensioning member 24 comprises a woven fabric. For example, the tensioning member 24 may comprise, but is not limited to, the woven fabric shown in any one of FIG. 5*a* to FIG. 5*e*. The tensioning member 24 is connected to the first clamping sheet 235 and the second clamping sheet 236 by gluing, respectively. Alternatively, the first clamping sheet 235 and the second clamping sheet 236 are joined by welding (e.g., thermal welding or high-frequency welding). During welding, molten material traverses holes in the tensioning member 24 to connect the first clamping sheet 235 and the second clamping sheet 236, so that the first clamping sheet 235, the tensioning member 24 and the second clamping sheet 236 are connected together.

The first clamping sheet 235 and the second clamping sheet 236 each are made of a substantially homogenous material (e.g., polyvinyl chloride, i.e., PVC, or silicone). In other example embodiments, the first clamping sheet 235 and the second clamping sheet 236 are composed of at least two materials, for example, the first clamping sheet 235 and the second clamping sheet 236 may have the same or substantially the same structure as that of the connecting strip shown in any one of FIG. 3*a* to FIG. 3*g*, or the first clamping sheet 235 and the second clamping sheet 236 respectively may have the same or substantially the same structure as that of the connecting strip shown in any one of FIG. 4*a* to FIG. 4*h*.

Figure 13E:
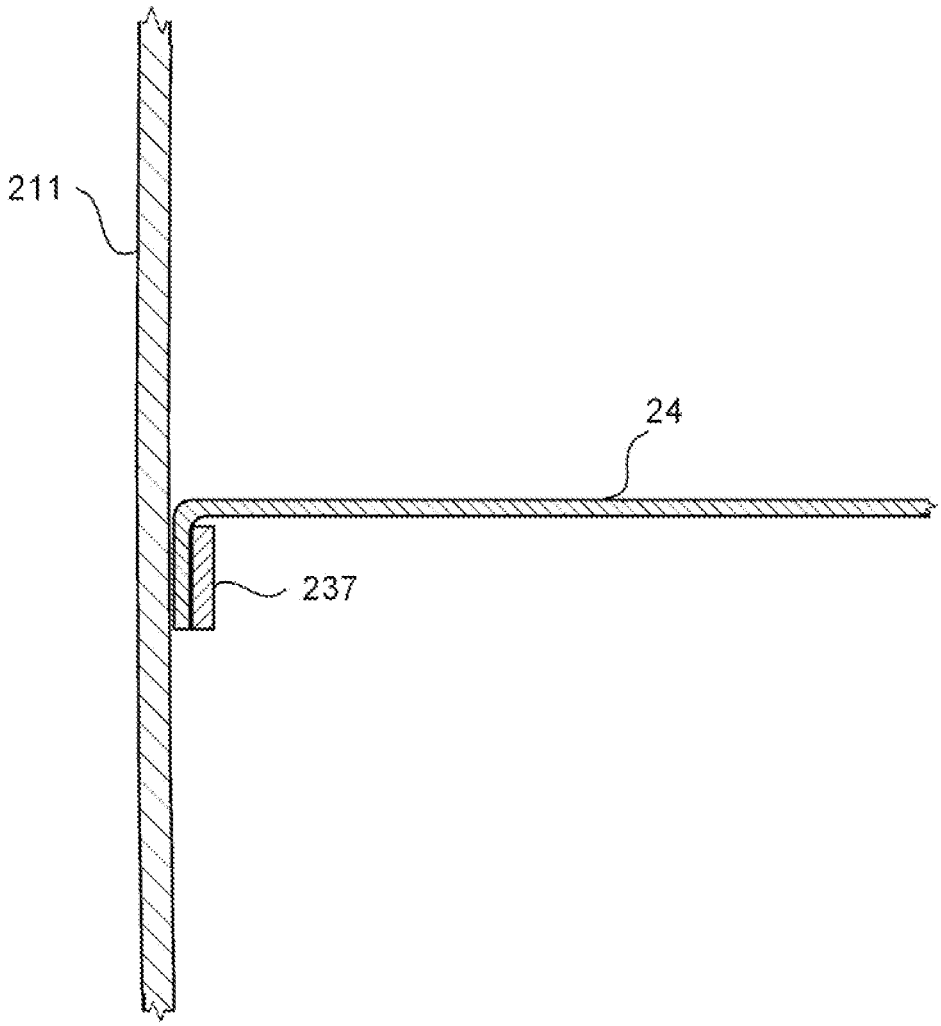

FIG. 13*e* illustrates an example embodiment in which a tensioning member is connected to an inner wall of an inflatable chamber through clamping sheets. The following description will be given by taking the installation of the tensioning members on the inner wall 211 of the pool wall of the inflatable pool as an example. However, the tensioning member is adaptable to any wall of the inflatable product. In some example embodiments, the connecting members used to connect the tensioning members to different walls of the inflatable product may have the same or substantially the same structure. In other example embodiments, the connecting members used to connect the tensioning members to different walls of the inflatable product may have different structures.

Specifically, the tensioning member 24 is sandwiched between a clamping sheet 237 and the inner wall 211. The tensioning member 24 comprises a woven fabric. For example, the tensioning member 24 may comprise, but is not limited to, the woven fabric shown in any one of FIG. 5*a* to FIG. 5*e*. The clamping sheet 237 is joined by welding (e.g., thermal welding or high-frequency welding). During welding, molten material traverses holes in the tensioning member 24, so that the clamping sheet 237, the tensioning member 24 and the inner wall 211 are connected together.

The clamping sheet 237 is substantially made of a homogenous material (e.g., polyvinyl chloride, i.e., PVC, or silicone). In some other example embodiments, the clamping sheet 237 may be composed of at least two materials, for example, the clamping sheet 237 has the same or substantially the same structure as the connecting strip shown in any one of FIG. 3*a* to FIG. 3*g*, or the clamping sheet 237 has the same or substantially the same structure as that of the connecting strip shown in any one of FIG. 4*a* to FIG. 4*h*.

Figure 13F:
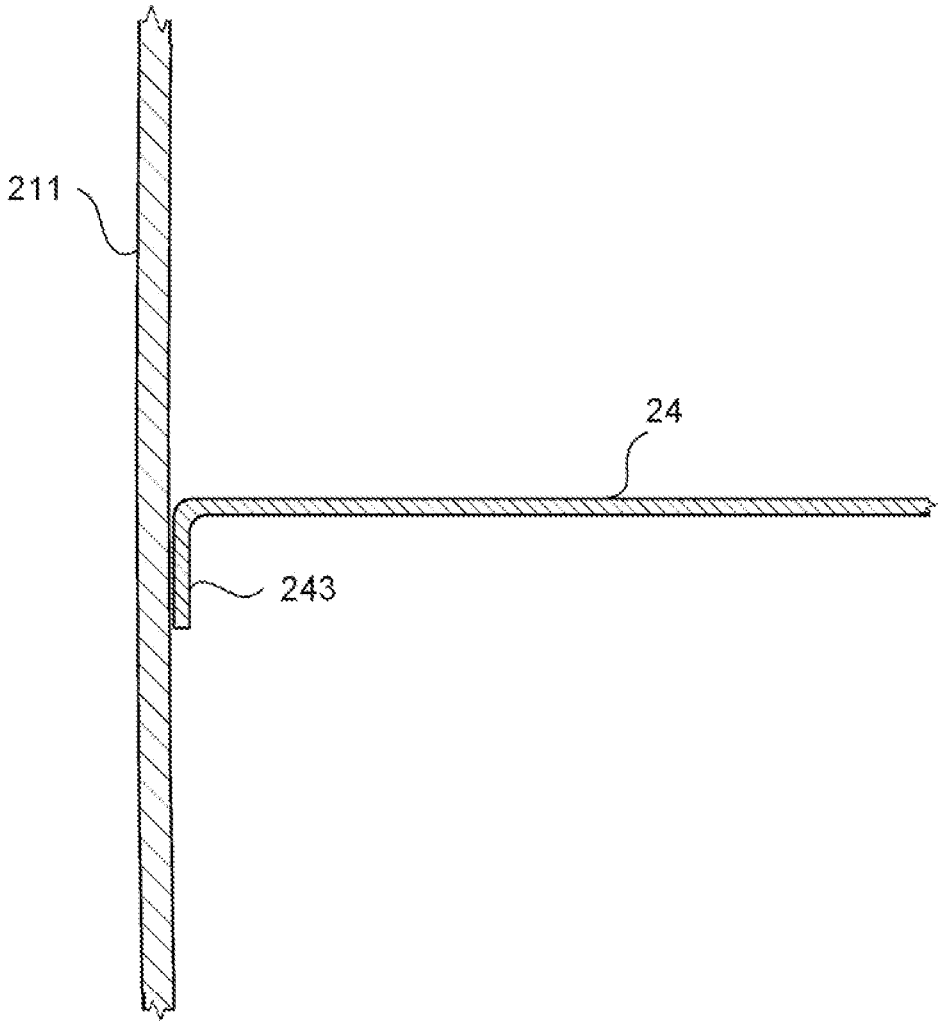
FIG. 13*f* to FIG. 13*h* illustrate a connection manner of a connecting member and a tensioning member according to an example embodiment.

FIG. 13*f* illustrates an example embodiment in which a tensioning member is directly fixed to a wall of an inflatable chamber. The following description will be given by taking the installation of the tensioning members on the inner wall 211 of the pool wall of the inflatable pool as an example. However, the tensioning member is adaptable to any wall of the inflatable product.

Figure 13G:
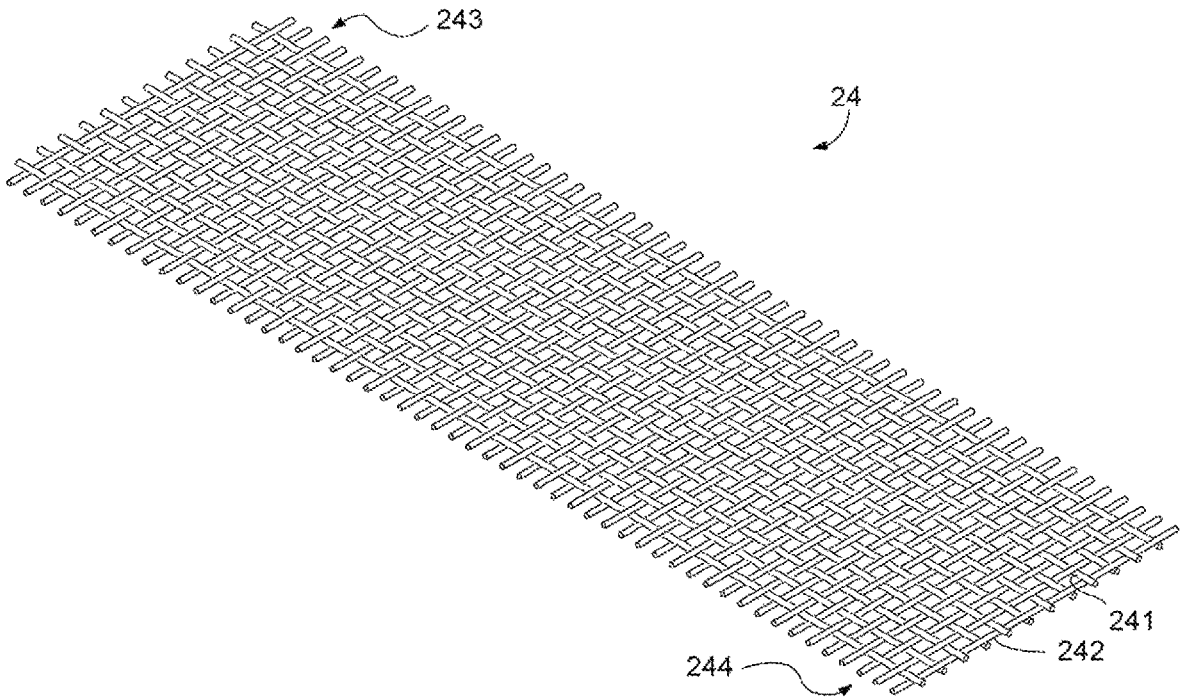

Specifically, a first end 243 of the tensioning member 24 is welded to one wall of the inflatable product (e.g., the inner wall 211 of the pool wall of the inflatable pool), while a second end 244 of the tensioning member 24 is welded to another wall of the inflatable product (e.g., the outer wall of the pool wall of the inflatable pool). For example, referring to FIG. 13*g*, the tensioning member 24 comprises a plurality of strands 241 and a plurality of strands 242, and the strands 241 and the strands 242 are interwoven with each other to form a mesh structure. In different example embodiments, the mesh structure of the tensioning member 24 may have different structures. According to one or more example embodiments, the tensioning member 24 may have a mesh structure as shown in any of FIG. 5*a* to FIG. 5*e*.

Figure 13H:
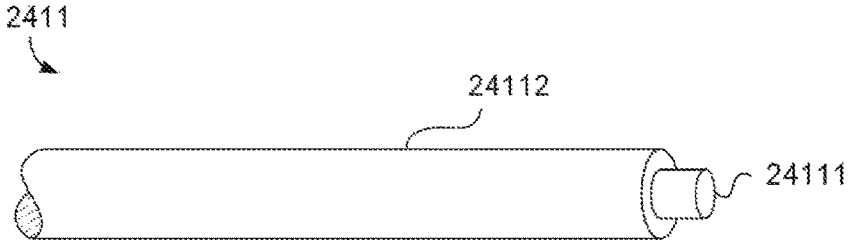

The strands 241 are substantially made of a homogenous material (e.g., polyvinyl chloride, i.e., PVC, or silicone), and the strands 242 are substantially made of a homogenous material (e.g., polyvinyl chloride, i.e., PVC, or silicone). In some other example embodiments, the strands 241 and the strands 242 are respectively made of a strand material 2411. Referring to FIG. 13*h*, the strand material 2411 may comprise a thread core 24111 and an outer layer 24112. The thread core is made of one or more types of fibers such as natural fibers or chemical fibers. For example, the one or more types of fibers may be selected from the following materials, but are not limited to: cotton fibers, linen fibers, silk fibers, nylon fibers, polyacrylonitrile fibers (PAN fibers), and Ultra High Molecular Weight Polyethylene Fiber (UHMWPEF).

It should be understood that there are many kinds of natural fibers or chemical fibers, and for the sake of brevity, they are not listed here, but only some common examples are provided, and these examples do not constitute a limitation on the example embodiments described herein.

The outer layer 24112 is made of a weldable material so that the strand material 2411 is weldable to the wall of the inflatable product. The outer layer 24112 is made of, for example, but not limited to, polyvinyl chloride (i.e., PVC) or silicone.

According to one or more example embodiments described herein degradable materials (such as fabrics) with high tensile strength may be used to a higher ratio, and these materials may be firmly connected to the inner wall of the inflatable chamber through the connecting members or other manners, which may reduce the costs and may reduce the proportion of non-degradable materials in the inflatable product.

Figure 14A:
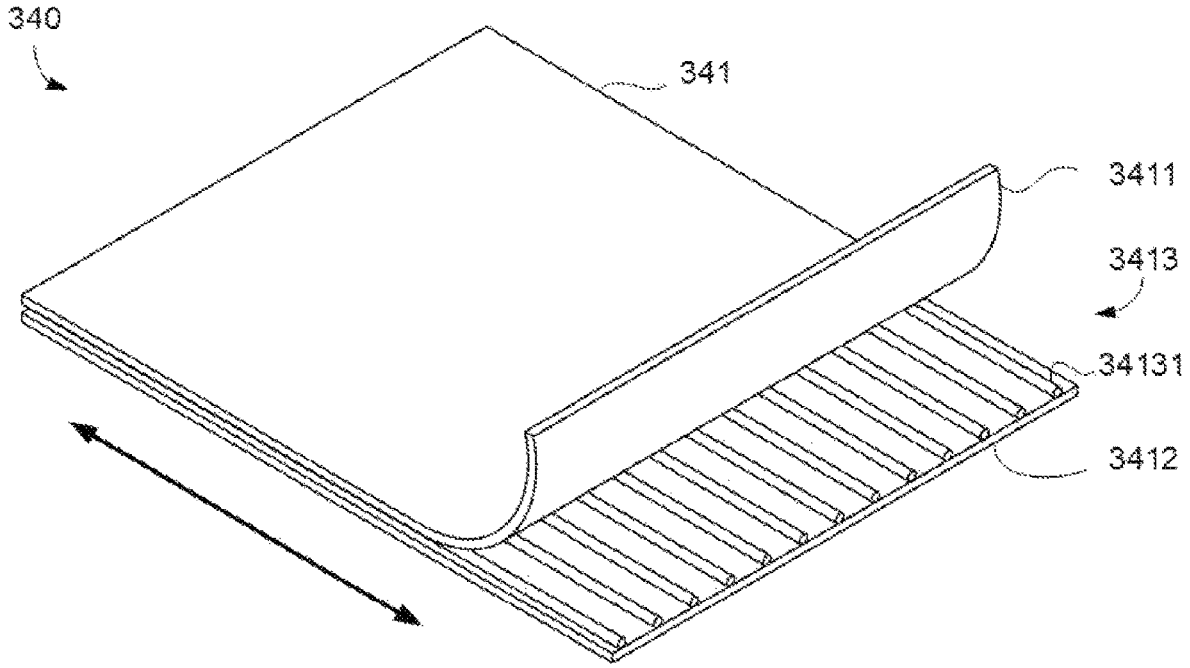
FIG. 14*a* and FIG. 14*b* each illustrate composition of a material for manufacturing a tensioning member according to an example embodiment.
Figure 14B:
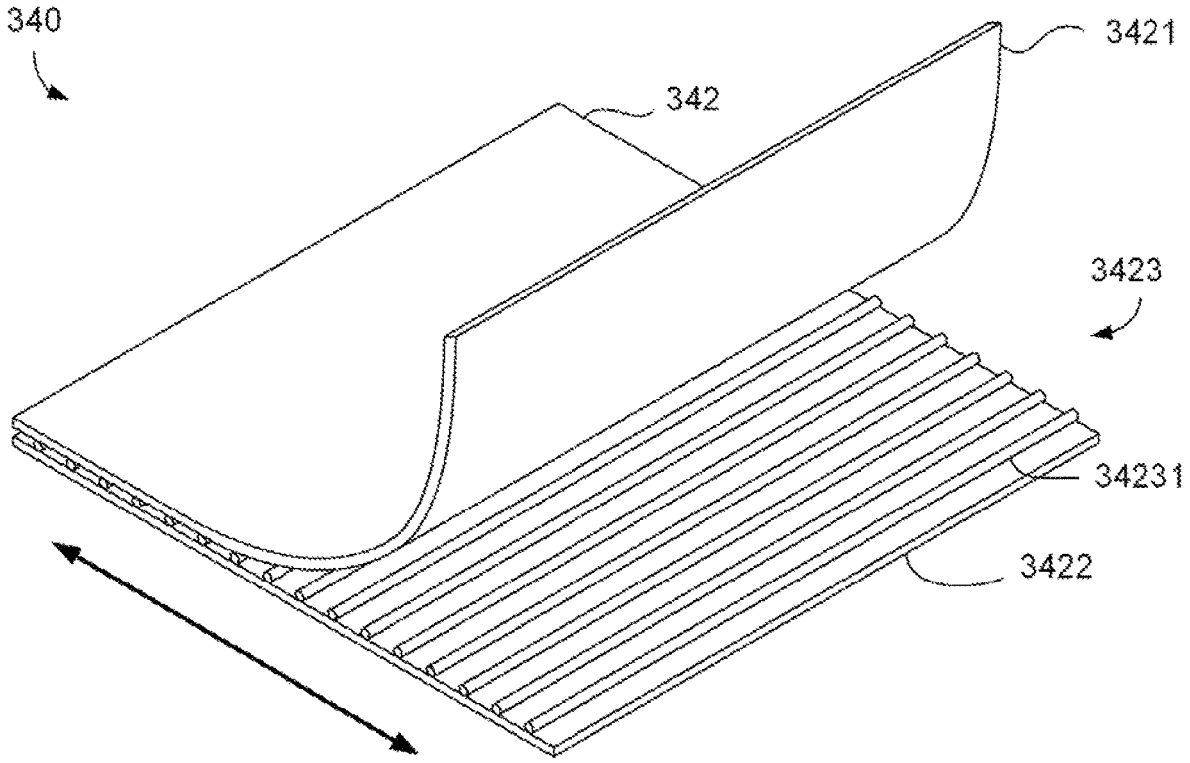

FIG. 14*a* and FIG. 14*b* illustrate an example embodiment of a laminated material for manufacturing a tensioning member of an inflatable product. The tensioning member is directly connected to at least one wall of the inflatable product. The laminated material is composed of at least two materials. For example, the laminated material is composed of at least one fiber layer and at least one covering layer. The covering layer covers a surface of one side of the fiber layer by gluing, welding, hot pressing, or another manner. The fiber layer includes a plurality of strands or fibers, a two-dimensional woven fabric, or a three-dimensional woven fabric.

The strands or fibers, two-dimensional woven fabric, or three-dimensional woven fabric in the fiber layer is made of one or more types of fibers (such as natural fibers or chemical fibers). For example, the one or more types of fibers are selected from the following materials, but are not limited to: cotton fibers, linen fibers, silk fibers, nylon fibers, polyacrylonitrile fibers (PAN fibers), and Ultra High Molecular Weight Polyethylene Fiber (UHMWPEF).

It should be understood that there are many kinds of natural fibers or chemical fibers, and for the sake of brevity, they are not listed here, but only some common examples are provided, and these examples do not constitute a limitation on example embodiments described herein.

For example, a laminated material 340 includes two covering layers and a fiber layer, and the fiber layer is sandwiched between the two covering layers. Specifically, referring to FIG. 14*a* and FIG. 14*c*, the laminated material 341 comprises a first covering layer 3411, a second covering layer 3412 and a fiber layer 3413. The fiber layer 3413 comprises a plurality of strands 34131. A direction of a tensile force applied to the laminated material 340 in the tensioning member 34 is indicated by the arrows. The directions of the strands 34131 are parallel or substantially parallel to the direction of the tensile force, and an elongation of the strands 34131 is smaller than that of the first covering layer 3411 and an elongation of the second covering layer 3412, so that the strands 34131 may limit the amount of deformation of the tensioning member in the direction of the tensile force to which when the tensioning member 34 is pulled, so as to maintain the reliability of the inflatable product. A first end of a tensioning member 34 is connected to one wall of the inflatable product (e.g., an inner wall 311 of the pool wall of the inflatable pool), and the second end of the tensioning member 34 is connected to the other wall of the inflatable product (e.g., the outer wall of the pool wall of the inflatable pool). For example, the tensioning member 34 is connected to one wall of the inflatable product (e.g., the inner wall 311 of the pool wall of the inflatable pool) by gluing, hot pressing, welding (e.g., thermal welding or high-frequency welding), or another manner.

Figure 14C:
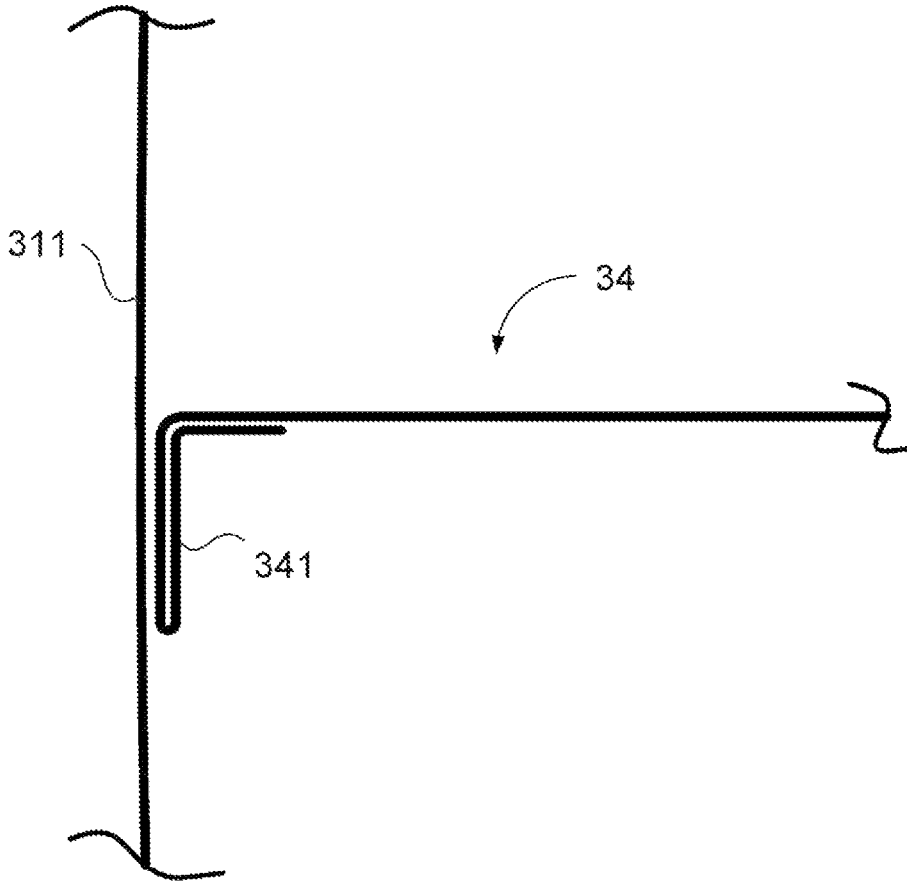
FIG. 14*c* illustrates a connection manner of a connecting member and a tensioning member according to an example embodiment.

In some example embodiments, the tensioning member 34 may be provided with a folded portion at each of the two ends. As shown in FIG. 14*c*, the material at the ends of the tensioning member 34 is folded over and overlapped, and overlapped portions are joined together by gluing, hot pressing, welding (e.g., thermal welding or high-frequency welding) or another manner to form a folded portion 341. The folded portion 341 is connected to one wall of the inflatable product (e.g., the inner wall 311 of the pool wall of the inflatable pool) by gluing, hot pressing, welding (e.g., thermal welding or high-frequency welding), or another manner. A thickness of the folded portion 341 is greater than a thickness of a middle portion of the tensioning member 34, and compared with the laminated material 340 that is unfolded, it has a higher strength and is less prone to a fatigue crack, so that the inflatable product may be more reliable.

Alternatively, the strands in the fiber layer may be arranged in other directions. For example, referring to FIG. 14*b*, the laminated material 342 includes a first covering layer 3421, a second covering layer 3422, and a fiber layer 3423. The fiber layer 3423 comprises a plurality of strands 34231. A direction of a tensile force applied to the laminated material 340 in the tensioning member 34 is indicated by the arrows. The directions of the strands 34231 are perpendicular or substantially perpendicular to the direction of the tensile force. In other example embodiments, the strands 34231 are arranged obliquely between the first covering layer 3421 and the second covering layer 3422, and the strands 34231 are neither parallel to the direction of the tensile force nor perpendicular to the direction of the tensile force. In other words, an angle between the strands 34231 and the direction of the tensile force may be an acute angle.

For the inflatable product including the tensioning member 34, its reliability and appearance may be improved by the arrangement of the tensioning member 34.

Figure 14D:
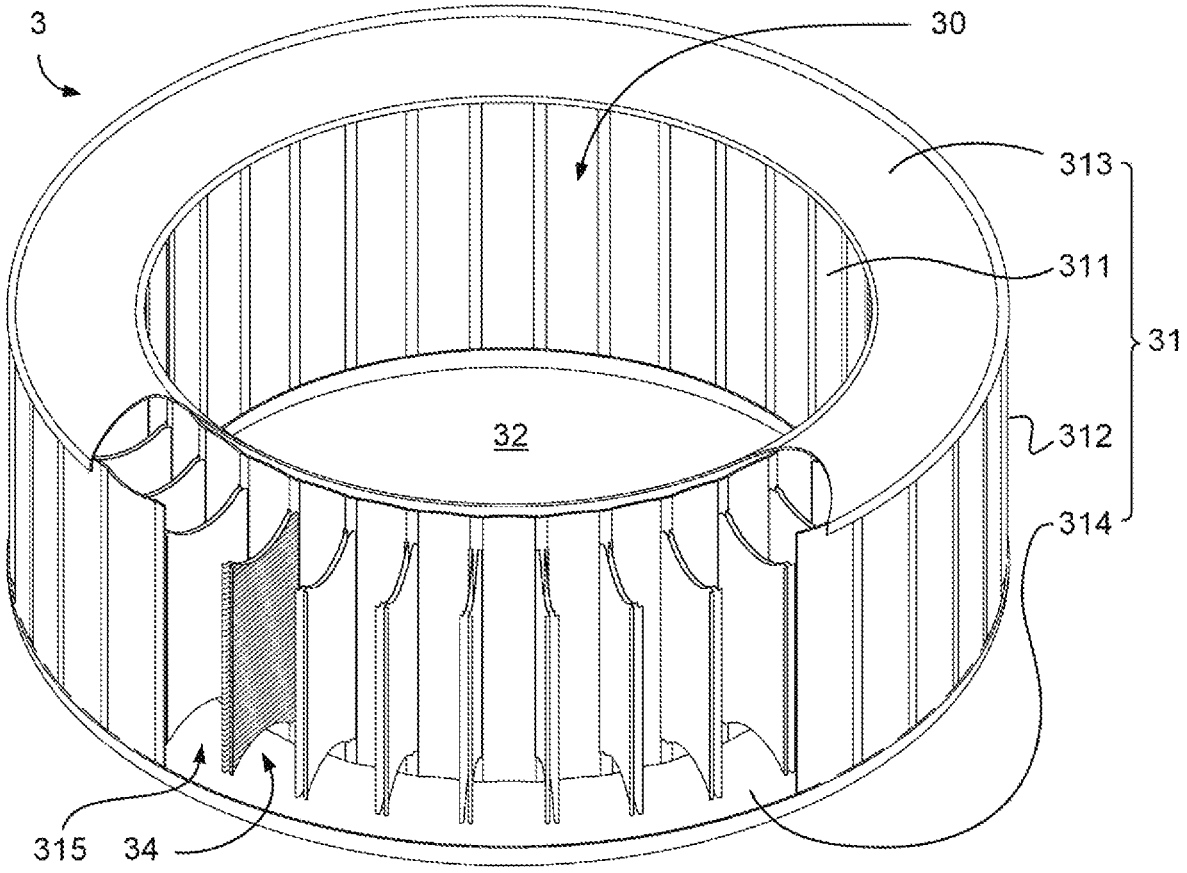
FIG. 14*d* and FIG. 14*e* illustrate an inflatable pool in an example embodiment in which tensioning members are arranged in an inflatable chamber of the inflatable pool.
Figure 14E:
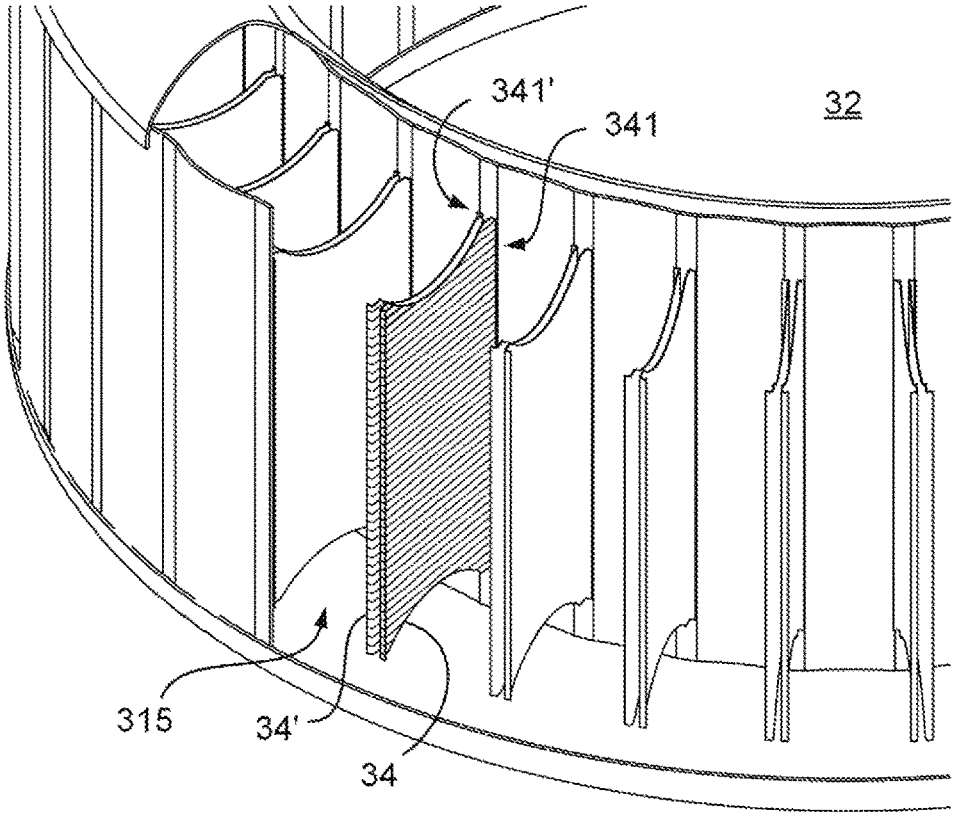

Referring to FIG. 14*d* and FIG. 14*e*, in an example embodiment, the inflatable product is an inflatable pool 3. The inflatable pool 3 comprises a pool wall 31 and a pool bottom 32. The pool wall 31 is connected to the pool bottom 32 and defines a water cavity 30. The pool wall 31 comprises an inner wall 311, an outer wall 312, and an inflatable chamber 315, and the inflatable chamber 315 is defined between the inner wall 311 and the outer wall 312. For example, the pool wall 31 further includes a top wall 313 and a bottom wall 314. The top wall 313 is connected to an upper end of the inner wall 311 and an upper end of the outer wall 312, the bottom wall 314 is connected to a lower end of the inner wall 311 and a lower end of the outer wall 312, and the inner wall 311, the outer wall 312, the top wall 313, and the bottom wall 314 define the inflatable chamber 315. External air enters the inflatable chamber 315 through an air passage provided on the pool wall 31 to inflate the inflatable chamber 315. A plurality of tensioning member pairs are arranged in the inflatable chamber 315, and each tensioning member pair includes a tensioning member 34 and a tensioning member 34'. Alternatively, one or more tensioning member groups, each including more than two tensioning members, may be provided. The tensioning member 34 and the tensioning member 34' are arranged in parallel, the distance between the two being much smaller than the distance between adjacent tensioning member pairs. Two or more tensioning members in a tensioning member pair disperse a tensile force applied at a connection position between the inflatable chamber of the inflatable product and the tensioning member, allowing the inflatable product a relatively smooth outer surface and potentially reducing tensile force applied to each individual tensioning member. Accordingly, improved safety of the inflatable product and prolonging service life of the inflatable product.

One side of each tensioning member 34 is connected to the inner wall 311, and the other side of the tensioning member 34 is connected to the outer wall 312. One side of each tensioning member 34' is connected to the inner wall 311, and the other side of the tensioning member 34' is connected to the outer wall 312. The tensioning member 34 and tensioning member 34' cannot be stretched or may be difficult to be stretched. The inner wall 311 and the outer wall 312 are respectively pulled by the tensioning member group toward the inflatable chamber 315, so that the pool wall 31 and the inflatable chamber 315 can maintain a desired shape.

Each tensioning member group or pair of the inflatable pool 3 may be vertically disposed in the inflatable chamber 315, or substantially vertically disposed in the inflatable chamber 315, and these tensioning member pairs/groups are arranged in an array in the inflatable chamber 315. It is to be noted that the tensioning member pair/group vertically or substantially vertically arranged is only used to illustrate specific example implementations. The tensioning member pairs/groups are not limited to be arranged vertically as shown in FIG. 14*d* and FIG. 14*e*.

Each tensioning member 34 is connected to two walls of the inflatable product (e.g., the inner wall 311 and the outer wall 312 of the pool wall 31) respectively through folded portions (e.g., folded portions 341) at both sides thereof.

The tensioning members and connecting members that can be used for the inflatable product, and the way of assembling the tensioning members in the inflatable product are described above in detail based on inclusion in an example inflatable pool. However, the tensioning member, the connecting member, and the described method of assembling these are not only applicable to inflatable pools, but also applicable to other inflatable products, including but not limited to inflatable toys, inflatable sofas, air mattresses, inflatable Stand-up Paddle Boards (SUP Boards), etc. After the inflatable product is inflated, the tensioning member is tensioned and provides a tensile force to limit a deformation of the inflatable product, maintaining the inflatable product in a certain shape.

Figure 15:
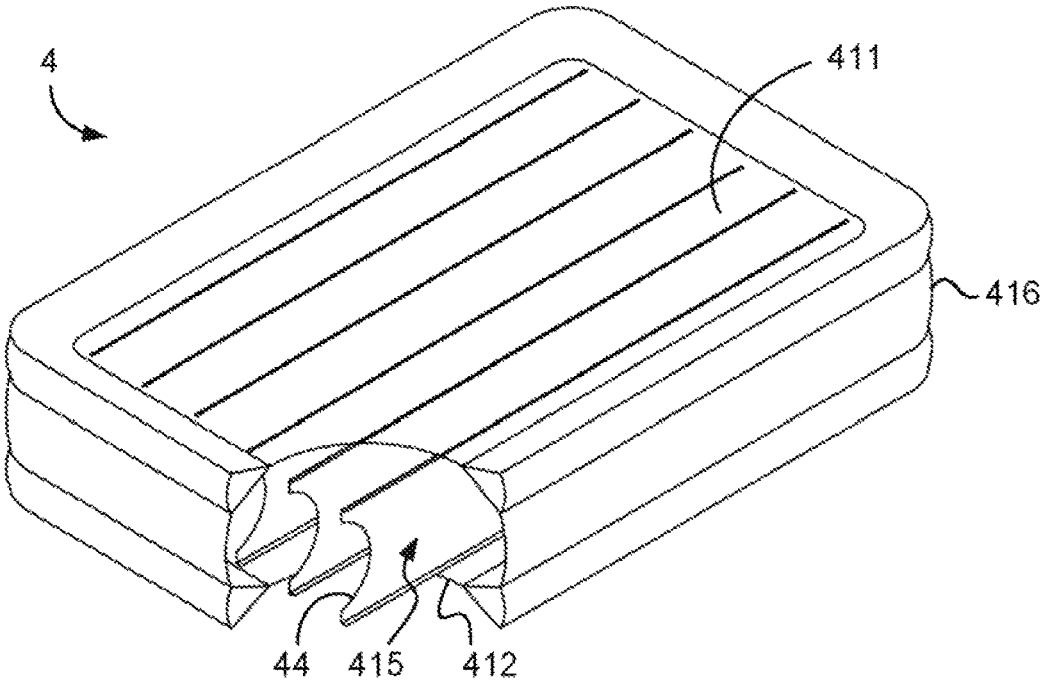
FIG. 15 illustrates an inflatable mattress in an example embodiment in which tensioning members are arranged in an inflatable chamber of the inflatable mattress.

For example, FIG. 15 illustrates an air mattress 4 that comprises a top wall 411 and a bottom wall 412, and further comprises a side wall 416. The top wall 411, the bottom wall 412 and the side wall 416 define an inflatable chamber 415. A plurality of tensioning members 44 are arranged in the inflatable chamber 415, and both sides of each tensioning member 44 are directly or indirectly connected to the top wall 411 and the bottom wall 412, respectively. The tensioning members 44 are optionally distributed in an array. After the air mattress 4 is inflated, the tensioning member 44 is tensioned and provides a tensile force to limit deformations of the top wall 411 and the bottom wall 412, maintaining the air mattress 4 in a certain shape.

Figure 16A:
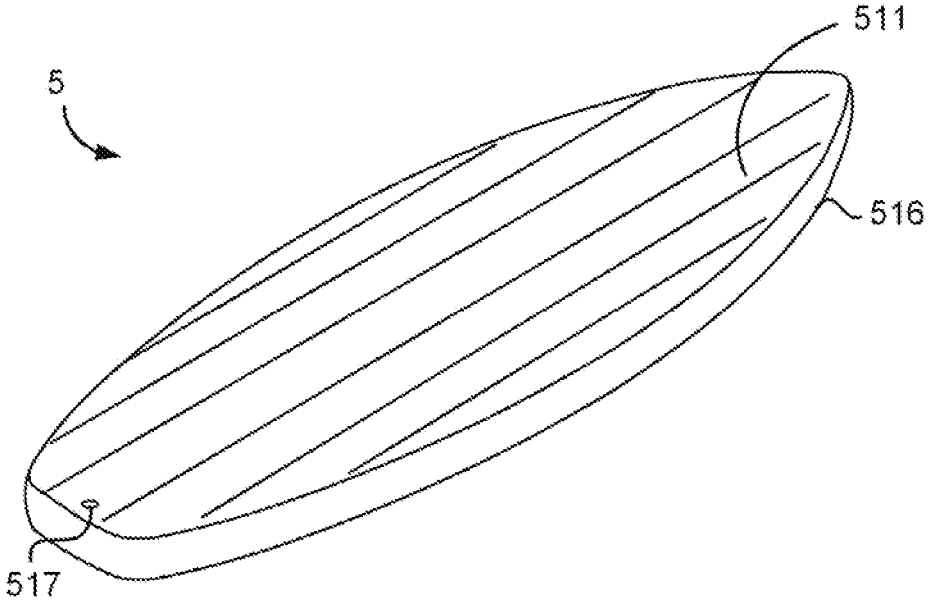
FIG. 16*a* and FIG. 16*b* illustrate a stand-up paddle board in an example embodiment in which tensioning members are arranged in an inflatable chamber of the stand-up paddle board.
Figure 16B:
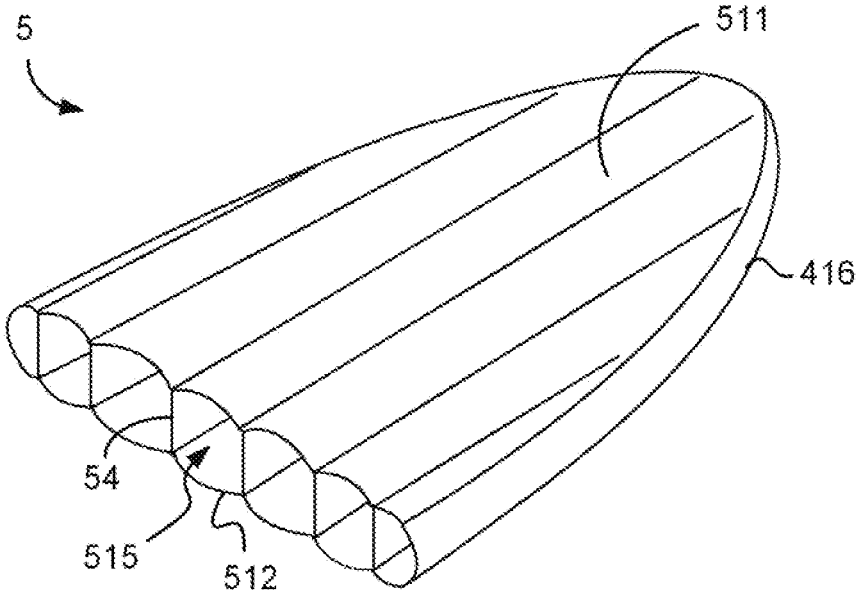

FIG. 16*a* and FIG. 16*b* illustrate an inflatable stand-up paddle board 5, which comprises a top wall 511 and a bottom wall 512, and further comprises a side wall 516. The top wall 511, the bottom wall 512 and the side wall 516 define an inflatable chamber 515. The stand-up paddle board further comprises an inflation inlet 517. The inflation inlet 517 is may be provided on the top wall 511 in FIG. 16*a*. A plurality of tensioning members 54 are arranged in the inflatable chamber 515, and both sides of each tensioning member 54 are directly or indirectly connected to the top wall 511 and the bottom wall 512. The tensioning members 54 are optionally distributed in an array. After the inflatable stand-up paddle board 5 is inflated, the tensioning member 54 is tensioned and provides a tensile force to limit deformations of the top wall 511 and the bottom wall 512, maintaining the inflatable stand-up paddle board 5 in a certain shape.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable product, comprising:
a chamber wall;
an inflatable chamber defined by the chamber wall;
a connecting member disposed in the inflatable chamber and comprising:
a first covering layer welded to the chamber wall and including a first surface and a second surface; and
a first fiber layer attached to the first surface of the first covering layer and disposed between the chamber wall and the first covering layer; and
a tensioning member disposed in the inflatable chamber and comprising
a woven fabric connected to the second surface of the first covering layer and sewn to the first fiber layer.

2. The inflatable product of claim 1, wherein the first fiber layer of the connecting member comprises a plurality of parallel strands.

3. The inflatable product of claim 1, wherein the connecting member further comprises a second covering layer, and the fiber layer is disposed between the first covering layer and the second covering layer.

4. The inflatable product of claim 1,
the connecting member further comprising:
a second covering layer;
a third covering layer; and
a second fiber layer disposed between the second covering layer and the third covering layer;
wherein the first fiber layer is disposed between the first covering layer and the second covering layer.

5. The inflatable product of claim 1,
the connecting member further comprising a second covering layer; and
a second fiber layer disposed between the second covering layer and the chamber wall;
wherein the first fiber layer is disposed between the first covering layer and the second covering layer.

6. The inflatable product of claim 1,
the connecting member further comprising:
a second covering layer;
a third covering layer;
a fourth covering layer; and
a second fiber layer disposed between the third covering layer and the fourth covering layer;
wherein the first fiber layer is disposed between the first covering layer and the second covering layer.

7. The inflatable product of claim 1, wherein the inflatable product is an inflatable pool.

8. An inflatable product comprising:
a first wall;
a second wall opposite to the first wall;
an inflatable chamber defined between the first wall and the second wall;
a plurality of pairs of connecting members, each of the plurality of pairs of connecting members including:
a first connecting member, including:
a first covering layer welded to the first wall and including a first surface and a second surface; and
a first fiber layer attached to the first surface of the first covering layer of the first connecting member and disposed between the first wall and the first covering layer of the first connecting member; and
a second connecting member, including:
a first covering layer welded to the second wall and including a first surface and a second surface; and
a first fiber layer attached to the first surface of the first covering layer of the second connecting member and disposed between the second wall and the first covering layer of the second connecting member; and
a plurality of tensioning members disposed in the inflatable chamber,
each of the plurality of tensioning members connected to one of the plurality of pairs of connecting members and including a woven fabric having a first portion and a second portion,
wherein the first portion of the woven fabric one of the plurality of tensioning members is connected to the second surface of the first covering layer of the corresponding first connecting member and sewn to the first fiber layer of the corresponding first connecting member; and
the second portion of the woven fabric one of the plurality of tensioning members is connected to the second surface of the first covering layer of the corresponding second connecting member and sewn to the first fiber layer of the corresponding second connecting member.

9. The inflatable product of claim 8, wherein the first fiber layer of the first connecting member comprises a plurality of parallel strands, and the first fiber layer of the second connecting member comprises a plurality of parallel strands.

10. The inflatable product of claim 8, wherein the first connecting member further comprise a second covering layer, and the first fiber layer of the first connecting member is disposed between the first and second covering layers of the first connecting member.

11. An inflatable product comprising:
a first wall;
a second wall opposite to the first wall;
an inflatable chamber defined between the first wall and the second wall;
a pair of connecting members including:
a first connecting member, including:
a first covering layer welded to the first wall and including a first surface and a second surface; and
a first fiber layer attached to the first surface of the first covering layer of the first connecting member and disposed between the first wall and the first covering layer of the first connecting member; and
a second connecting member, including:
a first covering layer welded to the second wall and including a first surface and a second surface; and
a first fiber layer attached to the first surface of the first covering layer of the second connecting member and disposed between the second wall and the first covering layer of the second connecting member; and
a tensioning member disposed in the inflatable chamber and connected to the first and second connecting members, the tensioning member including a woven fabric having a first portion and a second portion;

wherein the first portion of the tensioning member is connected to the second surface of the first covering layer of the first connecting member and sewn to the first fiber layer of the first connecting member; and the second portion of the tensioning member is connected to the second surface of the first covering layer of the second connecting member and sewn to the first fiber layer of the second connecting member.

12. The inflatable product of claim 11, wherein the first fiber layer of the first connecting member comprises a plurality of parallel strands, and the first fiber layer of the second connecting member comprises a plurality of parallel strands.

13. The inflatable product of claim 11, wherein, the first connecting member further comprises a second covering layer, and the first fiber layer of the first connecting member is disposed between the first and second covering layers of the first connecting member.

* * * * *